US012442098B2

(12) United States Patent
Leach et al.

(10) Patent No.: US 12,442,098 B2
(45) Date of Patent: Oct. 14, 2025

(54) METHODS OF ELECTROCHEMICAL DEPOSITION

(71) Applicant: Gary William Leach, Coquitlam (CA)

(72) Inventors: Gary William Leach, Coquitlam (CA); Sasan Vosoogh-Grayli, North Vancouver (CA); Finlay Charles Henry Macnab, Vancouver (CA)

( * ) Notice: Subject to any disclaimer, the term of this patent is extended or adjusted under 35 U.S.C. 154(b) by 0 days.

(21) Appl. No.: 16/260,091

(22) Filed: Jan. 28, 2019

(65) Prior Publication Data

US 2019/0256995 A1 Aug. 22, 2019

Related U.S. Application Data

(63) Continuation-in-part of application No. PCT/CA2017/050914, filed on Jul. 28, 2017.
(Continued)

(51) Int. Cl.
*C23C 18/31* (2006.01)
*C23C 18/08* (2006.01)
(Continued)

(52) U.S. Cl.
CPC ..... *C25D 3/02* (2013.01); *C23C 18/08* (2013.01); *C23C 18/143* (2019.05); *C23C 18/31* (2013.01);
(Continued)

(58) Field of Classification Search
CPC .. C25D 3/56; C25D 3/02; C23C 18/08; C23C 18/54; C23C 18/42; C23C 18/143;
(Continued)

(56) References Cited

U.S. PATENT DOCUMENTS 3,532,519 A * 10/1970 Hirohata ..... C23C 18/1683 427/8
3,551,997 A * 1/1971 Etter ..... C03C 27/046 228/124.1
(Continued)

FOREIGN PATENT DOCUMENTS

CN 103691968 7/2016
WO WO-2016013426 A1 * 1/2016 ..... C09D 171/02

OTHER PUBLICATIONS

Ee, et al, "Effect of processing parameters on electroless Cu seed layer properties" Thin Solid Films 462-463 (2004), pp. 197-201. (Year: 2004).*
(Continued)

*Primary Examiner* — Katherine A Bareford
(74) *Attorney, Agent, or Firm* — Millen, White, Zelano & Branigan, P.C.; Christopher W. Brody

(57) ABSTRACT

A method of electrochemical deposition of a metallic material onto a substrate is provided. The method includes providing an alkaline solution of hydroxide ions, immersing a metallic material precursor and the substrate into the alkaline solution to form an electrochemical bath, and electrochemically depositing a textured layer of the metallic material onto the substrate. A method of electrochemical deposition of a textured nanoparticle is provided. The method includes providing an alkaline solution of hydroxide ions, immersing the metallic material into the alkaline solution to form an electrochemical bath, and precipitating the textured nanoparticles from the electrochemical bath. A method of electrochemical deposition of a metallic material onto a nanoparticle is provided. The method includes providing an alkaline solution of hydroxide ions, immersing the metallic material and the nanoparticle into the alkaline
(Continued)

solution to form an electrochemical bath, and depositing a textured layer of the metallic material onto the nanoparticle.

20 Claims, 23 Drawing Sheets

Related U.S. Application Data

(60) Provisional application No. 62/368,292, filed on Jul. 29, 2016.

(51) Int. Cl.

| | |
|---|---|
| ***C23C 18/14*** | (2006.01) |
| ***C23C 18/42*** | (2006.01) |
| ***C23C 18/54*** | (2006.01) |
| ***C25D 3/02*** | (2006.01) |
| ***C25D 3/56*** | (2006.01) |

(52) U.S. Cl.
CPC ..... *C23C 18/42* (2013.01); *C23C 18/54* (2013.01); *C25D 3/56* (2013.01)

(58) Field of Classification Search
CPC ..... C23C 18/31; C23C 18/34; C23C 18/40; C23C 18/44; C23C 18/48; C23C 18/32; C23C 18/38; C23C 18/405; C23C 18/36; C23C 18/1683
See application file for complete search history.

(56) References Cited

U.S. PATENT DOCUMENTS

| | | | | |
|---|---|---|---|---|
| 3,961,109 | A * | 6/1976 | Kremer | C23C 18/30 106/1.11 |
| 4,908,242 | A * | 3/1990 | Hughes | C23C 18/1617 106/1.23 |
| 5,435,898 | A | 7/1995 | Commander et al. | |
| 2003/0050188 | A1* | 3/2003 | Ovshinsky | H01M 4/90 502/337 |
| 2003/0165633 | A1* | 9/2003 | Ryu | H05K 3/381 427/535 |
| 2005/0093166 | A1* | 5/2005 | Higashi | H01L 21/76874 257/774 |
| 2006/0228488 | A1* | 10/2006 | Sung | C23C 18/1619 427/437 |
| 2009/0107845 | A1 | 4/2009 | Arzt et al. | |
| 2010/0155257 | A1 | 6/2010 | Brunner et al. | |
| 2011/0094889 | A1* | 4/2011 | Shin | C09D 11/101 205/122 |
| 2013/0022899 | A1 | 1/2013 | Arai et al. | |
| 2013/0316190 | A1 | 11/2013 | Bedrnik et al. | |
| 2014/0162067 | A1 | 6/2014 | Shahjamali et al. | |
| 2015/0320895 | A1* | 11/2015 | Sun | B22F 1/0018 600/8 |
| 2015/0337452 | A1* | 11/2015 | Arvin | C25D 21/12 204/229.1 |
| 2016/0175937 | A1 | 6/2016 | Xia et al. | |
| 2017/0044679 | A1* | 2/2017 | Jin | C23C 14/00 |
| 2017/0213615 | A1* | 7/2017 | Okada | B22F 3/1021 |

OTHER PUBLICATIONS

Hasan, et al "Growth and Density Time Dependence of Electroless Cu Films Deposited onto Au Using Cu-EDTA-HCHO Bath", Electrochemical and Solid-State Letters, 8 (10) (2005), pp. C145-C147. (Year: 2005).*

Jian Li, "On the Texture of Electroless . . . on Si (100) and Si (111) Substrates", Journal of Electrochemical Society, vol. 139, No. 4, Apr. 1, 1992, pp. L37-L39, XP55679930.

Olivier S. et al., "Inhomogeneous nucleation and . . . advanced copper interconnects", Thin Solid Films, vol. 518, No. 17, Jun. 30, 2010, pp. 4773-4778, XP027065069.

Gangaiah M. et al., "Site selective Cu . . . versus planar surfaces", CRYSTENGCOMM, vol. 17, No. 48, Jan. 1, 2015, pp. 9459-9465, XP55679848.

R. Sard, "Influence of Substrate Structure on Electroless Gold Deposition", Journal of the Electrochemical Society, vol. 123, No. 11, Jan. 1, 1976, p. 1604, XP55679911.

Devi et al., Synthesis of silica/Au core-shell nanostructures by galvanic replacement of silica/Ag in aqueous and alkaline medium. Journal of Experimental Nanoscience, 2015. vol. 10, No. 5, pp. 371-380.

Lahav et al. Core-Shell and Segmented Polymer-Metal Composite Nanostructures. Nano Letters, 2006, vol. 6, No. 9, pp. 2166-2171.

Uysal, et al. The Preparation of Core-Shell A1203/Cu Composite Powders by Electroless Plating in the Alkaline Solution. ACTA Physica Polonica A, 2013, vol. 123, No. 2, pp. 238-240.

Chang et al. Electroless Plating Growth Au—Ag Core-Shell Nanoparticles for Surface Enhanced Raman Scattering. Int. J. Electrochem. Sci., 8 (2013), pp. 6889-6899.

* cited by examiner nanoantenna
d Au EED

/stalline gold
pect ratio.

METHODS OF ELECTROCHEMICAL DEPOSITION

REFERENCE TO RELATED APPLICATIONS

This application is a continuation in part of Patent Cooperation Treaty application No. PCT/CA2017/050914 filed 28 Jul. 2017 and entitled METHODS OF ELECTROCHEMICAL DEPOSITION, which in turn claims priority from, and for the purposes of the United States the benefit under 35 USC 119(e) of, U.S. Patent Application Ser. No. 62/368,292, entitled METHOD OF ELECTROCHEMICAL DEPOSITION, filed 29 Jul. 2016. The patent applications referred to in this paragraph are hereby incorporated herein by reference.

TECHNICAL FIELD

This application relates to textured layers of metallic materials, textured nanocrystals, core-shell nanoparticles having a textured shell, and methods of electrochemical deposition for producing textured layers of metallic materials, textured nanocrystals, and core-shell nanoparticles having a textured shell.

BACKGROUND

The controlled formation of nanostructures and the deposition of metals, metal alloys, and metal-containing compounds represents an important aspect of many modern day technologies, including, without limitation, semiconductor fabrication (e.g. forming metal interconnects), use of planar and nanostructured metal films in plasmonic, nanophotonic, and meta-material applications, deposition of patterned, high aspect ratio metal structures for X-ray optics, production of energy conversion technologies and sensors, use of metals, metal alloys, and metal nanostructures for catalyzing chemical reactions, use of magnetic alloy materials for magnetic storage applications, etc. For these and related technologies, such as those requiring metal nanowires, there may be a desire for patterning of metallic materials at smaller size scales than those that are currently employed. Improved methods for their controlled formation will may also be desirable.

Metal nanoparticles play important roles in many different technological and commercial applications. For example, metal nanoparticles serve as a model system to experimentally probe the effects of quantum-confinement on electronic, magnetic, and other related properties. They have also been widely exploited for use in photography, catalysis, biological labeling, photonics, optoelectronics, information storage, surface-enhanced Raman scattering (SERS), and formulation of magnetic ferrofluids. The intrinsic properties of metal nanoparticles may be related to a number of parameters which include, without limitation, their size, shape, composition, crystallinity, and structure. These parameters can be used to control the properties of the nanoparticles. For example, the plasmon resonance features of gold or silver nanorods have been shown to have a strong dependence on the aspect-ratios of these nanostructures. The sensitivity of SERS has also been demonstrated to depend on the morphology of a silver nanoparticle. Silver nanoparticles are also subject to oxidation, which limits their stability and utility in many different environments. One strategy that has been proposed to circumvent this shortcoming is to encapsulate the silver nanoparticle with a thin layer of gold, since gold is significantly more resistant to oxidation than silver. However, attempts to reduce gold onto silver nanoparticles are limited by so-called galvanic replacement, where gold ion ($Au^{3+}$) reduction comes at the expense of silver (Ag) oxidation, resulting in porous, mixed composition structures with undesirable SERS response. U.S. Pat. No. 9,394,168 entitled "Methods of nanostructure formation and shape selection" describes methods to take advantage of porous nanostructures formed in this manner, due to their relatively lower density and higher surface area than their solid counterparts. However, the ability to make Au/Ag core-shell nanoparticles without compromising the integrity of the silver core would extend the SERS activity and stability of these structures, as well as offer new plasmonic applications. Thus, there remains a desire to develop new methods of metal reduction that mitigate the effects of galvanic replacement.

The electrochemical deposition of metals, metal alloys, and metal-containing compounds is widely used in many industries and represents a versatile and inexpensive deposition method. However, in many cases, the quality of electrochemical deposition is subject to kinetic and thermodynamic factors that limit the fidelity and crystallinity of the resulting deposited material. For example, the rates of nucleation and growth in conventional electrodeposition and electroless deposition of metallic materials often result in polycrystalline deposition characterized by voids, defects, and grain boundaries that can limit performance in certain applications. Due to losses at grain boundaries and defects, such materials typically have poor performance characteristics and compromised thermal and mechanical stabilities. For example, the resistivity of a material increases as a result of imperfections, such as defects, impurities, grain boundaries, and dislocations (see Ziman, J. M. "Electrons and Phonons", Clarendon Press, Oxford, 1960). Conventional attempts to improve the quality of the materials resulting from electrochemical deposition rely on the use of additives and stabilizers in the electrochemical bath. U.S. Pat. No. 4,525,390 entitled "Deposition of Copper From Electroless Plating Compositions" describes electrochemical bath compositions and methods to reduce the number of voids and nodules encountered during copper deposition into printed circuit board interconnects. These voids may lead to unreliable electrical connections and cracking in printed circuit boards, while nodules may result in unwanted short circuits between printed circuit board elements.

The ability to form nanocrystals and core-shell nanoparticles and to deposit crystalline metallic materials using electrochemical reduction methods is anticipated to provide opportunities for improved performance of existing technologies as well as the development of new technologies. There are some known methods for depositing crystalline metallic materials. However, most of these known methods use high vacuum or ultrahigh vacuum methods (such as molecular beam epitaxy, vapor phase epitaxy, and atomic layer epitaxy) or high temperature furnaces (such as in liquid phase epitaxy). As a result, these methods are costly and time consuming. U.S. Pat. No. 6,670,308 entitled "Method of Depositing Epitaxial Layers on a Substrate" describes electrochemical deposition methods to produce substantially single orientation epitaxial layers. Sodium borohydride and sodium hypophosphate are used as reducing agents for electrochemical deposition. Such reducing agents oxidize substrates susceptible to galvanic replacement in the presence of a metal salt (e.g. silver (Ag)).

Improved control over metallic material deposition remains a significant challenge for many technologies and new methods that achieve crystalline material deposition electrochemically are extremely desirable. Therefore, there is a desire for improved methods for forming textured nanocrystals and core-shell nanoparticles having a textured shell, and for the electrochemical deposition of textured layers of metallic materials on substrates including, but not limited to, single-crystal substrates, patterned substrates, and articles formed on a substrate.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One aspect of the invention provides a method of electrochemical deposition of a metallic material onto a substrate. The method includes providing an alkaline solution of hydroxide ions, immersing a metallic material precursor and the substrate into the alkaline solution to form an electrochemical bath, and electrochemically depositing a textured layer of the metallic material onto the substrate.

Another aspect of the invention provides a method electrochemical deposition of a textured nanoparticle. The method includes providing an alkaline solution of hydroxide ions, immersing the metallic material into the alkaline solution to form an electrochemical bath, and precipitating the textured nanoparticles from the electrochemical bath.

Another aspect of the invention provides a method of electrochemical deposition of a metallic material onto a nanoparticle. The method includes providing an alkaline solution of hydroxide ions, immersing the metallic material and the nanoparticle into the alkaline solution to form an electrochemical bath, and depositing a textured layer of the metallic material onto the nanoparticle.

Further aspects of the invention are described in the claims.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

SUMMARY

Figure 1:
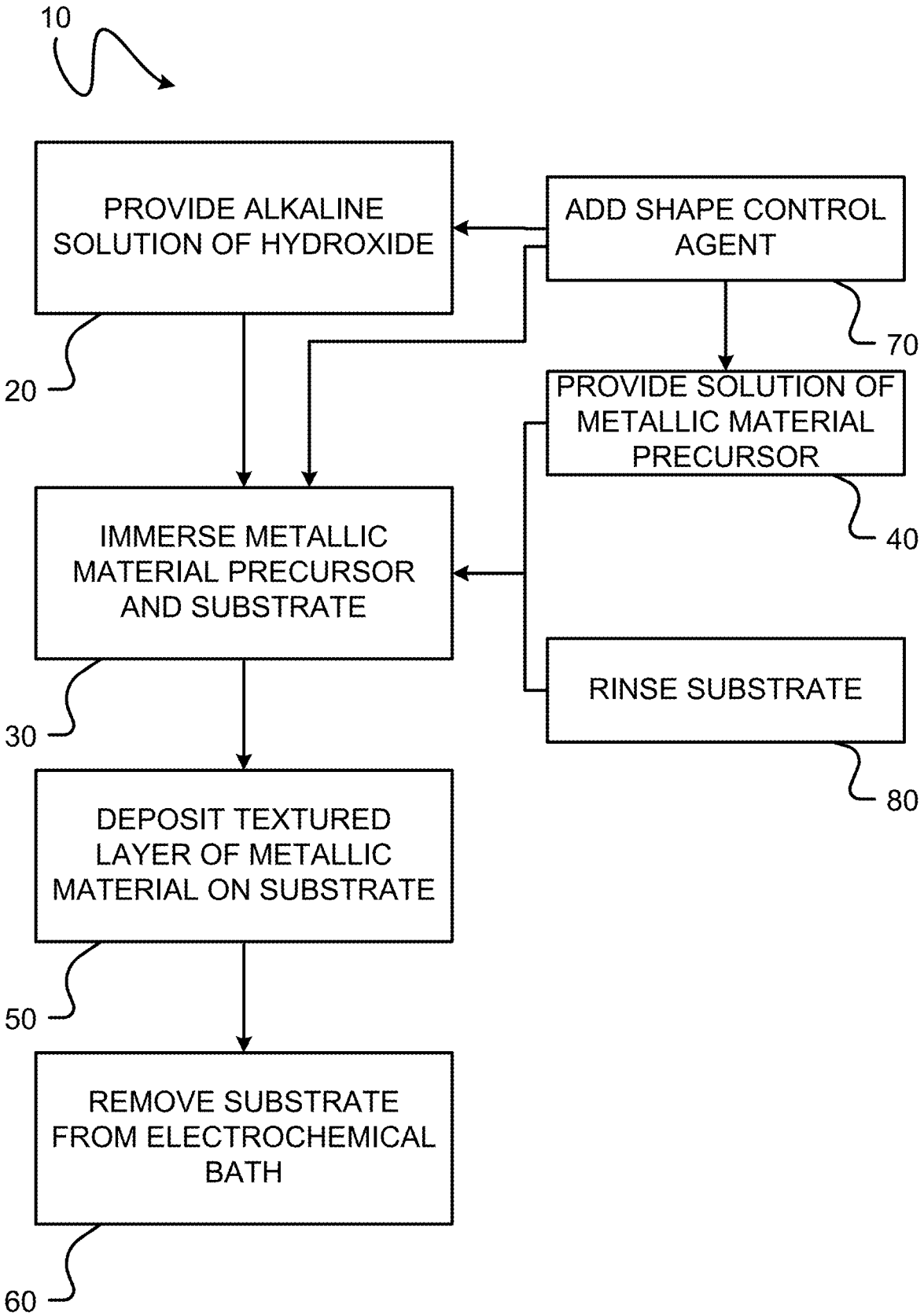
FIG. 1 is a flow chart which illustrates methods for electrochemical deposition of a textured layer of a metallic material on a substrate according to an example embodiment of the present invention.

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

The invention has a number of non-limiting aspects. Non-limiting aspects of the invention include the following.

1. A method of electrochemical deposition of a metallic material onto a substrate, the method comprising:
   providing an alkaline solution of hydroxide ions;
   immersing a metallic material precursor and the substrate into the alkaline solution to form an electrochemical bath; and
   electrochemically depositing a textured layer of the metallic material onto the substrate.
2. A method according to aspect 1 or any other aspect herein, wherein immersing the metallic material precursor comprises making a solution of the metallic material precursor and adding the resulting metallic material precursor solution to the alkaline solution.
3. A method according to aspect 1 or 2 or any other aspect herein, wherein the metallic material precursor comprises a salt form of one or more of a metal, a metal alloy, and a metal-containing compound.
4. A method according to aspect 1 or 2 or any other aspect herein, wherein the metallic material precursor comprises a solid anode comprising one or more of a metal, a metal alloy, and a metal-containing compound.
5. A method according to any one of aspects 1 to 4 or any other aspect herein, wherein the metallic material comprises one or more of a metal, a metal alloy, and a metal-containing compound.
6. A method according to any one of aspects 1 to 5 or any other aspect herein, wherein the substrate is immersed in the alkaline solution simultaneously with the metallic material precursor.
7. A method according to any one of aspects 1 to 6 or any other aspect herein, wherein the substrate is immersed in the alkaline solution before the metallic material precursor.
8. A method according to any one of aspects 1 to 7 or any other aspect herein, further comprising rinsing the substrate with an alcohol before immersing the substrate in the alkaline solution.
9. A method according to aspect 8 or any other aspect herein, wherein the alcohol comprises one or more of methanol, ethanol, and isopropyl alcohol.
10. A method according to aspect 8 or 9 or any other aspect herein, wherein the alcohol comprises isopropyl alcohol.
11. A method according to any one of aspects 1 to 10 or any other aspect herein, wherein the electrochemical bath is aqueous.
12. A method according to any one of aspects 1 to 10 or any other aspect herein, wherein the electrochemical bath is non-aqueous.
13. A method according to any one of aspects 1 to 10 or any other aspect herein, wherein the electrochemical bath comprises aqueous and non-aqueous liquids.
14. A method according to any one of aspects 1 to 13 or any other aspect herein, further comprising adding one or more of an additive and one or more shape control agents to one or more of the alkaline solution, the metallic material precursor solution, and the electrochemical bath.

15. A method according to aspect 14 or any other aspect herein, wherein the one or more shape control agents comprise one or more of malachite green chloride, polyvinylpyrrolidone (PVP), cetyltrimethylammonium bromide (CTAB), chloride ions ($Cl^-$), sulphate ions ($SO_4^{2-}$) and nitrate ions ($NO_3^-$).
16. A method according to any one of aspects 1 to 15 or any other aspect herein, wherein the alkaline solution further comprises a reducing agent in addition to the hydroxide ions.
17. A method according to any one of aspects 1 to 16 or any other aspect herein, wherein the pH of the alkaline solution is greater than about 10.
18. A method according to any one of aspects 1 to 17 or any other aspect herein, wherein the pH of the alkaline solution is in the range of about 10 to about 15.
19. A method according to any one of aspects 1 to 17 or any other aspect herein, wherein the pH of the electrochemical bath is greater than about 10.
20. A method according to any one of aspects 1 to 17 and 19 or any other aspect herein, wherein the pH of the electrochemical bath is in the range of about 10 to about 15.
21. A method according to any one of aspects 1 to 17 or any other aspect herein, wherein the pH of the electrochemical bath is about 10.
22. A method according to any one of aspects 1 to 17 or any other aspect herein, wherein the pH of the electrochemical bath is about 11.
23. A method according to any one of aspects 1 to 17 or any other aspect herein, wherein the pH of the electrochemical bath is about 12.
24. A method according to any one of aspects 1 to 17 or any other aspect herein, wherein the pH of the electrochemical bath is about 13.
25. A method according to any one of aspects 1 to 17 or any other aspect herein, wherein the pH of the electrochemical bath is about 14.
26. A method according to any one of aspects 1 to 17 or any other aspect herein, wherein the pH of the electrochemical bath is about 15.
27. A method according to any one of aspects 1 to 26 or any other aspect herein, wherein the temperature of the electrochemical bath is in the range of about 5° C. to about 90° C.
28. A method according to any one of aspects 1 to 27 or any other aspect herein, wherein the temperature of the electrochemical bath is in the range of about 50° C. to about 80° C.
29. A method according to any one of aspects 1 to 28 or any other aspect herein, wherein the temperature of the electrochemical bath is about 70° C.
30. A method according to any one of aspects 1 to 29 or any other aspect herein, wherein the metallic material has a lower reduction potential than the substrate.
31. A method according to any one of aspects 1 to 29 or any other aspect herein, wherein the metallic material has a higher reduction potential than the substrate.
32. A method according to any one of aspects 1 to 29 or any other aspect herein, wherein electrochemically depositing the textured layer of the metallic material onto the substrate comprises forming a metal complex comprising the metallic material precursor and the hydroxide ions.
33. A method according to aspect 32 or any other aspect herein, wherein the metal complex has a lower reduction potential than the substrate.
34. A method according to aspect 32 or any other aspect herein, wherein the metal complex has a higher reduction potential than the substrate.
35. A method according to any one of aspects 1 to 34 or any other aspect herein, further comprising adding one or more electrodes to the electrochemical bath and applying a potential difference between the one or more electrodes.
36. A method according to any one of aspects 1 to 34 or any other aspect herein, wherein the one or more electrodes comprises the metallic material and the potential difference is applied between the metallic material and the electrode.
37. A method according to aspect 35 or 36 or any other aspect herein, wherein the one or more electrodes comprises the substrate and the potential difference is applied between the substrate and the electrode.
38. A method according to any one of aspects 35 to 37 or any other aspect herein, wherein the one or more electrodes comprises the substrate and the potential difference is applied between the substrate and the metallic material.
39. A method according to any one of aspects 35 to 38 or any other aspect herein, wherein electrochemically depositing the textured layer of the metallic material onto the substrate comprises electrodeposition of the textured layer of the metallic material onto the substrate.
40. A method according to any one of aspects 1 to 39 or any other aspect herein, further comprising exposing the electrochemical bath to electromagnetic radiation.
41. A method according to aspect 40 or any other aspect herein, wherein incident radiation induces redox reactions to deposit the textured layer of the metallic material onto the substrate.
42. A method according to aspect 40 or 41 or any other aspect herein, wherein electrochemically depositing the textured layer of the metallic material onto the substrate comprises photoelectrochemical deposition of the textured layer of the metallic material onto the substrate.
43. A method according to any one of aspects 1 to 34 or any other aspect herein, wherein electrochemically depositing the textured layer of the metallic material onto the substrate comprises electroless deposition of the textured layer of the metallic material onto the substrate.
44. A method according to any one of aspects 1 to 43 or any other aspect herein, wherein the layer of the metallic material is epitaxial.
45. A method according to any one of aspects 1 to 43 or any other aspect herein, wherein the layer of the metallic material is polycrystalline.
46. A method according to any one of aspects 1 to 43 or any other aspect herein, wherein the layer of the metallic material is crystalline.
47. A method according to any one of aspects 1 to 43 or any other aspect herein, wherein the layer of the metallic material is single-crystal.
48. A method according to any one of aspects 1 to 47 or any other aspect herein, wherein the substrate is susceptible to galvanic replacement in the presence of the metallic material precursor.
49. A method according to aspect 48 or any other aspect herein, wherein the ratio of the concentration of the hydroxide ions to the concentration of the metallic material precursor in the electrochemical bath is greater than about 400:1.

50. A method according to any one of aspects 1 to 47 or any other aspect herein, wherein the substrate is not susceptible to galvanic replacement in the presence of the metallic material precursor.

51. A method according to aspect 50 or any other aspect herein, wherein the ratio of the concentration of the hydroxide ions to the concentration of the metallic material precursor in the electrochemical bath is in the range of about 50:1 to about 400:1.

52. A method according to any one of aspects 1 to 47 or any other aspect herein, wherein the substrate is not susceptible to oxidation in the presence of the metallic material precursor.

53. A method according to aspect 52 or any other aspect herein, wherein the ratio of the concentration of the hydroxide ions to the concentration of the metallic material precursor in the electrochemical bath is greater than about 50:1.

54. A method according to any one of aspects 1 to 47 or any other aspect herein, wherein the ratio of the concentration of the hydroxide ions to the concentration of the metallic material precursor in the electrochemical bath is greater about 1700:1 when the deposited layer of the metallic material comprises an alloy.

55. A method according to any one of aspects 1 to 47 or any other aspect herein, wherein the ratio of the concentration of the hydroxide ions to the concentration of the metallic material precursor in the electrochemical bath is greater about 400:1 when the deposited layer of the metallic material comprises an alloy.

56. A method according to any one of aspects 1 to 47 or any other aspect herein, wherein the ratio of the concentration of the hydroxide ions to the concentration of the metallic material precursor in the electrochemical bath is greater about 10,000:1 when the deposited layer of the metallic material comprises an alloy.

57. A method according to any one of aspects 1 to 56 or any other aspect herein, wherein the substrate is non-soluble under basic conditions.

58. A method according to any one of aspects 1 to 57 or any other aspect herein, wherein the thickness of the textured layer of metallic material is in the range of about 70 nm to about 100 nm.

59. A method according to any one of aspects 1 to 58 or any other aspect herein, wherein a deposition period to deposit the textured layer of the metallic material onto the substrate is between about 0.5 hours to about 5 hours.

60. A method according to any one of aspects 1 to 58 or any other aspect herein, wherein a deposition period to deposit the textured layer of the metallic material onto the substrate is about 1 hour.

61. A method according to any one of aspects 1 to 60 or any other aspect herein, further comprising monitoring the concentration of the metallic material precursor in the electrochemical bath while depositing the textured layer of the metallic material onto the substrate.

62. A method according to any one of aspects 1 to 61 or any other aspect herein, further comprising adding the metallic material precursor to the electrochemical bath during depositing the textured layer of the metallic material onto the substrate.

63. A method according to any one of aspects 1 to 62 or any other aspect herein, further comprising monitoring the concentration of the hydroxide ions in the electrochemical bath while depositing the textured layer of the metallic material onto the substrate.

64. A method according to any one of aspects 1 to 63 or any other aspect herein, further comprising adding the hydroxide ions to the electrochemical bath during depositing the textured layer of the metallic material onto the substrate.

65. A method according to any one of aspects 1 to 64 or any other aspect herein, wherein the substrate is patterned.

66. A method according to aspect 65 or any other aspect herein, wherein the substrate is patterned according to one or more of the following: a lithographic process, wet etching, dry etching, electrodeposition, electroless deposition, physical vapor deposition, chemical deposition, and atomic layer deposition.

67. A method of electrochemical deposition of a textured nanoparticle, the method comprising:

providing an alkaline solution of hydroxide ions;

immersing the metallic material into the alkaline solution to form an electrochemical bath; and precipitating the textured nanoparticles from the electrochemical bath.

68. A method according to aspect 67 comprising any of the features, combinations of features, or sub-combinations of features of any of aspects 1 to 66.

69. A method of electrochemical deposition of a metallic material onto a nanoparticle, the method comprising:

providing an alkaline solution of hydroxide ions;

immersing the metallic material and the nanoparticle into the alkaline solution to form an electrochemical bath; and depositing a textured layer of the metallic material onto the nanoparticle.

70. A method according to aspect 69 comprising any of the features, combinations of features, or sub-combinations of features of any of aspects 1 to 68.

71. The plated substrate of the method according to any one of aspects 1 to 66.

72. The nanoparticles of the method according to aspect 67 or 68.

73. The core-shell nanoparticles of the method according to aspect 69 or 70.

74. Apparatus having any new and inventive feature, combination of features, or sub-combination of features as described herein.

75. Methods having any new and inventive steps, acts, combination of steps and/or acts, or sub-combination of steps and/or acts as described herein.

76. Compositions of matter having any new and inventive feature, combination of features, or sub-combination of features as described herein.

In addition to the exemplary aspects and embodiments described above, further aspects and embodiments will become apparent by reference to the drawings and by study of the following detailed descriptions.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Unless context dictates otherwise, "metallic material" (as used herein) refers to a metal, a metal alloy, a metal containing compound, a metallic material precursor, and mixtures thereof.

Unless context dictates otherwise, "metallic material precursor" (as used herein) refers to a solid anode comprising a metal, a metal alloy, a metal containing compound, and mixtures thereof and/or a salt of a metal, a metal alloy, a metal containing compound, or mixtures thereof.

Unless context dictates otherwise, "metal alloy" (as used herein) refers to a homogenous mixture of two or more metals.

Unless context dictates otherwise, "non-metal" (as used herein) refers to elements of the periodic table that are not a metal, chemical species that do not contain a metal, and mixtures thereof.

Unless context dictates otherwise, "metal-containing compound" (as used herein) refers to a compound that contains one or more metals. A metal-containing compound includes, but is not limited to, a coordination complex comprising a central metal atom or metal ion (i.e. the coordination centre) and a surrounding array of bound molecules or ions (i.e. the ligands or chemical species that contains one or more metallic elements. Examples include, but are not limited to, aluminum oxide ($Al_2O_3$), copper oxide ($Cu_2O$), zinc oxide (ZnO), cobalt monoxide (CoO), etc.

Unless context dictates otherwise, "uniform alloy composition" (as used herein) refers to the alloy composition of a deposition layer, wherein the distribution of the different metals is consistent throughout the thickness of the layer.

Unless context dictates otherwise, "substrate" (as used herein) refers to a catalytic or non-catalytic solid material capable of supporting a layer of metallic material deposited via electrochemical deposition. The solid material is non-soluble under basic conditions.

Unless context dictates otherwise, "polymeric material" (as used herein) refers to a large molecule, or macromolecule, formed by the polymerization of many smaller molecules, called monomers, in a form that often, but not always, comprises a repeating structure.

Unless context dictates otherwise "substantially crystalline substrate" (as used herein) refers to a material that is formed by one or more of physical vapor deposition, chemical vapor deposition, molecular beam epitaxy, atomic layer deposition, electrodeposition, electroless deposition, precipitation, diffusion, chemical reaction, and combinations thereof. Substantially crystalline substrates also include materials which have grown in crystalline form from a melted material or using other conventional methods that can nucleate material for producing crystalline materials.

Unless context dictates otherwise, "epitaxial" (as used herein) refers to an orientation of a layer of a material deposited on the surface of a substrate, wherein the layer mimics or is registered with respect to the orientation of the surface of the underlying substrate. The two-dimensional X-ray diffraction (2D-XRD) pattern of an epitaxial layer deposited on a substrate via electrochemical deposition aligns with the 2D-XRD patterns of the underlying substrate. At least some of the atomic planes of the epitaxial layer and the underlying substrate, which may be observed via transmission electron microscopy, are aligned.

Unless context dictates otherwise, "heteroepitaxy" and "heteroepitaxial" (as used herein) refer to the electrochemical deposition of a crystalline epitaxial layer on a substrate of a different kind of material.

Unless context dictates otherwise, "homoepitaxy" and "homoepitaxial" (as used herein) refer to the electrochemical deposition of a crystalline epitaxial layer on a substrate of the same kind of material.

Unless context dictates otherwise, "single-crystal" (as used herein) refers to a crystalline material in which the crystal lattice of the material is continuous and unbroken to the edges of the material, with no grain boundaries.

Unless context dictates otherwise, "crystalline" (as used herein) refers to a chemical material having a regular and periodic arrangement of atoms.

Unless context dictates otherwise, "polycrystalline" (as used herein) refers to an orientation of a layer of a material deposited on the surface of a substrate, wherein the layer comprises many crystallites of varying size and orientation with respect to the orientation of the surface of the underlying substrate. The two-dimensional X-ray diffraction (2D-XRD) pattern of a polycrystalline layer deposited on a substrate via electrochemical deposition does not align with the 2D-XRD patterns of the underlying substrate. The atomic planes of the polycrystalline layer and the underlying substrate, which may be observed via transmission electron microscopy, are not aligned.

Unless context dictates otherwise, "textured" (as used herein) refers to the distribution of crystallographic orientations between fully polycrystalline (e.g. powder) and single-crystal.

Unless context dictates otherwise, "amorphous" (as used herein) refers to a non-crystalline material that is not textured.

Unless context dictates otherwise, "X-ray diffraction pattern" (as used herein) refers to the angle(s) at which X-rays are scattered by the atoms of a crystal.

Unless context dictates otherwise, "crystal" (as used herein) refers to a material in which the atoms are arranged in a rigid geometrical structure marked by symmetry.

Unless context dictates otherwise, "electrochemical deposition" (as used herein) refers to electrodeposition, electroless deposition, and photoelectrochemical deposition.

Unless context dictates otherwise, "electrodeposition" (as used herein) refers to a process that uses an externally supplied electric potential or electric current to deposit a layer of a metallic material on a substrate. The cathode substrate, a metallic material precursor, and an anode are immersed in an electrochemical bath. In some embodiments, electric potential or electric current is supplied to an anode comprising a metallic material to oxidize the metallic material and thereby produce a dissolved metallic material precursor. In some embodiments, the electrochemical bath comprising an oxidized form of the metallic material precursor dissolved in a liquid is supplied independently (e.g. in the form of a dissolved metal salt). The oxidized metallic material precursor is then reduced at the interface between the electrochemical bath and the cathode substrate and the metallic material is thereby deposited onto the surface of the substrate.

Unless context dictates otherwise, "electroless deposition" (as used herein) refers to a non-galvanic plating method in which a metallic material precursor and a substrate are contained in an electrochemical bath and used to deposit a layer of a metallic material on a substrate without the use of external electric potential or electric current.

Unless context dictates otherwise, "photoelectrochemical deposition" (as used herein) refers to a process to deposit a layer of a metallic material on a substrate via electrodeposition or electroless deposition in the presence of electromagnetic radiation. In some embodiments, incident radiation induces redox reactions or produces chemical species that are capable of participating in redox reactions to thereby induce deposition.

Unless context dictates otherwise, "electrochemical bath" (as used herein) refers to a mixture comprising a reducing agent and metallic material in a liquid.

Unless context dictates otherwise, "reducing agent" (as used herein) refers to a chemical species that loses (i.e. donates) an electron to another chemical species in a redox reaction.

Unless context dictates otherwise, "chemical species" (as used herein) refers to an element, molecule, molecular fragment, or ion.

Unless context dictates otherwise, "redox reaction" (as used herein) refers to an oxidation-reduction reaction that involves a transfer of electrons in that the oxidation number of an atom, ion, or molecule changes by gaining or losing an electron.

Unless context dictates otherwise, "galvanic replacement" (as used herein) refers to an electrochemical process in which a surface layer of a metal ($M_1$) is replaced by another metal ($M_2$) according to the general replacement reaction: $nM_1+mM_2^{n+}\leftrightarrow nM_1^{m+}+mM_2$. The reaction is driven by the difference in the equilibrium potential of the two metal/metal ion redox couples.

Unless context dictates otherwise, "liquid" (as used herein) refers to water, deionized water, an alcohol, an aqueous electrolyte (e.g. an ionic aqueous solvent), a non-aqueous electrolyte (e.g. an ionic non-aqueous solvent), and mixtures thereof.

Unless context dictates otherwise, "alcohol" (as used herein) refers to an organic solvent with a hydroxyl functional group bound to a saturated carbon atom. Examples include, but are not limited to, methanol, ethanol, isopropyl alcohol, etc.

Unless context dictates otherwise, "nanocrystal" (as used herein) refers to a material particle having at least one dimension smaller than 1000 nanometers and comprising atoms in either a single-crystal or a polycrystalline arrangement. In some embodiments, where explicitly specified, a nanocrystal may refer to a material particle having at least one dimension smaller than 100 nanometers and comprising atoms in either a single-crystal or a polycrystalline arrangement (e.g, "a less than 100 nm nanocrystal").

Unless context dictates otherwise, "core-shell nanoparticle" (as used herein) refers to a nanocrystal (made in situ or otherwise formed) that is deposited with a textured layer of metallic material by electrochemical deposition.

Unless context dictates otherwise, "shape control agent" (as used herein) refers to a chemical species that is capable of interacting with one or more of a cathode substrate, a layer of a metallic material being deposited on the substrate via electrochemical deposition, a complex comprising an oxidized form of a metallic material precursor, and other chemical species present in an electrochemical bath to alter the geometry and/or morphology and/or crystalline composition of the deposited material and/or the rate of metallic material deposition. In some embodiments, a shape control agent interacts with the different facets of a substrate to impart differential growth kinetics during electrochemical deposition, resulting in crystalline deposits or nanocrystals with desired shapes and textures. Examples of shape control agents include, but are not limited to, malachite green chloride, polyvinylpyrrolidone (PVP), cetyltrimethylammonium bromide (CTAB), sodium chloride (NaCl), sodium sulphate ($Na_2SO_4$), sodium nitrate ($NaNO_3$), and other organic, polymeric, and ionic materials conventionally known. In some embodiments, a plurality of shape control agents may be used. Using a plurality of shape control agents, can allow the methods to produce new structures with shapes not always attainable using a single shape control agent.

Unless context dictates otherwise, "about" (as used herein) means near the stated value (i.e. within ±5% of the stated value, within ±1 pH unit of the stated pH value, within ±5° of the stated X-ray diffraction angle as context dictates, or within 30 minutes of the stated time value).

Some embodiments of the present invention provide methods of electrochemical deposition of a textured layer of a metallic material on the surface of a substrate. The methods include providing an alkaline solution of hydroxide, immersing a metallic material precursor and a substrate in the solution, and depositing a textured layer of the metallic material onto the surface of the substrate. The textured layer of the metallic material may be deposited via electrodeposition, electroless deposition, or photoelectrochemical deposition.

Some embodiments of the present invention provide single-crystal nanocrystals, core-shell nanoparticles, and substrate surfaces coated with a textured layer of a metallic material, all formed via electrochemical deposition in an alkaline electrochemical bath comprising hydroxide.

FIG. 1 shows a method 10 of electrochemical deposition of a textured layer of a metallic material on the surface of a substrate. The method involves immersing a metallic material precursor and the substrate in an alkaline solution of hydroxide and depositing a textured layer of the metallic material on the surface of the substrate. In block 20 an alkaline solution of hydroxide is provided. The solution may be prepared by dissolving a hydroxide salt (e.g. sodium hydroxide (NaOH), potassium hydroxide (KOH), ammonium hydroxide ($NH_4OH$), etc.) in a liquid. In some embodiments, one or more other chemical species may also be dissolved in the liquid. For example, a shape control agent could be added to the alkaline solution in optional block 70. To alter the electrochemical deposition reaction mechanism and/or the rate of metallic material deposition, one or more additives may also be added to the liquid. The additives may interact with one or more of a cathode substrate, a layer of a metallic material being deposited on the substrate, and a complex comprising an oxidized form of the metallic material precursor. In some embodiments, the morphology of the deposited material is influenced by the additive(s). Examples of additives include, without limitation, smoothing agents, polishing agents, etc.

In some embodiments, the alkaline solution comprises hydroxide and one or more other reducing agents. In some embodiments, the concentration of hydroxide ions in the alkaline solution is greater than about 0.0001 M. In some embodiments, the concentration of hydroxide ions in the alkaline solution is between about 0.0001 M and about 10 M. In some embodiments, the pH of the alkaline solution is greater than about 10. In some embodiments, the pH of the alkaline solution is in the range of about 10 to about 15.

In block 30 a metallic material precursor and a substrate are immersed in the alkaline solution. In some embodiments, the substrate is immersed with the metallic material precursor in the alkaline solution. In some embodiments, the substrate is immersed before the metallic material precursor is immersed in the alkaline solution. In some embodiments, the metallic material precursor is added to the alkaline solution continually and/or periodically to maintain the concentration of the metallic material precursor within a desired range. In some embodiments, immersing the metallic material precursor in the alkaline solution before the substrate is immersed may cause the metallic material to nucleate, aggregate, agglomerate, precipitate, or otherwise combine with the hydroxide and/or the reducing agent to form nanoparticles in the alkaline solution. Such nanoparticles can become incorporated into the layer during deposition of the metallic material onto the substrate, thereby altering the resulting quality and/or texture of the layer. However, where the textured layer of the metallic material is deposited on the surface of the substrate using electric potential or electric current and the metallic material precursor is provided as a solid anode, the metallic material precursor may be immersed in the alkaline solution before, at the same time as, or after the substrate is immersed in the solution provided the electrical current is not supplied to the metallic material precursor until both the metallic material precursor and the substrate are immersed in the solution. In some embodiments, immersing the metallic material and the substrate in the alkaline solution comprises mixing, agitating, or otherwise stirring the mixture.

In some embodiments, the substrate comprises a material that is susceptible to galvanic replacement in the presence of a metal salt. In some embodiments, the substrate need not necessarily be considered to be catalytic for electroless deposition and may still have a textured layer of the metallic material deposited thereon. In some embodiments, this is achieved by rendering the substrate catalytic according to conventional methods, or by electroless reduction under conditions that permit galvanic replacement of substrate surface atoms, or by other methods that render the substrate suitable for subsequent electrochemical reduction. Methods of making substrates catalytic are described in U.S. Pat. No. 4,904,506 entitled "Copper Deposition from Electroless Plating Bath". By using such methods, electroless deposition onto a range of non-catalytic substrates may be accomplished. For example, in some embodiments, the substrate may comprise a semiconductor (e.g. silicon), an insulator, a polymeric material, etc. Electrochemical deposition according to embodiments of the present invention has been observed using the following substrates: silicon (Si), silver (Ag), gold (Au), platinum (Pt), palladium (Pd), iridium (Ir), ruthenium (Ru), copper (Cu), cobalt (Co), steel:copper: nickel alloys, tin-doped indium oxide (ITO), glass, polyethylene terephthalate (PET), polyimide (Kapton), poly(methyl methacrylate) (PMMA), silicon nitride ($Si_3N_4$), silicon oxide ($SiO_2$), stannous chloride ($SnCl_2$), and palladium chloride ($PdCl_2$). Other examples of suitable substrates include, but are not limited to, nanoparticles, a suspension of seed nanocrystals, a single-crystal substrate, a substantially crystalline substrate, sub-micron apertures formed on a substantially crystalline substrate, crystallites formed on a substrate, a crystalline noble metal, a crystalline semi-noble metal, etc.

In some embodiments, the substrate is patterned using a lithographic process and/or one or more other patterning methods conventionally known (e.g. wet etching, dry etching, etc.). In some embodiments, one or more of subtractive and additive methods conventionally known are employed to pattern the substrate. Examples of additive methods include, without limitation, electroless deposition, electrodeposition, physical vapor deposition, chemical deposition, and atomic layer deposition. Persons skilled in the art will recognize that different permutations of the different patterning methods may be employed to achieve a desired effect.

In some embodiments, the metallic material precursor is immersed as a salt of the metallic material in block 30. In optional block 40 a solution of the metallic material precursor is provided. The solution is prepared by dissolving the metallic material precursor (e.g. a metallic material salt) in a liquid. In some embodiments, one or more other chemical species may be dissolved in the liquid of the block 40 metallic material precursor solution. For example, a shape control agent could be added to the metallic material solution in optional block 70. Electrochemical deposition according to embodiments of the present invention has been observed using the following metals: gold (Au), silver (Ag), platinum (Pt), palladium (Pd), iridium (Ir), rhodium (Rh), copper (Cu), and cobalt (Co). Other examples of suitable metals include metals that may have similar chemical properties, but this is not necessary.

The mixture of the alkaline solution and the metallic material precursor forms an electrochemical bath. In some embodiments, the concentration of metal ions dissolved in the electrochemical bath may be between about $1\times10^{-7}$ M and about 1 M, or the maximum allowable concentration dictated by metallic material precursor solubility. A person skilled in the art would understand that the concentration of the metallic material precursor and the reducing agent (i.e. hydroxide with or without other reducing agents) in the electrochemical bath depends on: (i) the concentration of the reducing agent in the alkaline solution; (ii) the concentration of the metallic material precursor in the metallic material solution; (iii) the volume of the alkaline solution; and (iv) the volume of the metallic material solution added to the alkaline solution. In some embodiments, the concentration of hydroxide ions in the electrochemical bath is between about 0.0001 M and about 15 M. In some embodiments, the pH of the electrochemical bath is greater than about 10. In some embodiments, the pH of the electrochemical bath in the range of about 10 to about 15. In some embodiments, the pH of the electrochemical bath is about 10. In some embodiments, the pH of the electrochemical bath is about 11. In some embodiments, the pH of the electrochemical bath is about 12. In some embodiments, the pH of the electrochemical bath is about 13. In some embodiments, the pH of the electrochemical bath is about 14. In some embodiments, the pH of the electrochemical bath is about 15.

For example, to deposit a textured layer of the metallic material on a single-crystal silver substrate (e.g. Ag (100)) having a surface area of about 1 $cm^2$ (i.e. about 1 cm by about 1 cm), the electrochemical bath may comprise the following concentrations of metal ions and hydroxide ions:

| Metal ion concentration (M) | Hydroxide ion concentration (M) |
|---|---|
| about $10^{-5}$M-about $10^{-1}$M | about 0.1M-about 10M |
| about $10^{-4}$M-about $7.5\times10^{-2}$M | about 0.5M-about 8.0M |
| about $10^{-3}$M-about $5\times10^{-2}$M | about 0.5M-about 4.0M |

In some embodiments, the ratio of hydroxide ion concentration:metal ion concentration in the electrochemical bath is greater than about 400:1 when the substrate is susceptible to galvanic replacement in the presence of the metallic material precursor. In some embodiments, the ratio of the concentration of the hydroxide ions to the concentration of the metallic material precursor in the electrochemical bath is in the range of about 50:1 to about 400:1 when the substrate is not susceptible to galvanic replacement in the presence of the metallic material precursor. In some embodiments, the ratio of the concentration of the hydroxide ions to the concentration of the metallic material precursor in the electrochemical bath is greater than about 50:1 when the substrate is not susceptible to oxidation in the presence of the metallic material precursor.

In block 50 a textured layer of the metallic material is deposited on the surface of the substrate via electrochemical deposition. In some embodiments, it is desirable to maintain uniform kinetics of deposition. To do so, the concentration of one or more of the metal ion and the hydroxide ion may be monitored during the deposition period, or a portion thereof. Information regarding the rate of deposition may be monitored through optical absorption properties of the electrochemical bath when the metal ions in the bath have spectral characteristics that allow them to be detected using conventional methods (e.g. optical absorbance at characteristic wavelengths). The kinetics of deposition may be estimated based on the rate at which the metal ions leave the electrochemical bath (i.e. are deposited on the substrate). In some embodiments, a syringe pump may be used to add one or more of the metal ion and the hydroxide ion at a continual rate or periodically to maintain uniform kinetics of deposition.

Figure 2A:
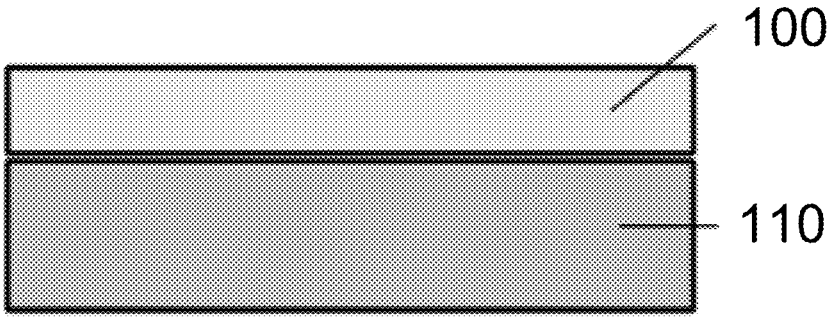
FIG. 2A is a schematic illustration of an epitaxial layer of a metallic material deposited on a single-crystal substrate according to an example embodiment of the present invention.
Figure 2B:
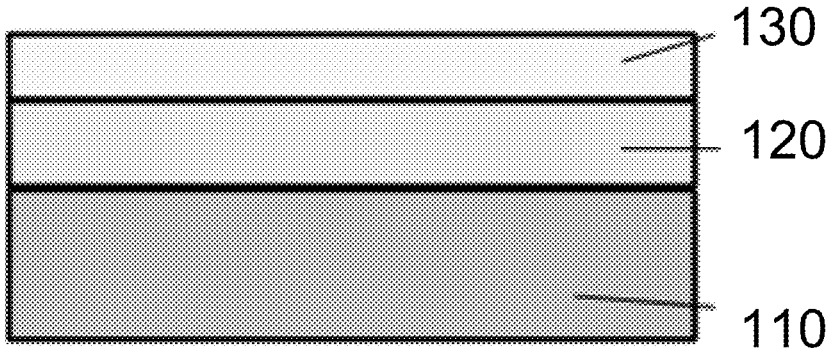
FIG. 2B is a schematic illustration of a single-crystal substrate coated with two epitaxial layers of metallic materials according to an example embodiment of the present invention.
Figure 2C:
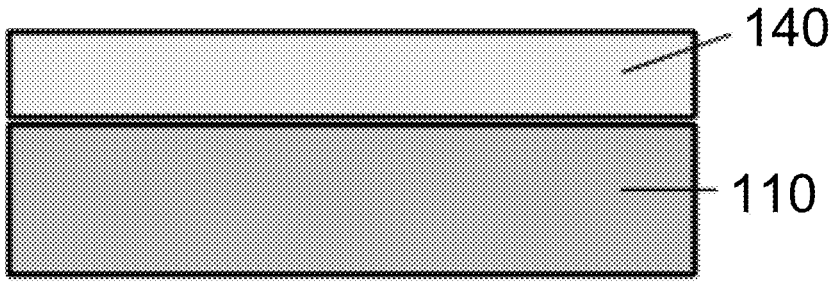
FIG. 2C is a schematic illustration of a single-crystal substrate upon which is deposited a metal alloy according to an example embodiment of the present invention.

In some embodiments, the textured layer is a metal alloy. Electrochemical deposition according to some embodiments of the present invention has been observed using the following metal alloys: gold (Au) and silver (Ag), platinum (Pt) and silver (Ag), platinum (Pt) and gold (Au), palladium (Pd) and silver (Ag), palladium (Pd) and gold (Au), cobalt (Co) and gold (Au), cobalt (Co) and copper (Cu), copper (Cu) and gold (Au), copper (Cu) and platinum (Pt), and a four member alloy consisting of copper (Cu), gold (Au), silver (Ag), and cobalt (Co). Other examples of suitable metal alloys may have similar chemical properties, but this is not necessary. FIG. 2C is a schematic illustration of a single-crystal substrate 110 upon which a metal alloy 140 has been deposited. Film colour was considered evidence of alloying. Also, scanning electron microscopy (SEM) was used to show surface morphology of the deposited layers and to distinguish between uniform deposition from electrochemical baths containing mixtures of metallic material precursors and metallic phase separation. X-ray diffraction (XRD) and X-ray photoelectron spectroscopy (XPS) were used to confirm the electrochemical deposition of the following alloys: Au:Ag, Pt:Ag, and Pt:Au.

In block 40 two or more metallic material precursors may be dissolved in the liquid. For example, to deposit a platinum-silver alloy layer, a platinum salt and a silver salt are dissolved in the liquid. To deposit a platinum-gold alloy, a platinum salt and a gold salt (e.g. $HAuCl_4$) are dissolved in the liquid. To deposit a platinum-palladium alloy, a platinum salt and a palladium salt are dissolved in the liquid. Due to such factors as different reduction potentials, the number of electrons required for reduction, different concentrations, etc., the concentrations of the different metal salts in the metallic material solution (and in the electrochemical bath) may not accurately reflect the alloy composition of the layer that is eventually deposited. The composition of the deposited layer may be analyzed using conventional analytical methods. Information regarding the relative rates of deposition of the different metal ions may also be monitored through optical absorption properties of the electrochemical bath when the metal ions in the bath have spectral characteristics that allow them to be detected using conventional methods (e.g. optical absorbance at characteristic wavelengths). The kinetics of deposition and alloy composition may be estimated based on the rate at which the metal ions leave the electrochemical bath (i.e. are deposited on the substrate). Where the kinetics of deposition of the different metal ions differ significantly, to maintain uniform alloy composition throughout the deposited layer, the concentration of each metal ion may be maintained within the ranges outlined elsewhere herein during the deposition period.

In some embodiments, the textured layer deposited in block 50 is a metal-containing compound. Electrochemical deposition according to embodiments of the present invention has been observed to deposit copper oxide ($Cu_2O$) and cobalt monoxide (CoO). Other examples of suitable metal-containing compounds may have similar chemical properties, but this is not necessary. For example, the textured layer may comprise aluminum oxide ($Al_2O_3$), zinc oxide (ZnO), etc.

Figure 3A:
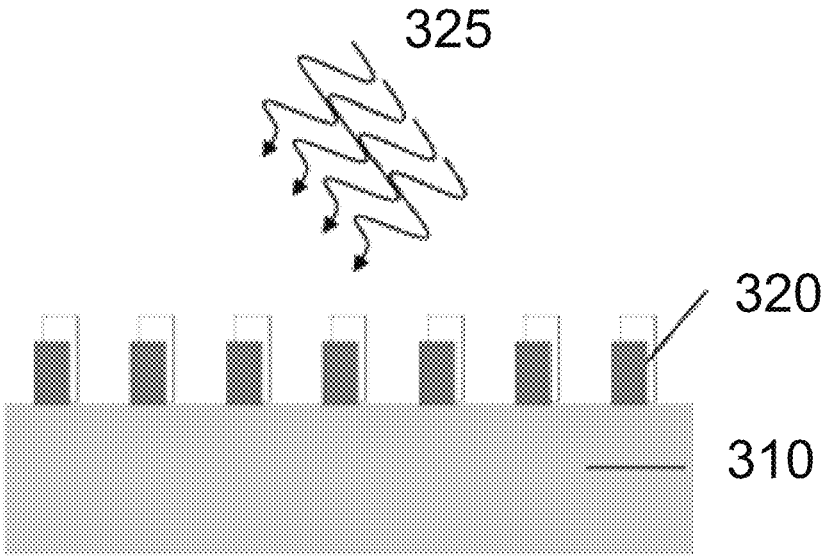
FIG. 3A is a schematic illustration of a substantially crystalline substrate upon which is deposited a locally resonant surface plasmons (LRSP) active element according to an example embodiment of the present invention.
Figure 3B:
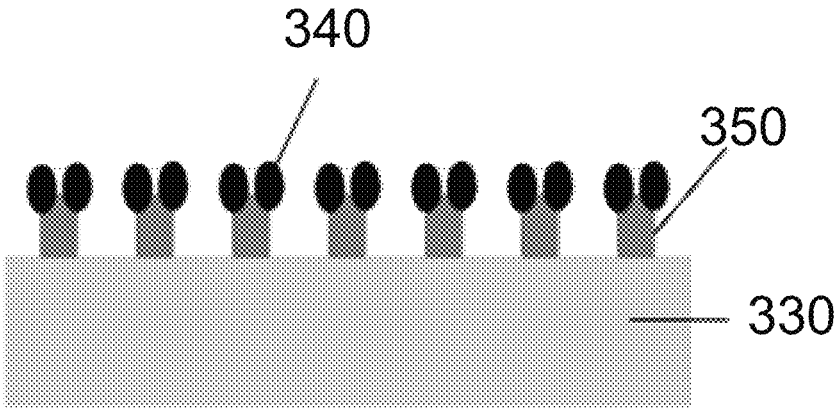
FIG. 3B is a schematic illustration of a substantially crystalline substrate upon which is deposited LRSP-mediated reduction on LRSP active elements according to an example embodiment of the present invention.

In some embodiments, to deposit the metallic material on the substrate via electrodeposition, an external electric potential or electric current is supplied to the electrochemical bath in block 50. In some embodiments, the metallic material is deposited on the surface of the substrate in a non-galvanic process, without the use of external electric potential or electric current (i.e. via electroless deposition). In some embodiments, electromagnetic radiation is used in block 50 to deposit the metallic material on the substrate via photoelectrochemical deposition. In some embodiments, the wavelengths of the electromagnetic radiation correspond with those capable of forming an excitation. Such excitation may include, but are not limited to, one or more of excitons, polarons, bipolarons, polaritons, plasmons, surface plasmon polaritons (SPPs), locally resonant surface plasmons (LRSPs), photothermal excitations, and/or other excitations, including those that lead to electron generation directly, or that can lead to direct or indirect reduction of ionic species. By way of non-limiting example, FIG. 3A shows a schematic illustration of a substantially crystalline substrate 310 upon which a LRSP active element 320 is deposited. Electromagnetic radiation 325 is radiated onto the surface of substrate 310. By way of non-limiting example, FIG. 3B shows a schematic illustration of a substantially crystalline substrate 330 upon which LRSP-mediated reduction on LRSP active elements 340 and LRSP active elements 350 are deposited.

In some embodiments, the wavelengths of the electromagnetic radiation are between Angstroms and meters. The electromagnetic radiation may induce excitations and ultimately result in reduction through interaction of the electromagnetic radiation with one or more of the substrate, chemical species supported on the substrate (e.g. shape control agent(s), etc.), and components of the electrochemical bath.

Without being bound by theory, the inventors consider that the concentration of hydroxide and/or the alkaline pH of the reducing agent solution facilitates electrochemical reduction of the metallic material precursor while preventing galvanic replacement or other deleterious oxidation processes that can occur to the substrate in less alkaline environments and/or environments with lower concentrations of hydroxide. In some embodiments, the concentration of hydroxide in the electrochemical bath is sufficient so that hydroxide acts as the reducing agent. In some embodiments, the electrochemical bath comprises one or more other reducing agents in addition to hydroxide.

Electrochemical deposition may be achieved at room temperature. In some embodiments, the temperature of the electrochemical bath is controlled in block 50. For example, temperature may be maintained in the range of about 5° C. to about 90° C. In some embodiments, the temperature is maintained in the range of about 50° C. to about 80° C. In some embodiments, the temperature is maintained at about 70° C. In some embodiments, the temperature is varied in block 50. In some embodiments, the temperature of the alkaline solution and/or the metallic metal solution is controlled. In some embodiments, the electrochemical bath is formed at room temperature and then heated to achieve a desired temperature. In some embodiments, the electrochemical bath is formed at the desired temperature. The temperature may be controlled using any means conventionally known.

After a time sufficient to achieve the desired thickness of metallic material deposited on the surface of the substrate, the substrate is removed from the electrochemical bath in block 60. Depending on the desired thickness, the deposition is carried out for a period of time between minutes to hours. By way of non-limiting example, in some embodiments, to achieve a deposited textured layer thickness of about 70 to about 100 nm, about 0.5 hours to about 5 hours of deposition may be desired. In some embodiments, a similar thickness may be achieved in about 1 hour or less. It will be appreciated that the thickness of the textured layer is correlated with the time of deposition. The inventors have experimented with shorter deposition times to achieve relatively low thickness and with longer deposition times to achieve relatively large thicknesses. In some embodiments, deposited textured layers may have thicknesses as low as 15 nm—by way of non-limiting example, in a range of 15 nm-50 nm, a range of 15 nm-100 nm or a range of 15 nm-500 nm. In some embodiments, deposited textured layers may have thicknesses as great as or greater than 10 μm—by way of non-limiting example, in a range of 100 nm-500 nm, a range of 100 nm-1 μm or a range of 100 nm-15 μm. In some embodiments, deposition times can be relatively low—e.g. in a range of 1-5 minutes, 1-10 minutes or 1-20 minutes. In some embodiments, deposition times can be relatively high—e.g. in a range of 1-5 hours. The inventors have also determined that temperature and concentration of metallic material precursor can impact these deposition times and thicknesses. Specifically, increasing temperature and/or concentration of metallic material precursor causes an increase in the deposition rate. Once removed, the substrate may be rinsed with a liquid to cease electrochemical deposition. In some embodiments, deposition may be reduced or terminated in block 60 by removing the current and/or electromagnetic radiation supplied to the metallic material precursor. Layer thickness and/or quality may be optimized by varying one or more of the following: (i) deposition time; (ii) temperature; (iii) concentration of the metallic material precursor in the electrochemical bath; (iv) concentration of the hydroxide ions in the electrochemical bath; (v) surface area of the substrate; (vi) type of substrate (for example, without limitation, the relative reduction potential of the substrate); (vii) type of metallic material (for example, without limitation, the required number of electrons for reduction of a particular ionic species, the relative reduction potential, etc.); and (viii) concentration of reducing agent(s) other than hydroxide in the electrochemical bath.

In some embodiments, to achieve the deposit of a textured layer of metallic material on the substrate, the concentration of the metallic material precursor in the electrochemical bath must be maintained at desired levels, wherein these concentration levels typically depend on the specific application. For example, to form a textured layer of a metallic material on a substantially crystalline substrate (e.g. a Ag(100) single-crystal surface), the concentration of metal ions in the electrochemical bath may be maintained at a sufficiently low concentration to avoid substrate oxidation (if the substrate is capable of oxidizing) and/or to avoid excessive formation of nanocrystals. Such nanocrystals can aggregate, agglomerate, precipitate, or otherwise become incorporated into the layer during deposition and alter the quality of the layer. If the concentration of the metallic material precursor is too high and excessive formation of nanocrystals results, the deposited layer may become polycrystalline and/or porous. However, in some applications, a polycrystalline and/or porous deposited layer is desirable. Accordingly, method 10 may be optimized to yield a desired morphology of the deposited layer of a metallic material. In some embodiments, it is desirable to form nanocrystals. To do so, the concentration of the metal ions in the electrochemical bath may be maintained at a sufficiently high concentration to induce formation of nanocrystals.

In some embodiments, to achieve the deposit of a textured layer of metallic material on the substrate, the concentration of the hydroxide ions in the electrochemical bath is maintained at desired levels, wherein these concentration levels depend on the specific application. Other conventional electroless deposition processes employ specific reducing agents in less alkaline environments. However, many of these methods are unable to prevent unwanted oxidative processes from compromising the integrity of the substrate and/or are unable to achieve the deposit of an epitaxial layer of a metallic material on a substrate. For example, the electroless deposition of gold (Au) onto silver (Ag) is well known. Due to the higher reduction potential of $Au^{3+}$ ions compared to $Ag^{+}$ ions, gold is reduced at the expense of silver oxidation. This results in a highly porous Au or Au/Ag composite deposition layer. As a result, many commercially significant gold plating applications are carried out using electrodeposition processes.

The inventors have found that depositing gold onto silver according to some embodiments of the present invention avoids deleterious silver oxidation. Without being bound by theory, the inventors consider that at appropriately high hydroxide ion concentrations and/or alkaline pH, gold ions form complexes with hydroxide ions and that the kinetic rate of gold ion reduction by the hydroxide ions is greater than the kinetic rate of gold ion reduction by silver oxidation. The concentration of hydroxide and/or the alkaline pH of the electrochemical bath may facilitate electrochemical reduction of the metallic material precursor while preventing galvanic replacement or other deleterious oxidation processes that can occur to the substrate in less alkaline environments and/or environments with lower concentrations of hydroxide. The inventors have found that depositing gold onto silver according to some embodiments of the present invention avoids deleterious silver oxidation and produces a textured layer of gold deposited onto the silver. Sufficiently high concentrations of hydroxide (as described elsewhere herein) and/or alkaline pH may also be beneficial for the deposition of other metallic materials that are not capable of undergoing galvanic replacement and/or for the deposition of metallic materials on substrates that are not capable of undergoing galvanic replacement.

In some embodiments, the rate of electrochemical deposition is controlled. For example, in optional block 80 the rate may be enhanced by rinsing the substrate with a liquid before immersing the substrate in the alkaline solution. In some embodiments, the substrate is rinsed with an alcohol. In some embodiments, the substrate is rinsed with isopropyl alcohol. In some embodiments, the substrate is rinsed with a solution of water and an alcohol. To deposit a layer of metallic material having a desired thickness, a deposition period of about 5 minutes to about 10 minutes was observed when the substrate was rinsed with isopropyl alcohol before immersing the substrate in the alkaline solution. To deposit a layer of metallic material having the same thickness on a substrate that was not rinsed prior to being immersed in the alkaline solution, a deposition period of about 1 hour was required.

The layer of metallic material deposited according to method 10 may be textured. In some embodiments, the textured layer is epitaxial. For example, the electroless deposition of a metallic material on a single-crystal silver (Ag(100)) substrate according to method 10 was observed to yield an epitaxial layer of the metallic material deposited on the surface of the substrate. FIG. 2A is a schematic illustration of a crystalline epitaxial layer 100 of metallic material deposited on a single-crystal Ag substrate 110. The distribution of crystallographic orientations of the deposited textured layer of metallic material may depend on the geometry and/or texture of the substrate to be plated. In some embodiments, the distribution of crystallographic orientations of the deposited textured layer of metallic material reflects the geometry and/or texture of the substrate to be plated. For example, the electroless deposition of a metallic material on an amorphous substrate according to method 10 was observed to yield an amorphous layer of the metallic material deposited on the surface of the substrate. The electroless deposition of a metallic material on a polycrystalline substrate according to method 10 was observed to yield a polycrystalline layer of the metallic material deposited on the surface of the substrate (see also FIGS. 28A and 28B). In some embodiments, deposition of a metallic material according to method 10 on a polycrystalline substrate containing voids leads to deposition of a layer with fewer voids and a more continuous character, thereby demonstrating film healing properties.

Figure 4A:
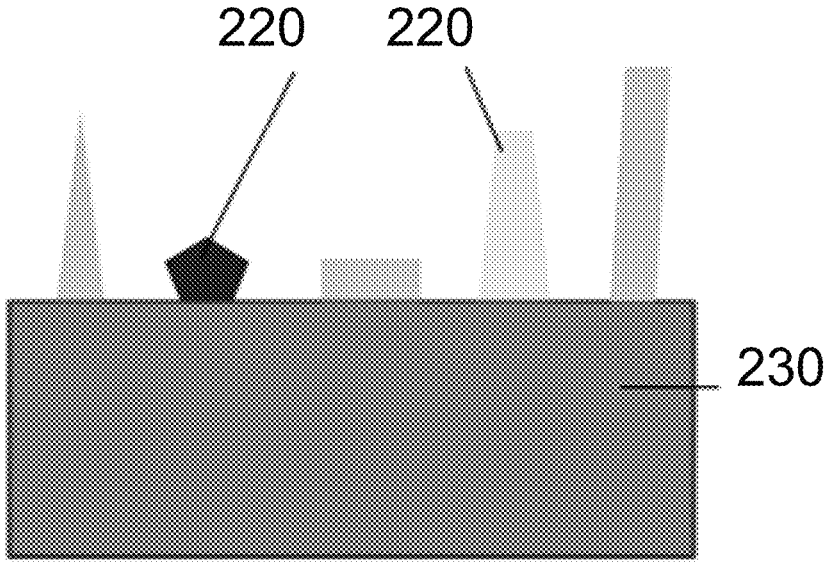
FIG. 4A is a schematic illustration of a variety of shaped crystallites supported by a substantially crystalline substrate according to an example embodiment of the present invention.
Figure 4B:
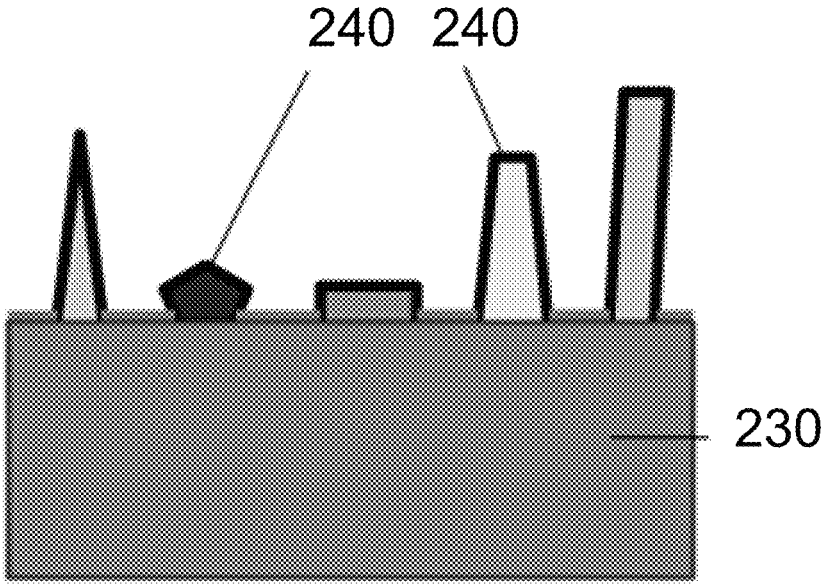
FIG. 4B is a schematic illustration of an epitaxial layer of a metallic material deposited on the variety of shaped crystallites and substrate of FIG. 4A substrate according to an example embodiment of the present invention.
Figure 5A:
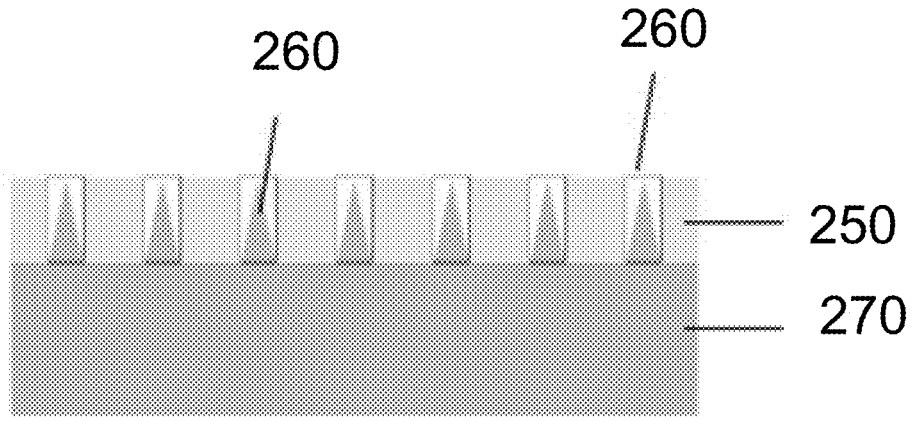
FIG. 5A is a schematic illustration of a epitaxial deposition of metallic material in the presence of one or more shape-control agents (i.e. shape-controlled epitaxy) demonstrating homoepitaxial deposition of square pyramidal crystallites onto a patterned substrate (i.e. additive deposition) according to an example embodiment of the present invention.
Figure 5B:
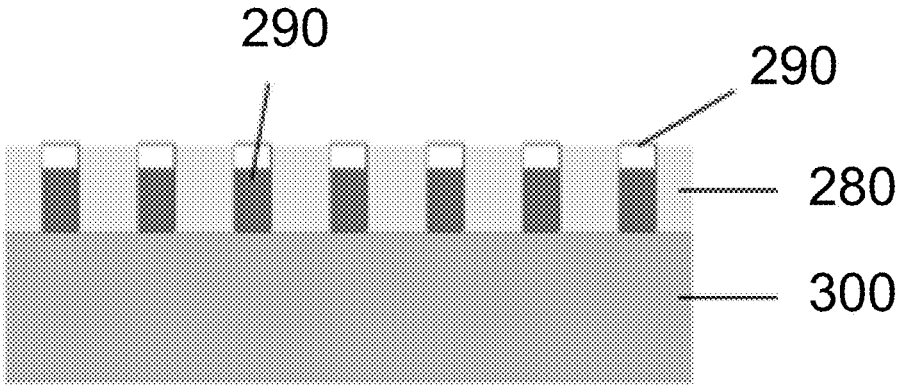
FIG. 5B is a schematic illustration of a shape-controlled epitaxy demonstrating heteroepitaxial deposition of cuboid crystallites onto a patterned substrate according to an example embodiment of the present invention.

To deposit a textured layer of metallic material having a preferred geometry and/or morphology and/or crystalline composition, one or more shape control agents may be used. In optional block 70 one or more shape control agents are provided. The shape control agent(s) may impart differential growth kinetics and, in some embodiments, result in crystalline deposits with crystallographic texture and/or well-defined shape preferences. Such crystalline qualities cannot typically be achieved using conventional electroless deposition without such shape control agents. One or more shape control agents may be added to one or more of the alkaline solution (in block 20), the metallic material solution (in block 40), and the electrochemical bath (in block 30). By way of non-limiting example, FIG. 4A shows a schematic illustration of a variety of shaped crystallites 220 supported by a substantially crystalline substrate 230. By way of non-limiting example, FIG. 4B shows a schematic illustration of an epitaxial layer 240 of a metallic material deposited on the FIG. 4A shaped crystallites 220 and substrate 230. By way of non-limiting example, FIG. 5A shows a schematic illustration of a shape-controlled epitaxy 250 demonstrating homoepitaxial deposition of square pyramidal crystallites 260 onto a patterned substrate 270 (i.e. additive deposition). By way of non-limiting example, FIG. 5B shows a schematic illustration of a shape-controlled epitaxy 280 demonstrating heteroepitaxial deposition of cubic crystallites 290 onto a patterned substrate 300.

In some embodiments, the plated substrate may be further processed by one or more of: electrodeposition, chemical vapor deposition, physical vapor deposition, and atomic layer deposition. In some embodiments, the plated substrate may be patterned using a lithographic process and/or one or more other patterning methods conventionally known (e.g. wet etching, dry etching, etc.). In some embodiments, one or more of subtractive and additive methods conventionally known are employed to pattern the plated substrate. In some embodiments, one or more layers of a metallic material may be deposited on a substrate. For example, FIG. 2B is a schematic illustration of a single-crystal substrate 110 coated with two crystalline epitaxial layers 120, 130 of metallic materials. Persons skilled in the art will recognize that many different permutations of the different deposition and/or patterning methods may be employed to achieve a desired effect.

Figure 6A:
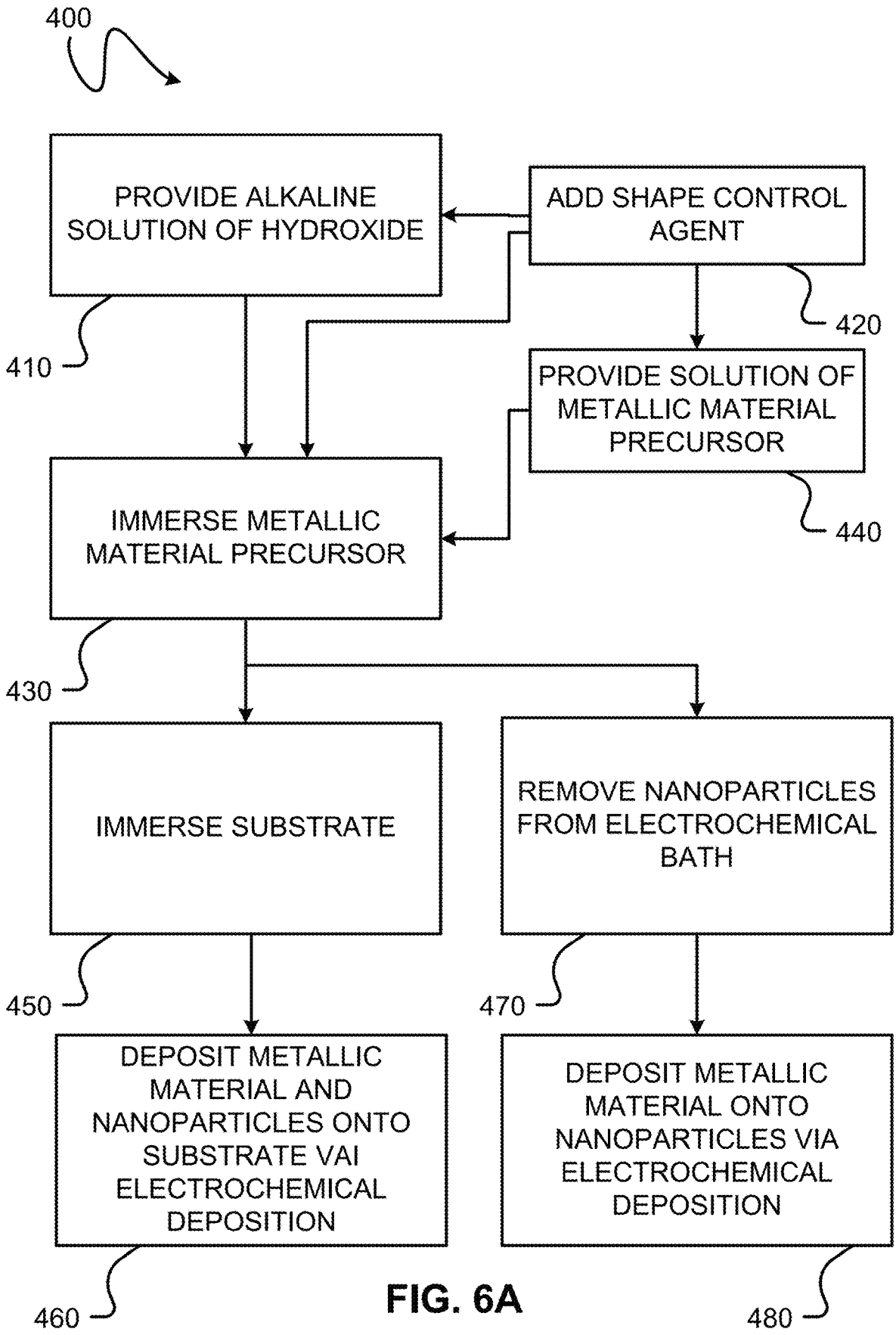
FIG. 6A is a flow chart which illustrates methods for forming textured nanoparticles and core-shell nanoparticles having a textured shell according to example embodiments of the present invention.

FIG. 6A shows a method 400 of making textured nanoparticles via electrochemical deposition. Unlike method 10, method 400 involves forming nanoparticles by electrochemical deposition and then either depositing the nanoparticles onto a substrate or removing the nanoparticles from the solution and optionally depositing a metallic material onto the nanoparticles. Method 400 comprises immersing a metallic material precursor in an alkaline solution of hydroxide. In block 410 an alkaline solution of hydroxide is provided. The block 410 solution may be prepared by using techniques described for block 20. A shape control agent may be added to the block 410 alkaline solution in optional block 420 as described for block 70.

In some embodiments, the alkaline solution comprises hydroxide and one or more other reducing agents. In some embodiments, the concentration of hydroxide ions in the alkaline solution is greater than about 0.0001 M. In some embodiments, the concentration of hydroxide ions in the alkaline solution is between about 0.0001 M and about 15 M. In some embodiments, the pH of the alkaline solution is greater than about 10. In some embodiments, the pH of the alkaline solution is in the range of about 10 to about 15.

In block 430 a metallic material precursor is immersed in the alkaline solution. In some embodiments, the metallic material precursor may be added to the alkaline solution continually and/or periodically to maintain the concentration of the metallic material precursor within a desired range. In some embodiments, the metallic material precursor is immersed as a salt of the metallic material in block 430. In optional block 440 a solution of a salt of the metallic material is provided as described for block 40. A shape control agent could be added to the metallic material solution in optional block 420.

The mixture of the alkaline solution and the metallic material precursor forms an electrochemical bath. In some embodiments, the concentration of metal ions dissolved in the electrochemical bath may be between about $1\times10^{-7}$ M and about 1 M, or the maximum allowable concentration dictated by metallic material precursor solubility. In some embodiments, the concentration of hydroxide ions in the electrochemical bath is between about 0.0001 M and about 15 M. In some embodiments, the pH of the electrochemical bath is greater than about 10. In some embodiments, the pH of the electrochemical bath in the range of about 10 to about 15. In some embodiments, the pH of the electrochemical bath is about 10. In some embodiments, the pH of the electrochemical bath is about 11. In some embodiments, the pH of the electrochemical bath is about 12. In some embodiments, the pH of the electrochemical bath is about 13. In some embodiments, the pH of the electrochemical bath is about 14. In some embodiments, the pH of the electrochemical bath is about 15.

In some embodiments, the ratio of hydroxide ion concentration:metal ion concentration in the electrochemical bath is greater than about 400:1 when the substrate is susceptible to galvanic replacement in the presence of the metallic material precursor. In some embodiments, the ratio of the concentration of the hydroxide ions to the concentration of the metallic material precursor in the electrochemical bath is in the range of about 50:1 to about 400:1 when the substrate is not susceptible to galvanic replacement in the presence of the metallic material precursor. In some embodiments, the ratio of the concentration of the hydroxide ions to the concentration of the metallic material precursor in the electrochemical bath is greater than about 50:1 when the substrate is not susceptible to oxidation in the presence of the metallic material precursor.

Immersing the metallic material precursor in the alkaline solution in block 430 may cause the metallic material to nucleate, aggregate, agglomerate, or otherwise combine with the hydroxide and/or the reducing agent to form crystalline nanoparticles in the alkaline solution in block 435. The formed nanoparticles may be deposited onto a substrate by following path 445, 455. To deposit the nanoparticles onto a substrate, the substrate is immersed in the electrochemical bath in optional block 450. In block 460, the nanoparticles are incorporated into a layer of metallic material deposited on a substrate via electrochemical deposition to alter the quality and/or texture of the deposited layer.

Alternatively, the formed nanoparticles may be removed from solution and optionally plated with a metallic material by following path 475. In optional block 470, the nanoparticles may be removed from the electrochemical bath. A metallic material may be deposited on the nanoparticles via electrochemical deposition in optional block 480 10 to produce core-shell nanoparticles having a textured shell. In some embodiments, the metallic material is deposited according to method 10 to produce core-shell nanoparticles having a textured shell.

Figure 6B:
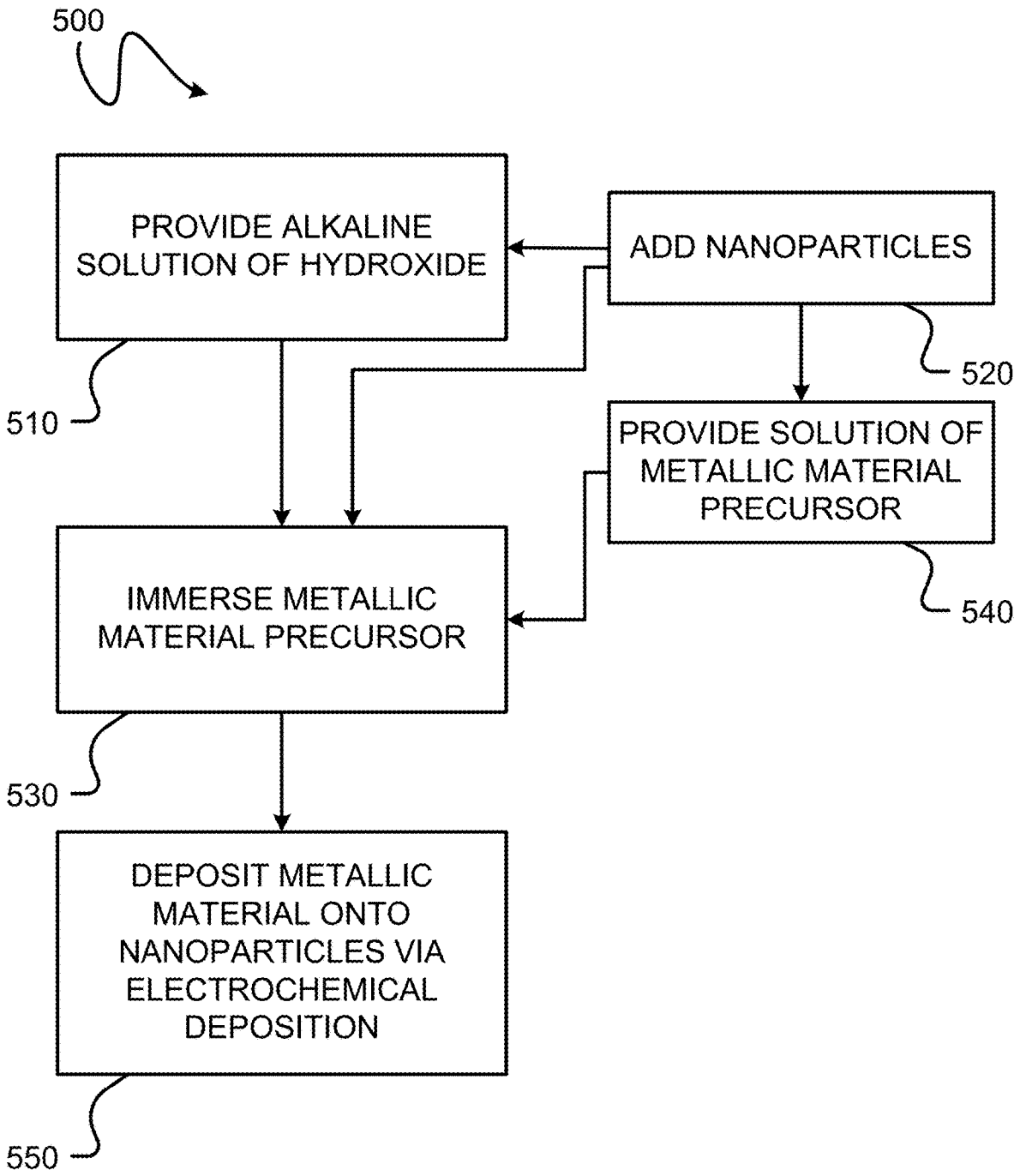
FIG. 6B is a flow chart which illustrates methods for forming core-shell nanoparticles having a textured shell according to an example embodiment of the present invention.

In some embodiments, a layer of a metallic material is deposited on nanoparticles formed independently of method 400 to produce core-shell nanoparticles comprising a textured shell. For example, FIG. 6B shows a method 500 of making core-shell nanoparticles having a textured shell via electrochemical deposition. The method involves immersing a metallic material precursor in an alkaline solution of hydroxide. In block 510 an alkaline solution of hydroxide is provided. The solution is prepared by as described for block 20.

In some embodiments, the alkaline solution comprises hydroxide and one or more other reducing agents. In some embodiments, the concentration of hydroxide ions in the alkaline solution is greater than about 0.0001 M. In some embodiments, the concentration of hydroxide ions in the alkaline solution is between about 0.0001 M and about 15 M. In some embodiments, the pH of the alkaline solution is greater than about 10. In some embodiments, the pH of the alkaline solution is in the range of about 10 to about 15.

In block 530 a metallic material is immersed in the alkaline solution. In some embodiments, the metallic material precursor is added to the alkaline solution continually and/or periodically to maintain the concentration of the metallic material precursor within a desired range. In some embodiments, the metallic material precursor is immersed as a salt of the metallic material in block 530. In optional block 540 a solution of a salt of the metallic material is provided as described for block 40.

The mixture of the alkaline solution and the metallic material precursor forms an electrochemical bath. In some embodiments, the concentration of metal ions dissolved in the electrochemical bath may be between about $1\times10^{-7}$ M and about 1 M, or the maximum allowable concentration dictated by metallic material precursor solubility. In some embodiments, the concentration of hydroxide ions in the electrochemical bath is between about 0.0001 M and about 15 M. In some embodiments, the pH of the electrochemical bath is greater than about 10. In some embodiments, the pH of the electrochemical bath in the range of about 10 to about 15. In some embodiments, the pH of the electrochemical bath is about 10. In some embodiments, the pH of the electrochemical bath is about 11. In some embodiments, the pH of the electrochemical bath is about 12. In some embodiments, the pH of the electrochemical bath is about 13. In some embodiments, the pH of the electrochemical bath is about 14. In some embodiments, the pH of the electrochemical bath is about 15.

In some embodiments, the ratio of hydroxide ion concentration:metal ion concentration in the electrochemical bath is greater than about 400:1 when the substrate is susceptible to galvanic replacement in the presence of the metallic material precursor. In some embodiments, the ratio of the concentration of the hydroxide ions to the concentration of the metallic material precursor in the electrochemical bath is in the range of about 50:1 to about 400:1 when the substrate is not susceptible to galvanic replacement in the presence of the metallic material precursor. In some embodiments, the ratio of the concentration of the hydroxide ions to the concentration of the metallic material precursor in the electrochemical bath is greater than about 50:1 when the substrate is not susceptible to oxidation in the presence of the metallic material precursor.

In block 520 nanoparticles are added to one or more of the alkaline solution, the metallic material precursor solution, and the electrochemical bath.

In block 550, a layer of a metallic material is deposited on the nanoparticles via the electrochemical deposition method 10 to produce core-shell nanoparticles having a textured shell.

Conventional methods of electrochemical deposition of a metallic material on a single-crystal substrate result in polycrystalline or amorphous material deposition. Because of losses due to grain boundaries and defects, such materials typically have poor performance characteristics and compromised thermal and mechanical stabilities. For example, the resistivity of a material is known to increase as a result of imperfections, such as defects, impurities, grain boundaries, and dislocations (see Ziman, J. M. "Electrons and Phonons", Clarendon Press, Oxford, 1960). The increased resistance and thermal loading associated with charge transport through polycrystalline material can be mitigated by reducing or eliminating the number of grain boundaries within the material. For example, single-crystal copper has better conductivity than polycrystalline copper. Accordingly, epitaxial metallic material deposition according to some embodiments of the present invention may mitigate charge transport loss across interfaces. The absence of the defects associated with grain boundaries in thin film and bulk materials may also give unique properties, particularly mechanical, optical, electrical and magnetic, which can also be anisotropic, depending on the type of crystallographic structure of the textured metallic material.

The use of single-crystal metallic materials to create plasmonic structures and metamaterials is anticipated to minimize optical losses originating from grain boundaries and surface roughness, demonstrate improved mechanical and thermal stability of nanostructures, provide enhanced localized surface plasmon resonant (LSPR) field intensity of well-faceted nanostructured elements, and generate enhanced plasmonic coupling between high definition nanoscale features. For example, single-crystal silver films sputter deposited on Si(111) substrates have been patterned by electron beam lithography and plasma etching to yield visible frequency hyberbolic metasurfaces that display the characteristic properties of metamaterials with device performance greatly exceeding previous demonstrations with polycrystalline silver films (see, for example, Kildishev, A. V., Boltasseva, A., Shalaev, V. M. "Planar photonics with metasurfaces", Science, 2013: 339 (1232009); Liu, Y. M., Zhang, X. "Metasurfaces for manipulating surface plasmons", Appl. Phys. Lett. 2013: 103 (141101); High, A. A., Devlin, A. A., Dibos, A., Polking, M., Wild, D. S., Perczel, J., de Leon, N. P., Lukin, M. D., Park, H. "Visible-frequency hyperbolic metasurface", Nature, 2015(522):192.) Other plasmonic applications as described by Leach et al. in U.S. patent application Ser. No. 13/813,143 entitled "Apparatus for Manipulating Plasmons" and metamaterial applications (see, for example, Pendry, J. B. "Negative refraction makes a perfect lens". Phys. Rev. Lett. 2000(85): 3966) may benefit from patterned features which are crystalline and epitaxially deposited.

Many beam steering applications in X-ray optics and X-ray microscopy rely on optical elements that are based on diffractive effects rather than refractive effects. The beam steering and imaging quality of these optical elements are determined by their diffraction efficiencies at relevant X-ray wavelengths. They are typically fabricated from metals such as gold because of its high electron density and ease of fabrication (e.g. electroplating) (see, for example, Anderson, E. H., Olynick, D. L., Harteneck, B., Veklerov, E., Denbeaux, G., Chao, W., Lucero, A., Johnson, L., and Attwood, D. "Nanofabrication and diffractive optics for high-resolution x-ray applications", J. Vac. Sci. Technol. B, 2000(18): 6; Jefimovs, K., Bunk, O., Pfeiffer, F., Grolimund, D., van der Veen, J. F. David, C. "Fabrication of Fresnel zone plates for hard X-rays", Microelectronic Engineering, 2007 (84): 1467-1470). However, the optimal thicknesses of metal features in these structures cannot be achieved readily and are limited by technical difficulties in attaining high quality, high aspect ratio metal deposition. Improving the diffraction efficiency by increasing the aspect ratio of lithographed metal features and/or improving the diffraction efficiency of the deposited metallic material may lead to improved performance of the optical elements. Current fabrication methods that employ electroplating of Au into lithographed structures such as zone plates, lead to polycrystalline Au deposition with lower diffraction efficiencies than those expected from single-crystal Au deposition. The ability to deposit highly crystalline metallic materials into high aspect ratio features may lead to improved diffraction efficiency and mitigate the requirement for deposition of even higher aspect ratio structures associated with polycrystalline metal deposition.

The use of metal and metal alloys to catalyze chemical reactions is well known. Metal catalyst materials such as platinum (Pt) and Pt alloys, for example, are known to be some of the most effective catalyst materials for oxygen reduction reactions (ORR) and hydrogen evolution reactions (HER). Such reactions are important to hydrogen fuel cell technologies and producing $H_2$ for clean energy applications, respectively. Improving a catalyst's activity and/or stability can reduce its loading requirements and improve the efficiency of a technology while reducing production costs, particularly when the catalyst is an expensive and rare element (e.g. Pt). Metal catalysts can assist in transferring electrons to reactants and/or alter their energetics and/or facilitate an intermediate chemical transformation. The ability of a catalyst to act in one or more of these ways is recognized to be dependent on the crystallinity of the catalyst material, with some crystal facets leading to enhanced catalytic performance over others. The use of catalyst alloys can alter energetics and/or bond lengths, leading to improved catalytic activity and/or stability. The ability to deposit a catalyst material as an element, compound, or alloy in an epitaxial manner may enable the creation of catalysts with preferential faceting and enhanced catalytic activity. Epitaxial crystalline deposition of catalyst materials may also enable higher mechanical and/or thermal and/or chemical stability, thereby improving catalyst longevity.

Other applications where materials are patterned or lithographed may also benefit from epitaxial and crystalline deposition. The magnetic properties of metals and their alloys are dependent on their crystallinity, grain size, and relative orientation. The ability to fabricate higher density magnetic storage media is limited by the magnetic anisotropy of single lithographed bits, which typically comprise multiple grains of material (e.g. PtCo alloy). While efforts to shrink the bit and grain sizes have led to significant increases in storage density, further grain size reduction is anticipated to be limited by thermal instability, even at room temperature. The energy required to reverse the magnetization of a magnetic region is proportional to the size of the magnetic region and the magnetic coercivity of the material. If the grains are very small, there may be enough thermal energy to reverse the magnetization in a region of the medium, comprising the stored data. Increasing the magnetic anisotropy of the grains would allow for higher thermal stability, smaller grains, and higher storage density. Current efforts to overcome these limits include moving to new materials with higher coercivity, although this is accompanied by other technological challenges. Alternatively, bit patterned media is another strategy to enhance storage density in which one can record data in magnetic islands (one bit per island). The islands would be patterned from a precursor magnetic film using nanolithography. This approach also has several technological hurdles associated with it. It is anticipated that the ability to deposit epitaxial, crystalline magnetic films may provide a means to control the magnetocrystalline and/or stress and/or shape anisotropies. This may provide the opportunity for an increase in the effective magnetic anisotropy and/or smaller bit size and/or higher storage density, independent of magnetic storage strategy.

Another potential application related to some embodiments of the present invention includes the formation of optical variable devices (OVD) comprising periodic and/or aperiodic arrays of shape-specific structures for security applications. As described in United States patent application publication No. 2015/0347887 entitled "Optically Variable Data Storage Device", such structures will have very specific optical signatures which are directly related to both the shape and the formation of these structures, as well as the orientation of these features with respect to each other. In the case of an OVD using plasmonic materials, the opto-plasmonic responses of such an OVD can be controlled and defined by the shape of the structures made from one or a combination of several plasmonic materials. When the variations in optical or opto-plasmonic response can be measured with an appropriate reading device which is capable of detecting the optical signatures, such an OVD may be used in applications that involve security and authentication, and may be used as an overt and covert security device. Such technology may benefit from a plurality of physical signatures to enhance the level of security by incorporating both optical and other responses (e.g.

magnetic response). This technology may benefit from the use of high quality crystalline structures and further, from such structures that display shape preference to generate more well defined optical and/or other physical response.

Printed electronics refers to the use of printing methods to create electrical devices on various substrates. As opposed to conventional electronic devices that are fabricated with high integration density on rigid substrates using sophisticated patterning and fabrication techniques that are typically high cost, printed electronics employs simple and extremely low cost fabrication methods to pattern substrates, including flexible substrates, over large area with comparatively low integration density. A key element of this technology is the ink which desirably enables electrical conduction. One of the primary printed electronics strategies involves the use of inks that contain silver nanowires or other conducting elements. However, the resulting printed circuit elements can possess less-than-desired conductivity characteristics, including, for example, when their substrates are subjected to stress and strain that can accompany flexure, or via oxidation of the circuit elements. This printed electronics technology may benefit from embodiments of the present invention by improving the quality of conduction of printed circuit elements through the deposition of conducting metals that contain fewer voids and grain boundaries and/or are less subject to oxidation. Circuit elements comprising continuous metal, as opposed to inks containing dispersions of metallic components, may preserve desirable conduction characteristics under conditions of more severe mechanical deformation.

Another potential area of application of embodiments of the present invention involves the fabrication of transparent conducting substrates. Such substrates are desirable for many technologies that involve the transmission of light as well as the conduction of electric charge. Examples include, without limitation, electrochromic windows and optical light emitting diodes (OLEDs). Transparent conducting substrates in current use typically comprise glass or other transparent material covered with a polycrystalline film of doped oxide (e.g. tin-doped indium oxide or indium tin oxide (ITO)). The high band gap oxide results in transparency in the optical region of the spectrum, while doping imparts limited conductivity. Improved conductivity comes with increasing film thickness, but increasing optical absorbance associated with the dopant induced free charge carriers as well, resulting in a trade-off between conductivity and transparency. Embodiments of the present invention may allow deposition of highly conductive metals with controlled thickness. In cases where the metal deposited does not interfere with the optical properties of the resultant device, or where very thin layers that may not adversely affect the optical properties of the device, embodiments of the present invention may offer a method to provide high conductivity on transparent or partially transparent substrates with beneficial conductivity.

Example 1

Epitaxial Electroless Deposition of Au(100) on Planar Ag(100)

Electroless deposition was carried out on a single-crystal silver (Ag(100) substrate of area 1 cm×1 cm according to method 10 of FIG. 1. The substrate was immersed in a 1.0 M aqueous solution of NaOH. 500 μL of 0.0025 M of $HAuCl_4$ $salt_{(aq)}$ was then added to 10 mL of 1.0M $NaOH_{(aq)}$ and the substrate was immersed in the resulting electrochemical bath for 2 hours. The temperature of the electrochemical bath was maintained at 60° C. during the deposition period. The resulting layer of gold deposited on the silver substrate was about 70 nm in thickness. The layer was observed to be an epitaxial Au(100) film (see FIGS. 8-11). No oxidation of the silver substrate was observed. Accordingly, these conditions produced an epitaxial gold layer on the Ag(100) substrate in the absence of the deleterious effects of galvanic replacement.

Example 2

Characterization of Film Quality

Figure 8:
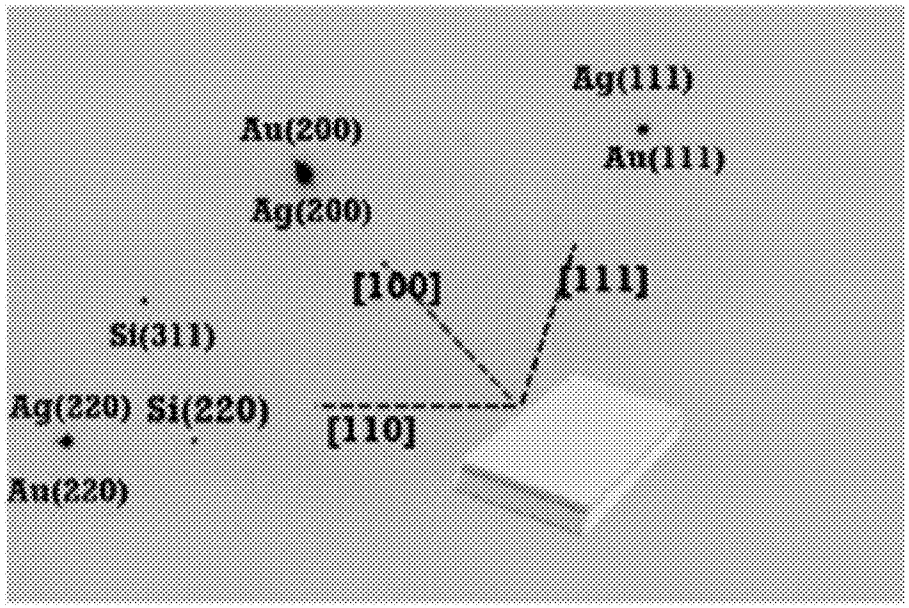
FIG. 8 is a 2D-XRD pattern of an epitaxial, single-crystal gold layer deposited on a single-crystal Ag(100) substrate according to the methods described in Example 1.
Figure 7:
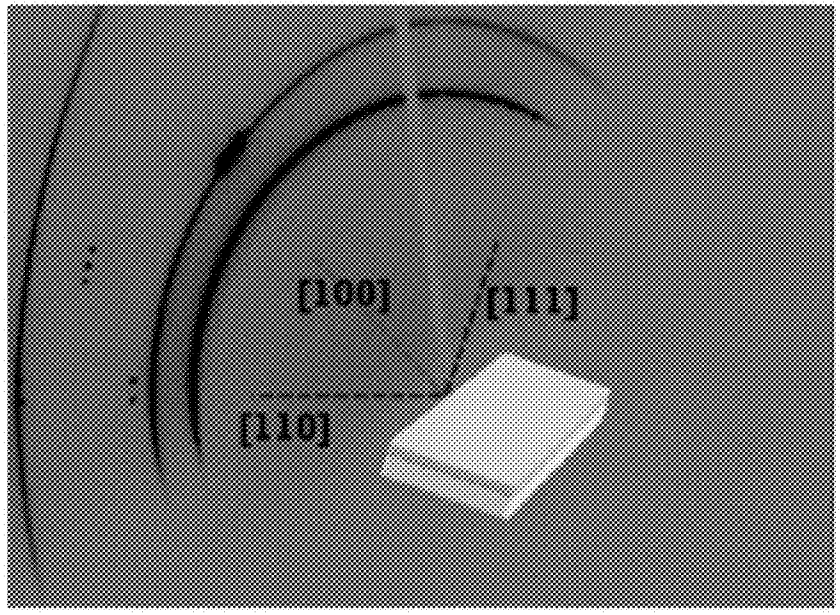
FIG. 7 is a two-dimensional X-ray diffraction (2D-XRD) pattern of a polycrystalline gold layer deposited on a single-crystal Ag(100) substrate under conditions that lead to surface oxidation by galvanic replacement.

The quality of a metallic material layer deposited according to method 10 of FIG. 1 was assessed using conventional physical characterization methods, including X-ray diffraction and electron microscopy. To compare the quality of various films, the metallic material was deposited on a highly uniform, ultra-flat (i.e. single-crystal) substrate. The least crystalline form of a film (i.e. a powder) comprises many randomly ordered crystallites. Crystalline order within each tiny crystallite leads to the diffraction of incident X-rays. The random arrangement of crystallites in a highly polycrystalline film, such as a film that has undergone oxidation via galvanic replacement, leads to an arc of X-ray diffraction intensity in a two-dimensional (2D) X-ray diffraction (2D-XRD) experiment (see FIG. 7). In contrast, the electrochemical deposition of a metallic material (i.e. Au) on a single-crystal substrate Ag(100) according to method 10 of FIG. 1 led to the deposition of a single-crystal, epitaxial Au(100) layer that displayed the unique diffraction spot in the 2D-XRD image shown in FIG. 8. The single spot shown in FIG. 8 is characteristic of the single orientation of the deposited epitaxial metallic material. Electroless deposition was carried out under the conditions described in Example 1. FIGS. 8-11 show the resulting deposited layer.

Figure 9:
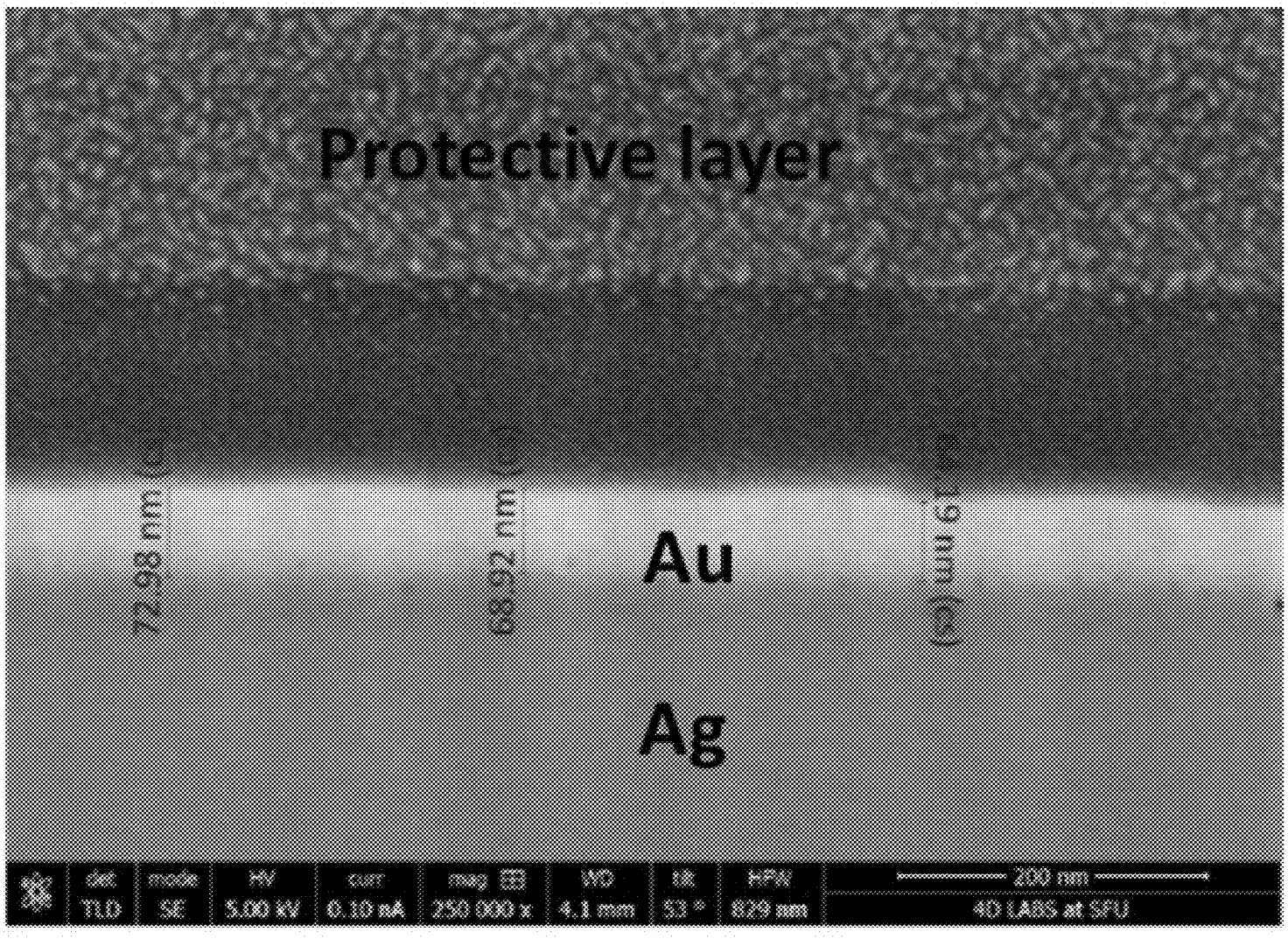
FIG. 9 is a cross-sectional scanning electron microscopy (SEM) image of an epitaxial, single-crystal gold layer deposited on a single-crystal Ag(100) substrate prepared according to the methods described in Example 1.
Figure 10B:
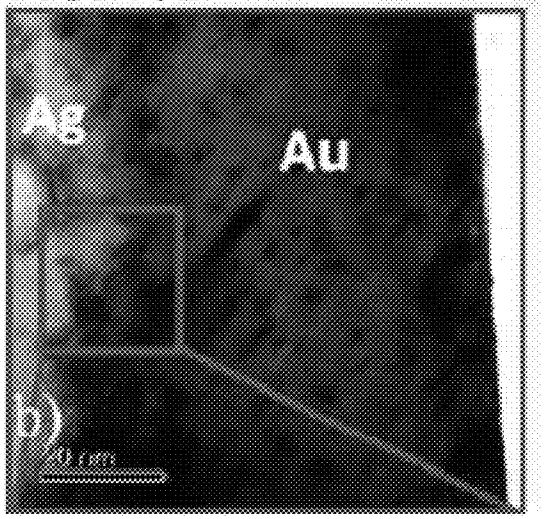
FIG. 10B is a high resolution cross-sectional TEM image (scale bar 20 nm) of the plated substrate highlighted region shown in FIG. 10A, with higher resolution.
Figure 10C:
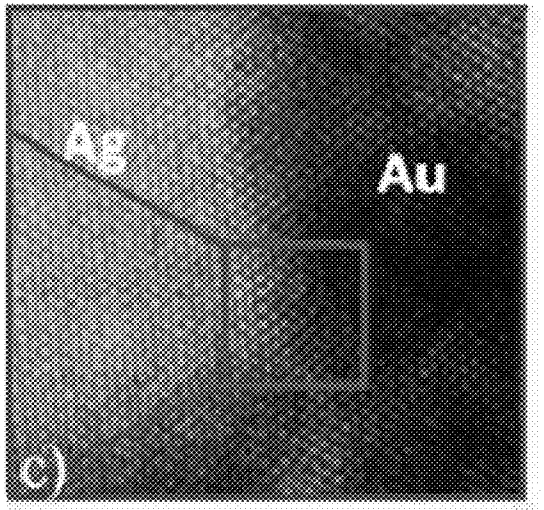
FIG. 10C is an expanded high resolution cross-sectional TEM image of the plated substrate highlighted region shown in FIG. 10B, demonstrating the alignment and registration of metal atoms across the interface.
Figure 10A:
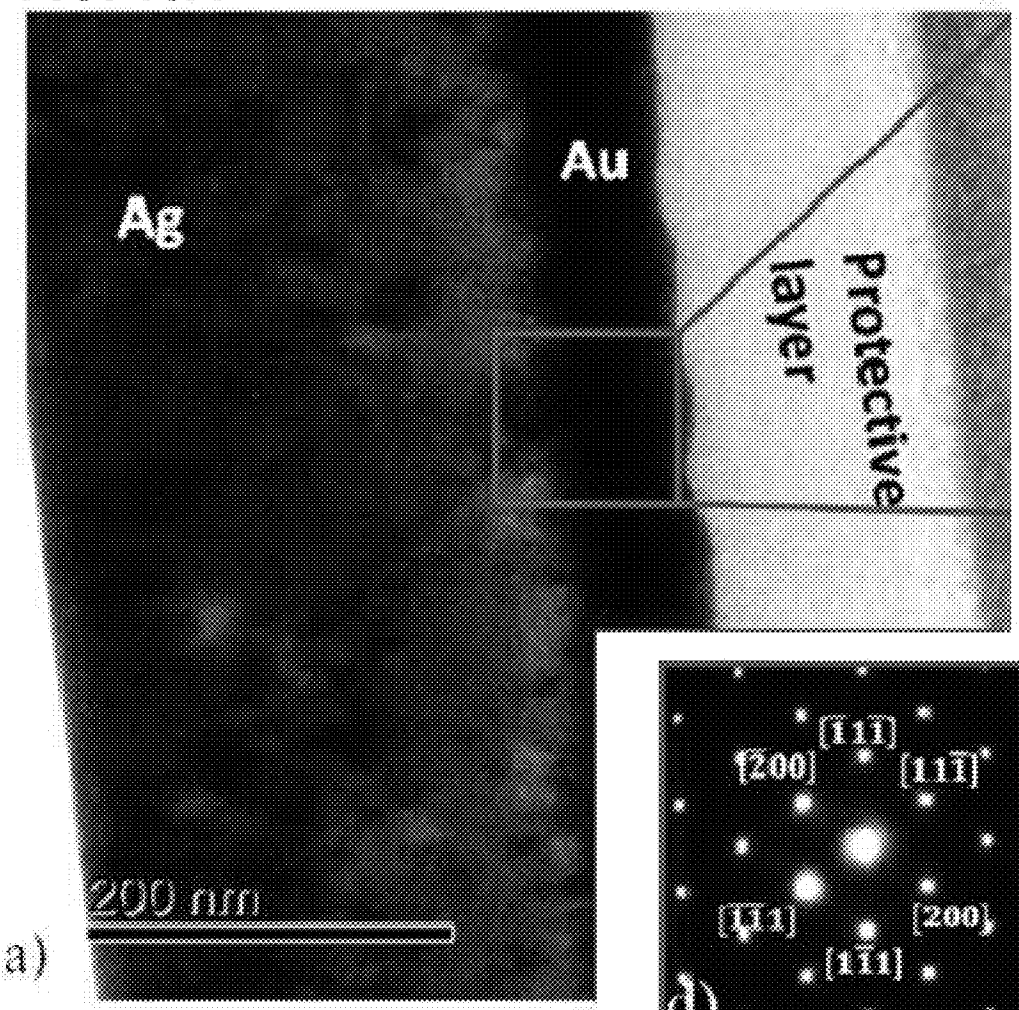
FIG. 10A is a high resolution cross-sectional transmission electron microscopy (TEM) image (scale bar 200 nm) of an epitaxial, single-crystal gold layer deposited on a single-crystal Ag(100) substrate according to the methods described in Example 1.
Figure 10D:
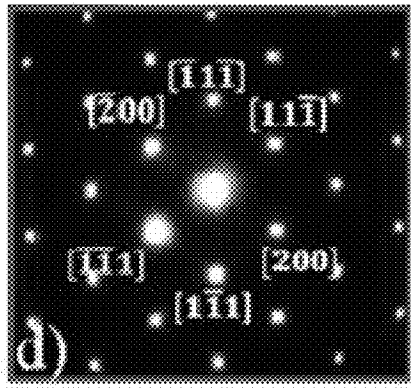
FIG. 10D is a cross-sectional selected area electron diffraction pattern of the highlighted region of the plated substrate shown in FIG. 10C.
Figure 11B:
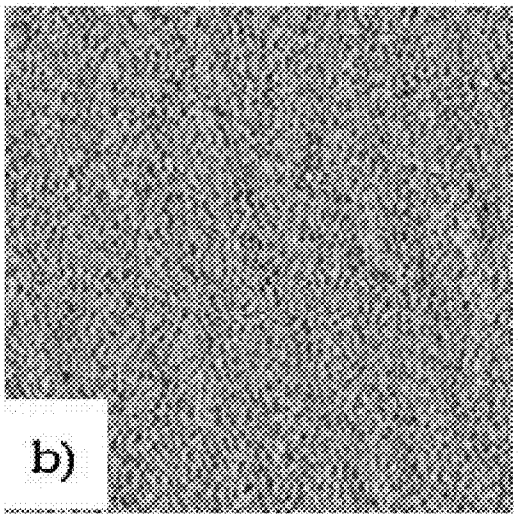
FIG. 11B is an atomic force microscopy (AFM) image ($2\times2$ $\mu m^2$) of the plated substrate shown in FIG. 11A.
Figure 11D:
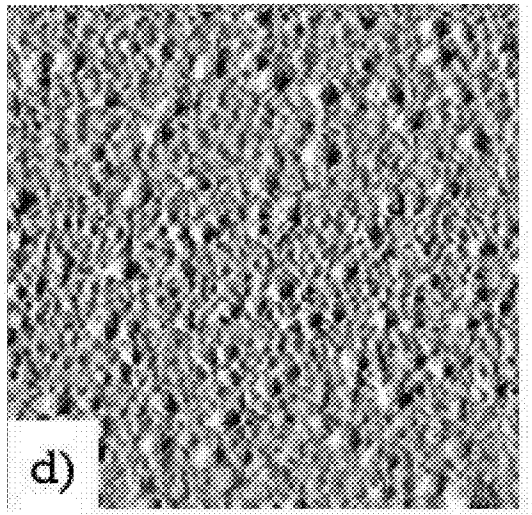
FIG. 11D is an AFM image ($2\times2$ $\mu m^2$) of the plated substrate shown in FIG. 11C.
Figure 11A:
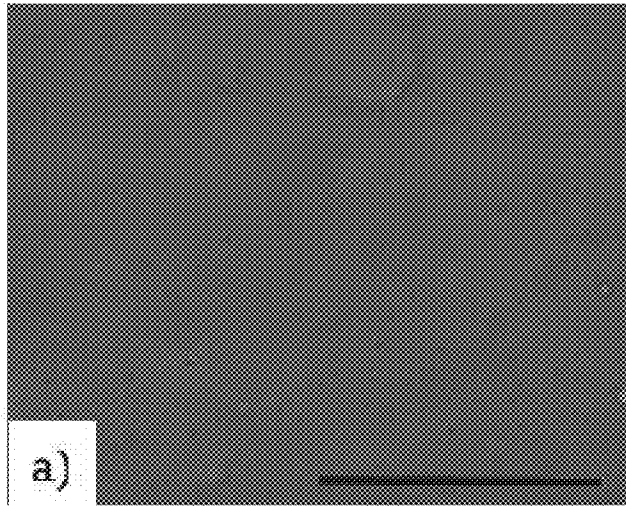
FIG. 11A is a top view SEM image (scale bar 500 nm) of an epitaxial, single-crystal gold layer deposited on a single-crystal Ag(100) substrate according to the methods described in Example 1.
Figure 11C:
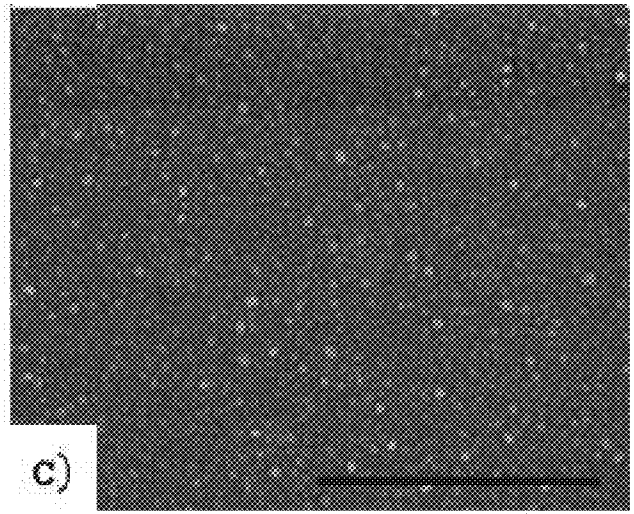
FIG. 11C is a top view SEM image (scale bar 500 nm) of a physical vapor deposition (PVD) deposited gold film on a single-crystal Si(100) substrate containing a 5 nm thick Cr adhesion layer.

FIG. 9 shows a cross-sectional scanning electron microscopy (SEM) image of the plated substrate shown in FIG. 8. The deposited Au layer was about 70 nm in thickness.

FIGS. 10A-10D show high resolution transmission electron microscopy (TEM) images of the plated substrate shown in FIG. 8. The images show alignment of the atomic planes of the Au layer with the atomic planes of the single-crystal Ag(100) substrate at the Au/Ag interface. Selected-area electron diffraction analysis (see FIG. 10D) further supports epitaxial and single-crystal deposition of Au on Ag.

Further characterization of film quality was provided using SEM and atomic force microscopy (AFM). Comparing SEM and AFM images shows that the electroless deposition of a metallic material on a single-crystal substrate according to method 10 of FIG. 1 was able to produce an atomically flat Au film (see FIGS. 11A-11B) with surface roughness over the entire area of approximately 10 Angstroms. In contrast, the surface quality of the Au film deposited on an atomically flat single-crystal silicon substrate containing a 5 nm thick Cr adhesion layer by conventional physical vapor deposition (PVD) methods (i.e. evaporation or sputtering) resulted in the production of a granular, polycrystalline film with a surface roughness of about 10 nm or more (see FIGS. 11C-11D).

Example 3

Additive and Subtractive Fabrication and Electroless Deposition

Figure 12A:
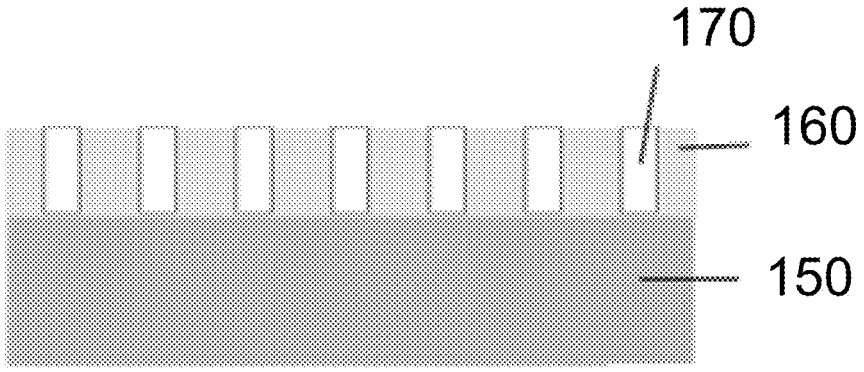
FIG. 12A is a schematic illustration of a substantially crystalline substrate coated with a sacrificial resist containing pores according to an example embodiment of the present invention.
Figure 12B:
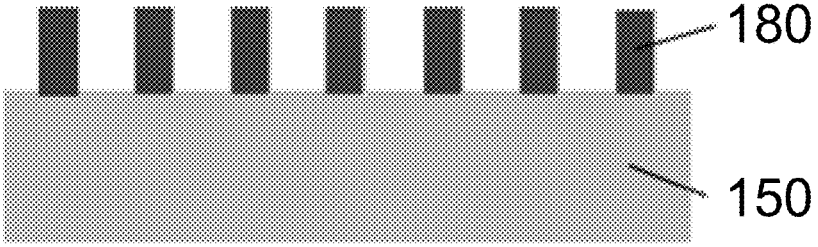
FIG. 12B is a schematic illustration of patterned epitaxial surface features deposited in the pores of the patterned substrate depicted in FIG. 13A, following removal of the sacrificial resist, according to an example embodiment of the present invention.
Figure 12C:
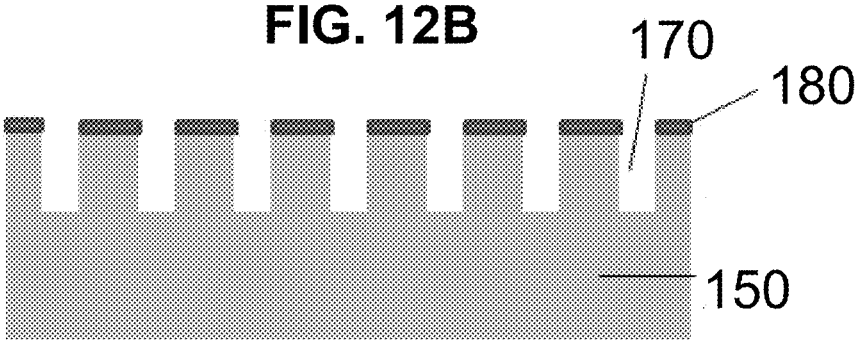
FIG. 12C is a schematic illustration of a substantially crystalline substrate containing pores and a sacrificial layer according to an example embodiment of the present invention.
Figure 12D:
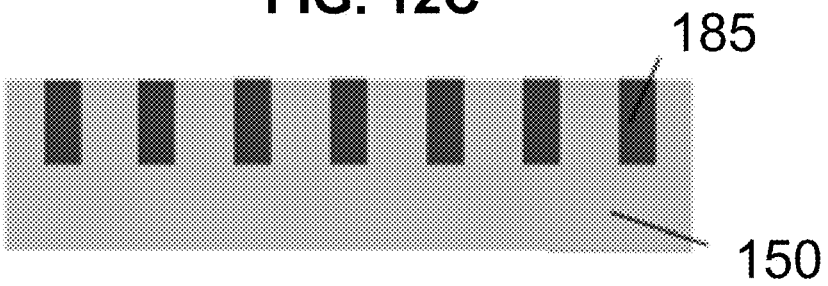
FIG. 12D is a schematic illustration of patterned epitaxial surface features deposited into the pores on the substrate shown in FIG. 13C following removal of the sacrificial layer.
Figure 13A:
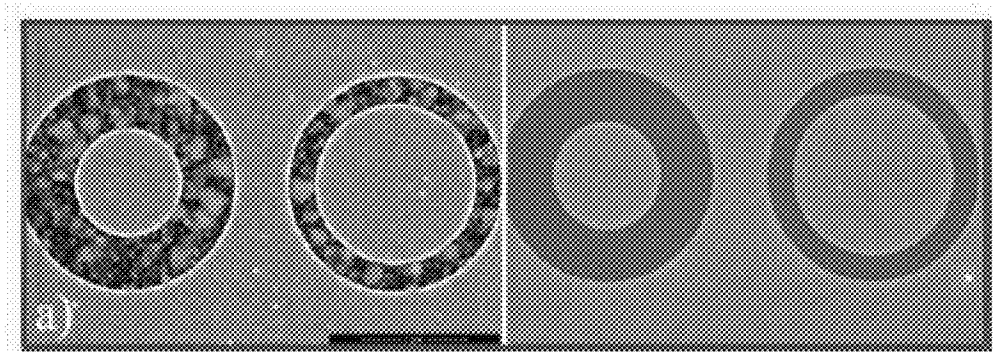
FIG. 13A is a top view SEM image (2 μm scale bar) of two rings patterned by FIB-milled in a PVD-deposited polycrystalline gold layer deposited on a single-crystal Si(100) substrate (left) and the same two features FIB-patterned in an epitaxial gold layer deposited on a single-crystal Ag(100) substrate (right) according to the methods described in Example 1.
Figure 13B:
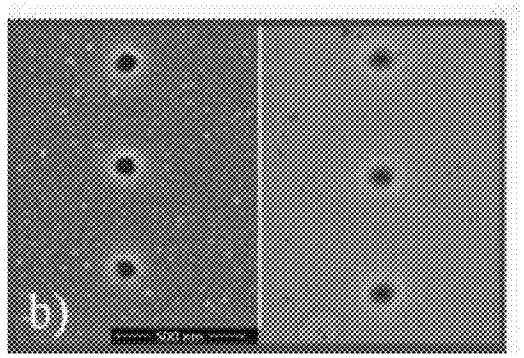
FIG. 13B is a top view SEM image (500 nm scale bar) of a series of holes FIB-milled in the PVD-deposited polycrystalline gold layer (left) and in an epitaxial Au(100) layer (right) according to the methods described in Example 1.
Figure 13C:
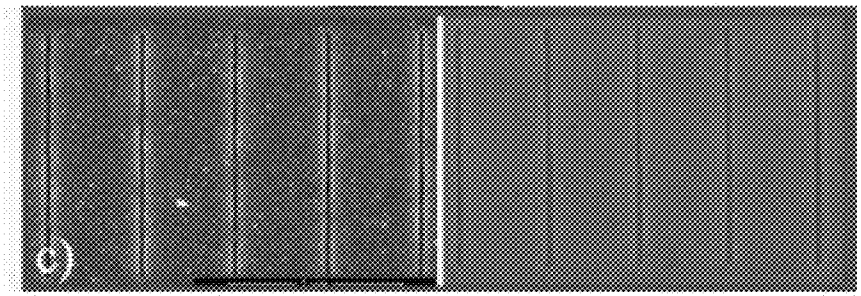
FIG. 13C is a top view SEM image (2 μm scale bar) of a series of lines FIB-milled in the PVD-deposited polycrystalline gold layer (left) and in an epitaxial Au(100) layer (right) according to the methods described in Example 1.
Figure 13D:
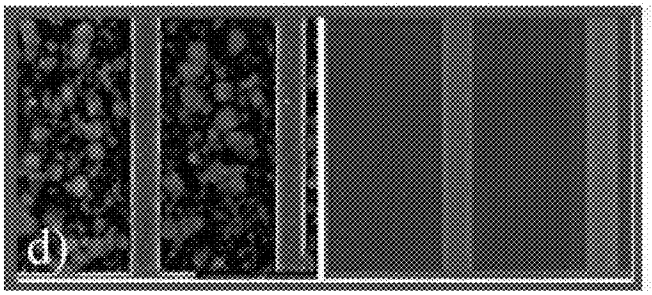
FIG. 13D is a top view SEM image (2 μm scale bar) of a series of FIB-milled windows in the PVD-deposited polycrystalline gold layer (left) and in an epitaxial Au(100) layer (right) according to the methods described in Example 1.
Figure 13E:
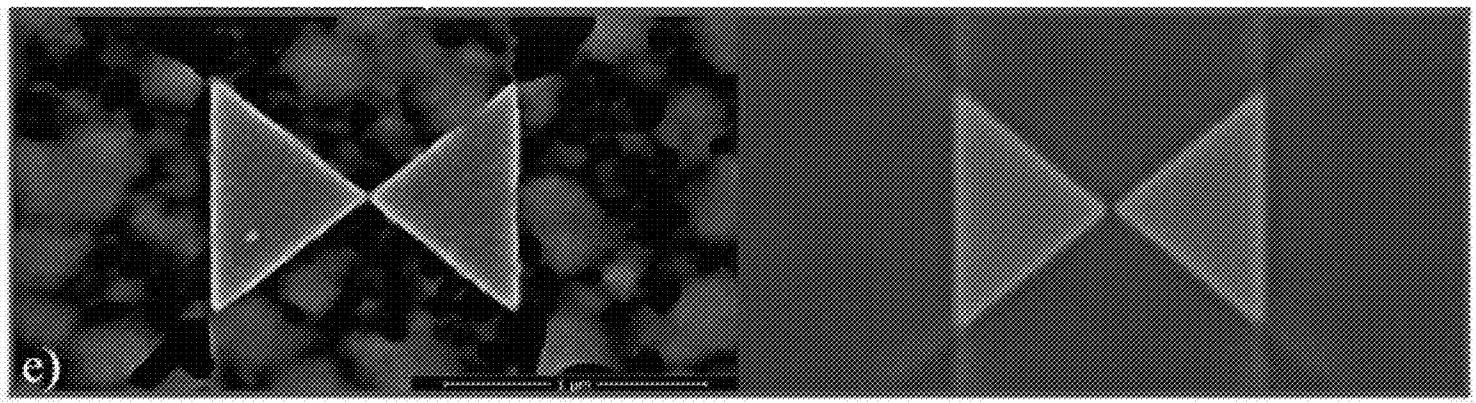
FIG. 13E is a top view SEM image (1 μm scale bar) of a bow-tie antenna FIB-milled in the PVD-deposited polycrystalline gold layer (left) and in an epitaxial Au(100) layer (right) according to the methods described in Example 1.
Figure 16A:
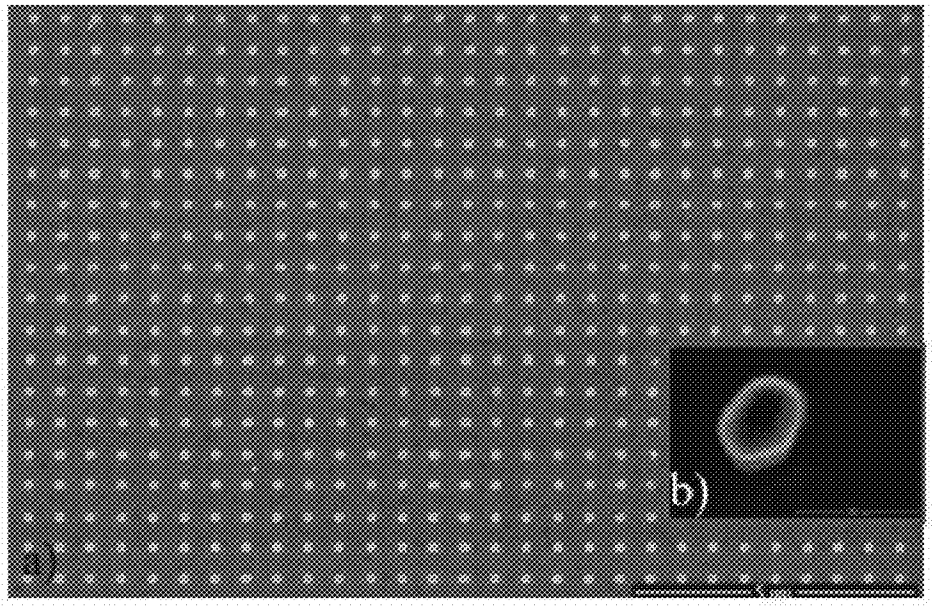
FIG. 16A is a top view SEM image (5 μm scale bar) of an epitaxial, crystalline silver nanopillar array formed on a Ag(100) single-crystal substrate using electron beam lithography patterning, as illustrated in FIGS. 11A and 11B, according to the methods described in Example 3.
Figure 16B:
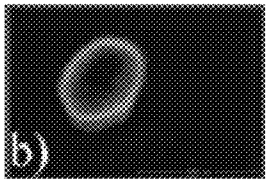
FIG. 16B is a tilt view SEM image (300 nm scale bar) of an individual pillar shown in FIG. 16A. The pillar demonstrates faceting expected from a feature deposited epitaxially on the Ag(100) substrate.
Figure 16C:
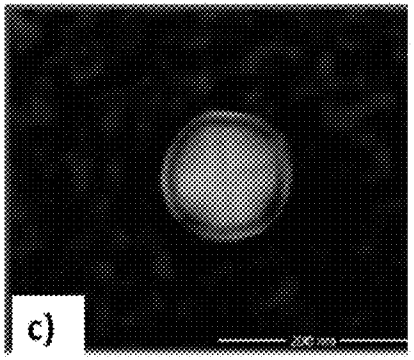
FIG. 16C is a top view SEM image (200 nm scale bar) of an individual pillar shown in FIG. 16A. The top view image shows the presence of crystal facets.

Electron beam lithography was used to pattern a substrate deposited with a layer of a metallic material according to method 10 of FIG. 1. A thin electron beam resist poly(methyl methacrylate) (PMMA) was cast onto a single-crystal silver Ag(100) substrate. The resist was then exposed in selected areas to a focused electron beam to alter the solubility of the resist material where illuminated. The resulting resist-coated substrate contained a series of patterned pores. FIG. 12A is a schematic illustration of a substantially crystalline substrate 150 coated with a resist 160 containing pores 170. Electroless deposition was carried out on resulting substrate. The substrate was immersed in a 1.0 M aqueous solution of NaOH. 500 μL of 0.0025 M of $AgNO_{3(aq)}$ was then added to 10 mL of 1.0M $NaOH_{(aq)}$ and the substrate was immersed in the resulting electrochemical bath for about 10 minutes. The temperature of the electrochemical bath was maintained at 60° C. during the deposition period. Immersing the patterned-resist covered Ag(100) substrate into the electrochemical bath led to inconsistent and/or incomplete deposition of Ag into the patterned substrate pores. Rinsing the patterned substrate with isopropyl alcohol prior to immersion into the electrochemical bath resulted in complete pore deposition within 10 minutes. The metallic material was deposited into the pores of the substrate to yield a patterned metasurface of nanopillars. FIG. 16A shows the resulting silver nanopillar array. A high resolution tilt view scanning electron microscopy (SEM) image of an individual pillar shows that the pillar was faceted and therefore single-crystal (see FIG. 16B). FIG. 16C shows a top view SEM of a pillar highlighting its facets. FIG. 12B shows a schematic illustration of patterned epitaxial surface features 180 deposited on substrate 150. In some embodiments, pores 170 may be formed directly in substrate 150. FIG. 12C shows a schematic illustration of such a substrate covered with a sacrificial layer 180. FIG. 12D shows a schematic illustration of patterned epitaxial surface features 185 deposited on substrate 150 following removal of sacrificial layer 180.

Figure 14A:
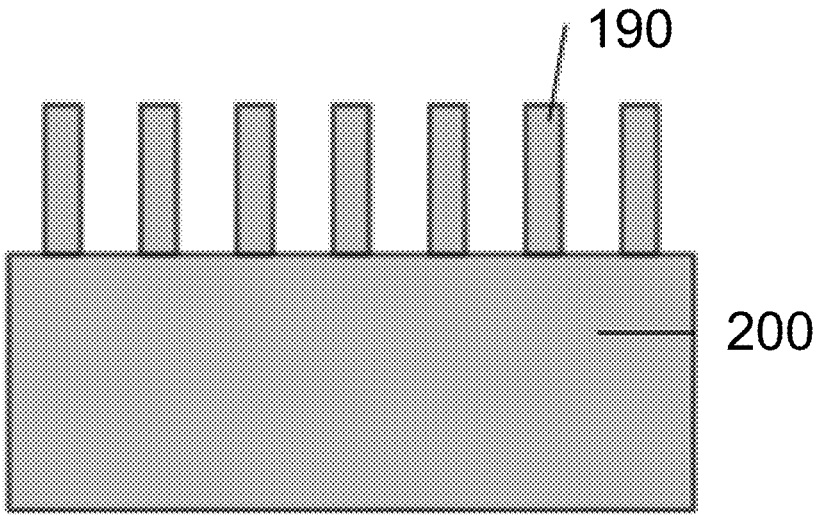
FIG. 14A is a schematic illustration of patterned pillars deposited on a substantially crystalline substrate according to an example embodiment of the present invention.
Figure 14B:
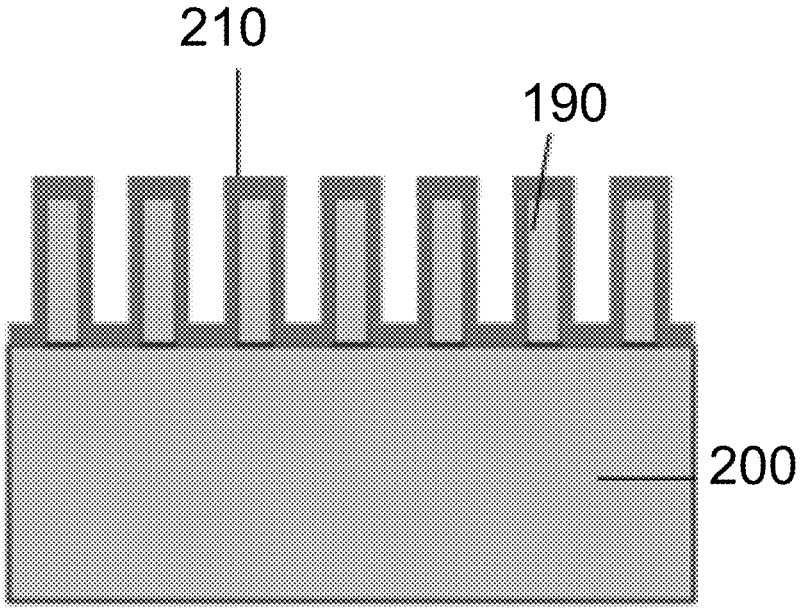
FIG. 14B is a schematic illustration of the FIG. 15A patterned pillars coated with an epitaxial layer of a metallic material according to an example embodiment of the present invention.
Figure 16D:
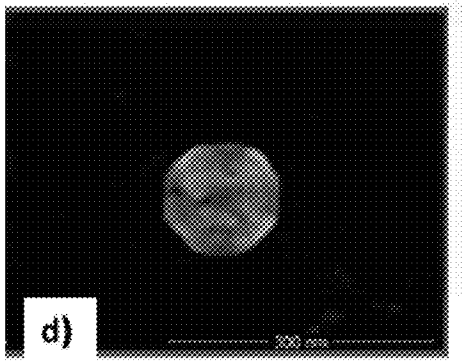
FIG. 16D is a top view SEM image of the pillar shown in FIG. 16C coated with a thin ~10 nm layer of gold according to an example embodiment of the present invention. The coated pillar retains its facted characteristics, implying that the deposited gold overlayer is heteroepitaxial.

An additional layer of a second metallic substrate was deposited on the plated substrate via electroless deposition according to method 10 of FIG. 1. Electroless deposition was carried out on a single-crystal silver (Ag(100) substrate of area 1 cm×1 cm according to method 10 of FIG. 1. The substrate was immersed in a 1.0 M aqueous solution of NaOH. 500 μL of 0.0025 M of $HAuCl_4$ $salt_{(aq)}$ was then added to 10 mL of 1.0M $NaOH_{(aq)}$ and the substrate was immersed in the resulting electrochemical bath for 10 minutes. The temperature of the electrochemical bath was maintained at 60° C. during the deposition period. FIG. 16D shows a top view SEM of a gold-coated silver pillar, which retained a faceted character. The thin gold overlayer prevented the underlying silver surface from undergoing oxidation. FIG. 14A shows a schematic illustration of patterned pillars 190 deposited on a substantially crystalline substrate 200. FIG. 14B shows a schematic illustration of patterned pillars 190 coated with an epitaxial layer 210 of a metallic material.

Figure 15A:
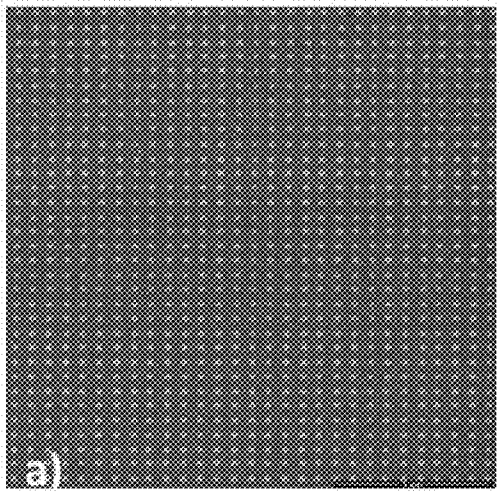
FIG. 15A shows a top view SEM image (5 μm scale bar) of a gold-coated silver nanopillar array with 550 nm pillar periodicity according to the methods described in Example 3.
Figure 15B:
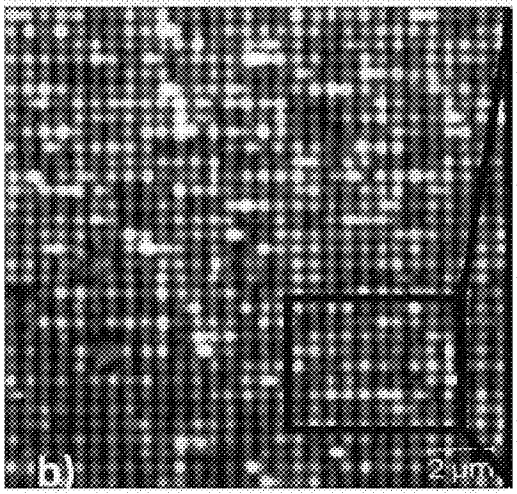
FIG. 15B shows a confocal microscope image (2 μm scale bar) of two-photon photoluminescence (2PPL) emanating from the gold-coated silver pillar array shown in FIG. 16A, following excitation with a pulsed laser centered at 735 nm wavelength.
Figure 15C:
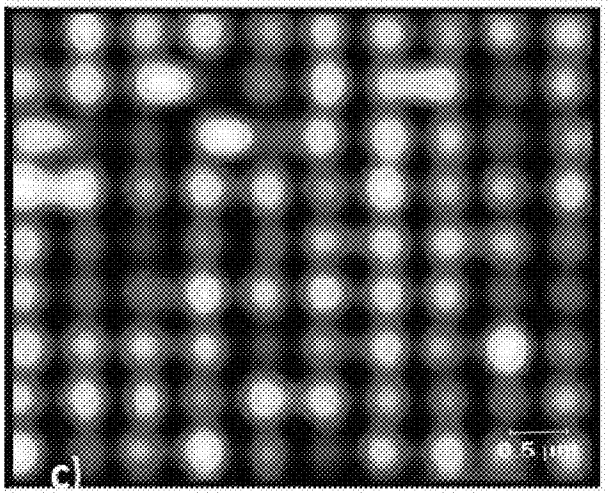
FIG. 15C shows an enlarged image of the confocal microscope image of 2PPL shown in FIG. 15B.

The gold-coated silver pillars were imaged with a confocal microscope equipped with a laser capable of exciting two-photon photoluminescence in the pillar array. Photoexcitation of locally resonant surface plasmons is known to induce 2PPL with particular spectral signatures according to the size, shape, and periodicity of the pillars in the array. FIG. 15A shows a top view SEM image of the gold-coated silver pillars. FIG. 15B-15C show confocal microscope images of two-photon photoluminescence (2PPL) from the gold-coated silver pillars excited with a short pulse laser centered at 735 nm wavelength, indicating that the gold-coated silver nanopillar array is plasmonically active. FIG. 15B shows a high resolution 2PPL image with emission from all individually resolved pillars. Other experiments indicated that the emitted light peaked at an emission wavelength of 580 nm. FIG. 15C shows an enlarged image of the pillar array showing 2PPL hot spots from individual pillars.

Surface quality was further assessed using patterning methods. A focussed ion beam (FIB) of gallium ions was used to mill material from the metallic material layer produced according to method 10 of FIG. 1 in selected areas to yield patterns with features as small as several nanometers in dimension (i.e. subtractive manufacturing). As seen in FIGS. 13A-13E, the fidelity of the pattern generation obtained via electroless deposition of gold on a single-crystal substrate according to method 10 of FIG. 1 was far superior to that obtained with PVD-deposited gold. Polycrystalline gold deposited via PVD resulted in anisotropic rates of ion milling in the differently oriented grains and therefore less uniform milling rates and poorer pattern transfer quality.

Example 4

Single-Crystal Gold Nanowires

Figure 17:
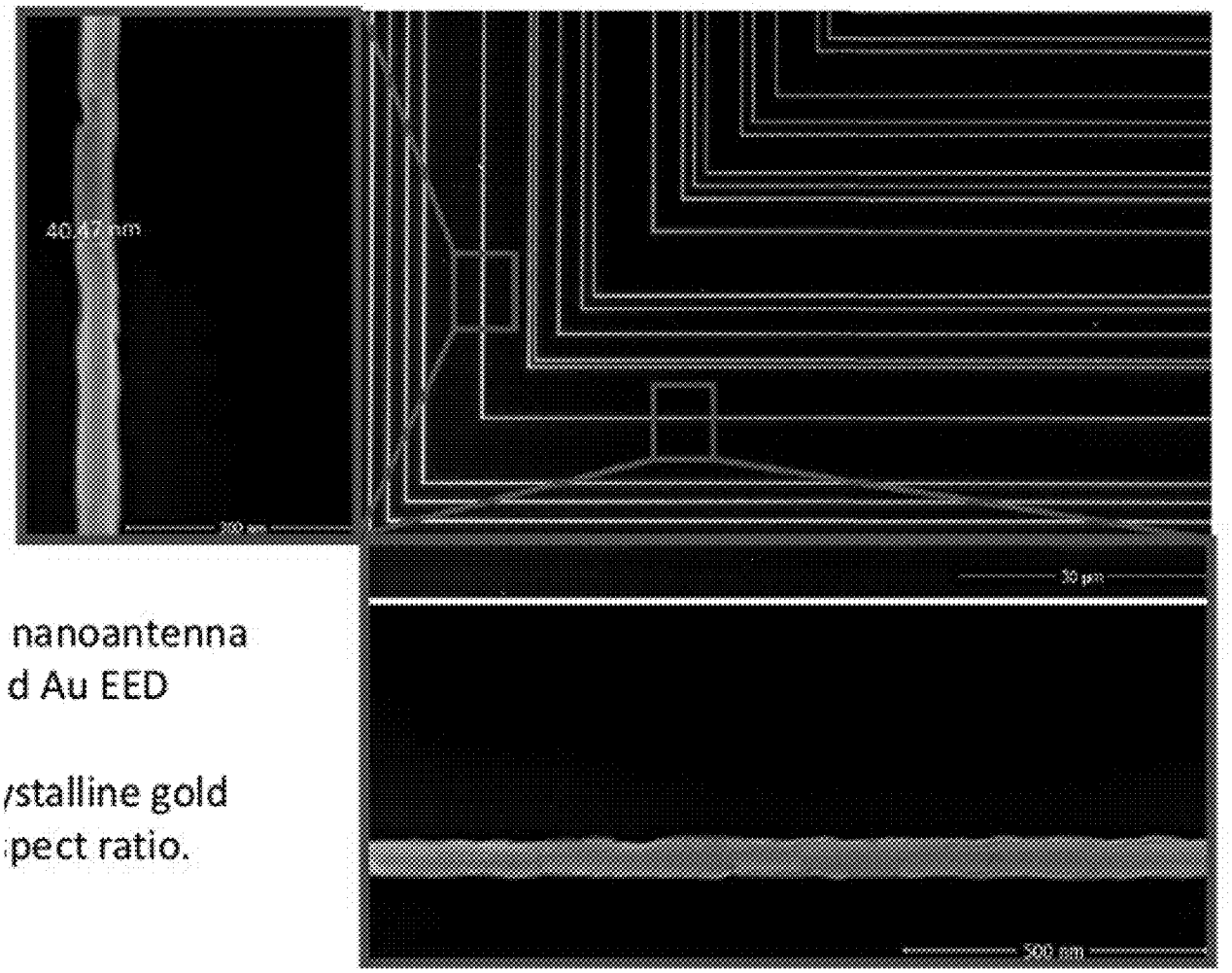
FIG. 17 shows a top view SEM image (300 μm scale bar) of a portion of a rectangle-based nanowire structure patterned by electron beam lithography (EBL). High aspect ratio crystalline gold nanowires displaying narrow widths over long distances) have been deposited on a single crystal Ag(100) substrate according to an example embodiment of the present invention. Inset (left) (300 nm scale bar) demonstrates nanowire widths of about 40 nm Inset (lower) (500 nm scale bar) demonstrates continuous crystalline wire characteristics.

Electron beam lithography (EBL) was used to pattern a substrate deposited with a layer of a metallic material according to method 10 of FIG. 1. A patterned structure of concentric rectangles was formed using the EBL method described elsewhere herein (see FIG. 17). Electroless deposition was carried out under the conditions described in Example 1, with the exception that the deposition period was 5 minutes. FIG. 17 shows a top view SEM image (300 μm scale bar) of a portion of the rectangle-based nanowire structure. High aspect ratio crystalline gold nanowires characterized by narrow widths over long distances have been deposited on a single-crystal Ag(100) substrate. Inset (left) (300 nm scale bar) demonstrates that nanowire widths of about 40 nm are readily achievable. Inset (lower) (500 nm scale bar) demonstrate that the nanowires have continuous, crystalline characteristics. FIG. 17 shows that such nanowires are capable of extending over relatively long distances of hundreds of microns to millimeters, limited by the write field characteristics of the electron beam patterning instrument.

Example 5

Shape-Controlled Electroless Epitaxial Deposition

A variety of shape control agents were used to deposit a layer of metallic material having a preferred geometry or texture. The shape control agents were observed to interact preferentially with the different facets of the substrate over the metallic material. The shape control agents were then observed to impart differential growth kinetics and result in crystalline deposits with crystallographic texture and/or well-defined shape preferences. Stronger interaction of the agent with a particular crystalline facet of the substrate made the facet less available for metallic material deposition. This "blocking" effect slowed the rate of growth of these facets preferentially and lead to higher relative metallic material deposition rates on other facets, with the net effect of imparting specific texture to the film.

Figure 18:
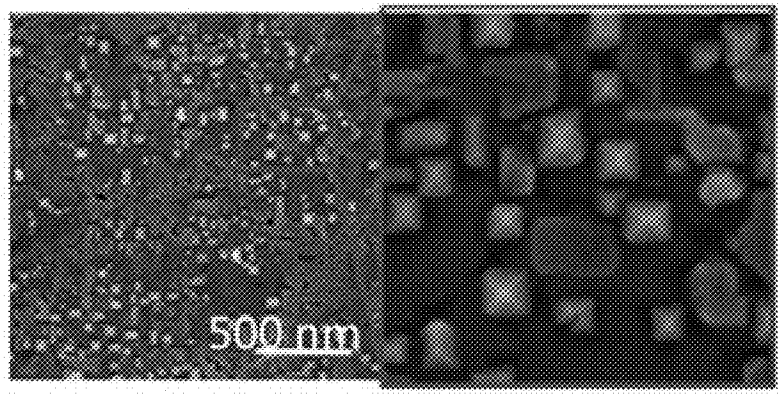
FIG. 18 shows a top view SEM image (500 nm scale bar) of nanometer-scale gold square pyramids deposited on a single crystal Ag(100) substrate according to an example embodiment of the present invention. Gold deposition in the presence of the shape control agent $Na_2SO_4$ yields a textured gold film characterized by oriented square pyramids registered with the underlying substrate. Inset (right) shows an expanded view of the highlighted area showing smoothly-faceted oriented square pyramids.

FIGS. 18-21 show the deposition of square pyramid shape control agents with different substrates and/or metallic material affinities. FIG. 18 shows a top view SEM image (500 nm scale bar) of nanometer-scale gold square pyramids deposited on a single crystal Ag(100) substrate. Gold deposition in the presence of the shape control agent $Na_2SO_4$ yields a textured gold layer characterized by oriented square pyramids registered with the underlying substrate. The inset shows an expanded view of the highlighted area showing smoothly-faceted oriented square pyramids. Deposition of copper under similar conditions but in the absence of this shape control agent, yields smooth single crystal Cu(100) surfaces, indicating that this additive is capable of imparting specific controllable texture to the deposited film.

Figure 19:
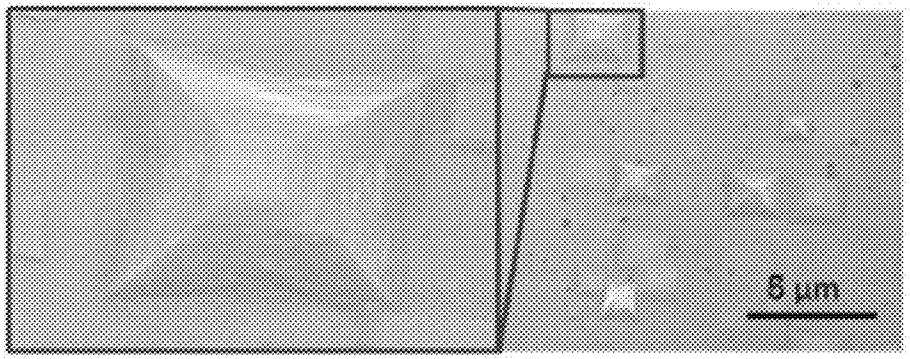
FIG. 19 shows a top view SEM image (5 μm scale bar) of gold square pyramids containing corkscrew defects deposited on a single crystal Ag(100) substrate according to an example embodiment of the present invention. Gold deposition in the presence of the shape control agent NaCl yields a textured gold film characterized by oriented square pyramids comprising corkscrew defects registered with the underlying substrate. Inset (let) shows an expanded view of a single pyramid highlighting the non-uniform facet morphology of the oriented square pyramids.

FIG. 19 shows a top view SEM image (5 μm scale bar) of gold square pyramids exhibiting corkscrew defects deposited on a single crystal Ag(100) substrate in the presence of the shape control agent NaCl. The resulting textured gold film is characterized by oriented square pyramids exhibiting corkscrew defects registered with the underlying substrate. The inset shows an expanded view of a single pyramid highlighting the non-uniform facet morphology of the oriented square pyramids and indicating a specific form of texture resulting from this shape control agent.

Figure 20:
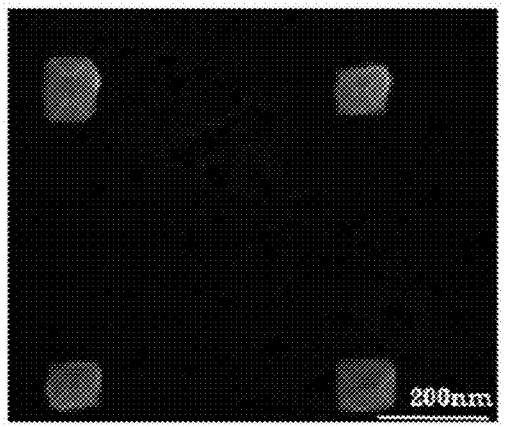
FIG. 20 shows a top view SEM image (200 nm scale bar) of nanometer-scale copper square pyramids deposited in the presence of the shape control agent $Na_2SO_4$ on a single crystal Au(100) substrate patterned by electron beam lithography according to an example embodiment of the present invention. Deposition is seen to occur only in the pores and yields smoothly faceted square pyramids with orientations registered with the underlying substrate.
Figure 22B:
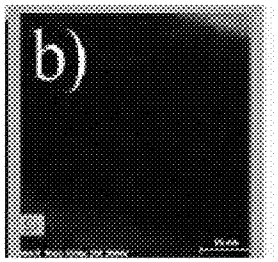
FIG. 22B shows an expanded TEM image (70 nm scale bar) of the region highlighted in FIG. 22A with elemental mapping contrast. The image highlights the location of silicon in the multilayer structure.
Figure 22C:
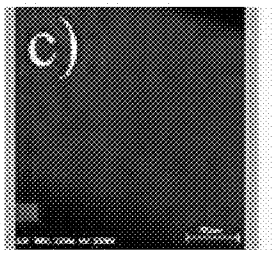
FIG. 22C shows an expanded TEM image (70 nm scale bar) of the region highlighted in FIG. 22A with elemental mapping contrast. The image highlights the location of silver in the multilayer structure.
Figure 22D:
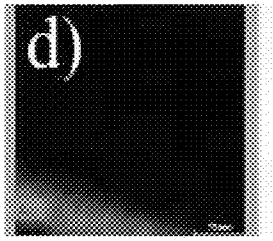
FIG. 22D shows an expanded TEM image (70 nm scale bar) of the region highlighted in FIG. 22A with elemental mapping contrast. The image highlights the location of gold in the multilayer structure.
Figure 22E:
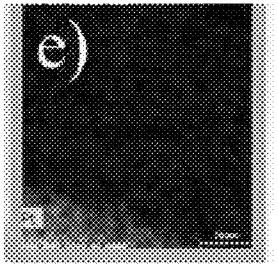
FIG. 22E shows an expanded TEM image (70 nm scale bar) of the region highlighted in FIG. 22A with elemental mapping contrast. The image highlights the location of platinum in the multilayer structure.
Figure 22A:
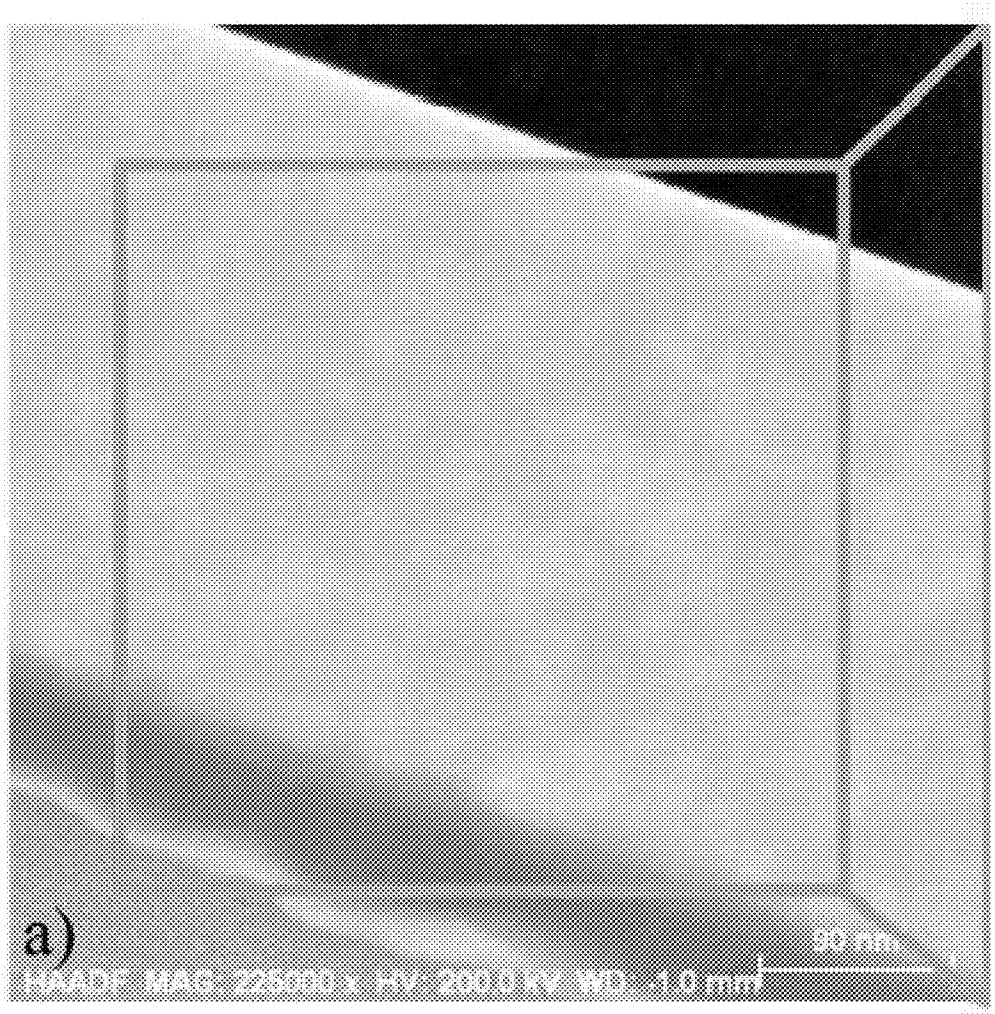
FIG. 22A shows a high-angle annular dark-field (HAADF) transmission electron microscopy image (90 nm scale bar) of a silicon-supported single crystal silver Ag(100) substrate deposited sequentially with gold (Au) and platinum (Pt) to yield a film containing a mixture of metals according to an example embodiment of the present invention.

FIG. 20 shows a top view SEM image (200 nm scale bar) of nanometer-scale copper square pyramids deposited in the presence of the shape control agent $Na_2SO_4$ on a single crystal Au(100) substrate patterned by electron beam lithography (EBL). Deposition is seen to occur only in the pores and yields smoothly faceted square pyramids with orientations registered with the underlying substrate. This example demonstrates the ability to perform patterned, shape controlled, heteroepitaxy as illustrated schematically in FIG. 4B.

Figure 21:
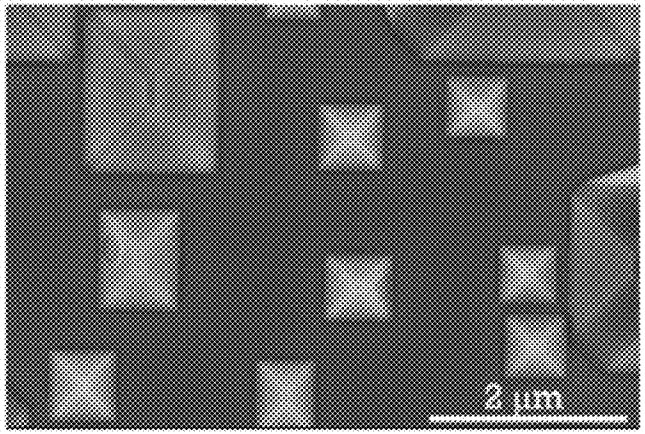
FIG. 21 shows a top view SEM image (2 μm scale bar) of nanometer-scale gold square pyramids deposited on a single crystal Ag(100) substrate according to an example embodiment of the present invention. Gold deposition in the presence of the shape control agent $SO_4^{2-}$ from the metal material precursor yields a textured gold film characterized by smoothly faceted oriented square pyramids registered with the underlying substrate.

FIG. 21 shows a top view SEM image (2 μm scale bar) of nanometer-scale copper square pyramids deposited on a single crystal Ag(100) substrate. Copper deposition in the presence of the shape control agent $SO_4^{2-}$ from the metal material precursor $CuSO_4$ yields a textured copper film characterized by smoothly faceted oriented square pyramids registered with the underlying substrate.

Example 6

Metal Composite Films

Sequential electroless deposition was carried out on a silver-coated silicon substrate according to method 10 of FIG. 1 to deposit metals from different metal salts. Thin layers of gold (Au) and platinum (Pt) were deposited. The transmission electron microscopy (TEM) images shown in FIGS. 22A-22E are high-angle annular dark-field (HAADF) transmission electron microscopy images showing elemental mapping within the multilayer film structure. The presence of thin layers of Au and Pt without any significant intermixing of the metals demonstrates the ability to deposit metal composite layers in which the layer comprises a mixture of metals.

Figure 24A:
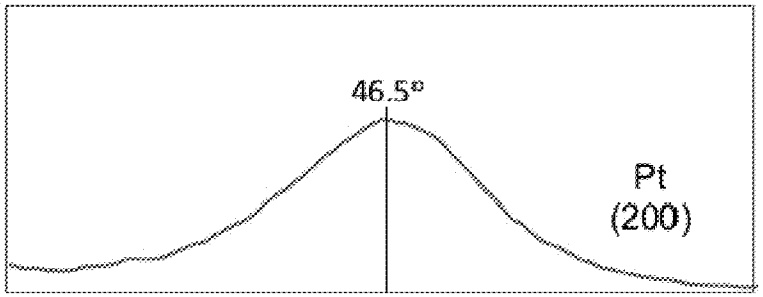
FIG. 24A shows a one-dimensional X-ray diffraction (1D-XRD) pattern of single-crystal Pt(100) on single crystal Ag(100) according to an example embodiment of the present invention.
Figure 24B:
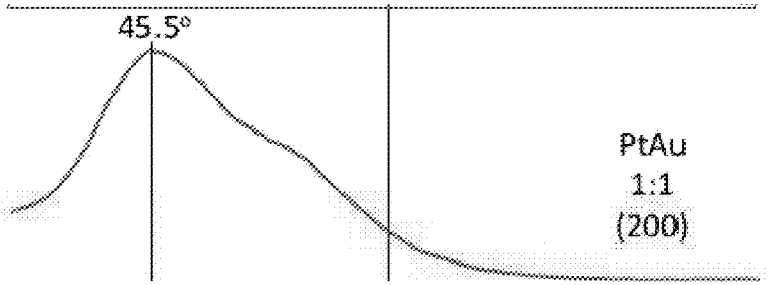
FIG. 24B shows a one-dimensional X-ray diffraction (1D-XRD) pattern of a single-crystal PtAu(100) alloy formed from a 1:1 molar ratio of Pt- and Au-containing metal salts in the electrochemical bath deposited on single crystal Ag(100) according to an example embodiment of the present invention.
Figure 24C:
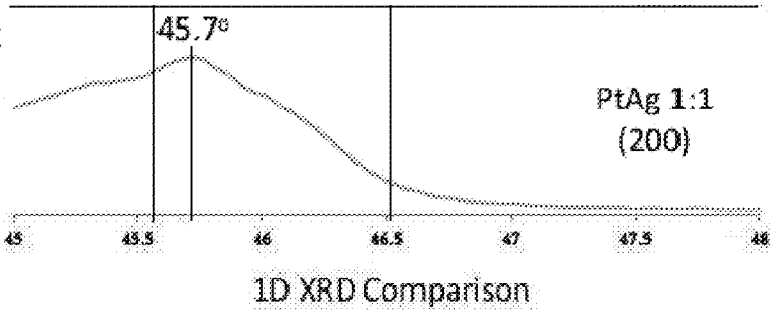
FIG. 24C shows a one-dimensional X-ray diffraction (1D-XRD) pattern of a single-crystal PtAg(100) alloy formed from a 1:1 molar ratio of Pt- and Ag-containing metal salts in the electrochemical bath deposited on single crystal Ag(100) according to an example embodiment of the present invention.
Figure 23:
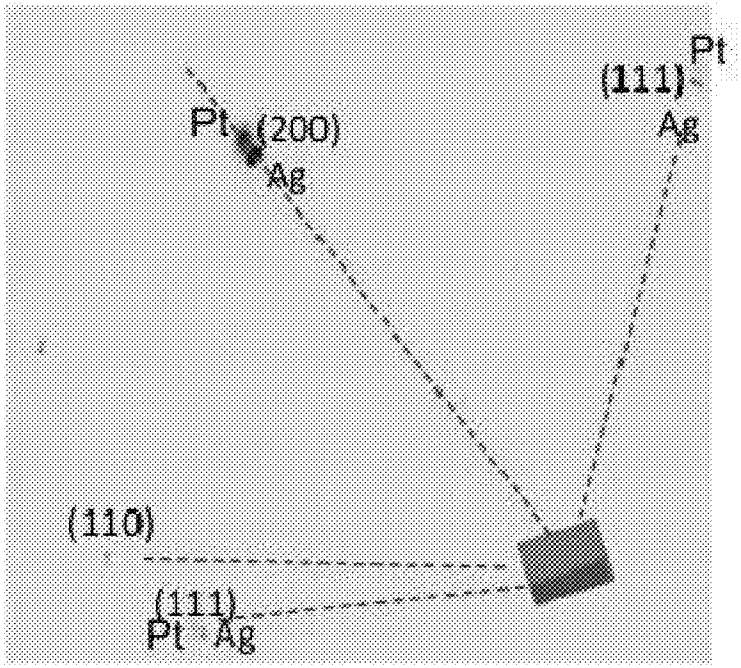
FIG. 23 shows a two-dimensional X-ray diffraction (2D-XRD) pattern of single-crystal Pt(100) deposited on single-crystal Ag(100) as evidenced by the highly localized Pt(200) diffraction intensity distribution.
Figure 25:
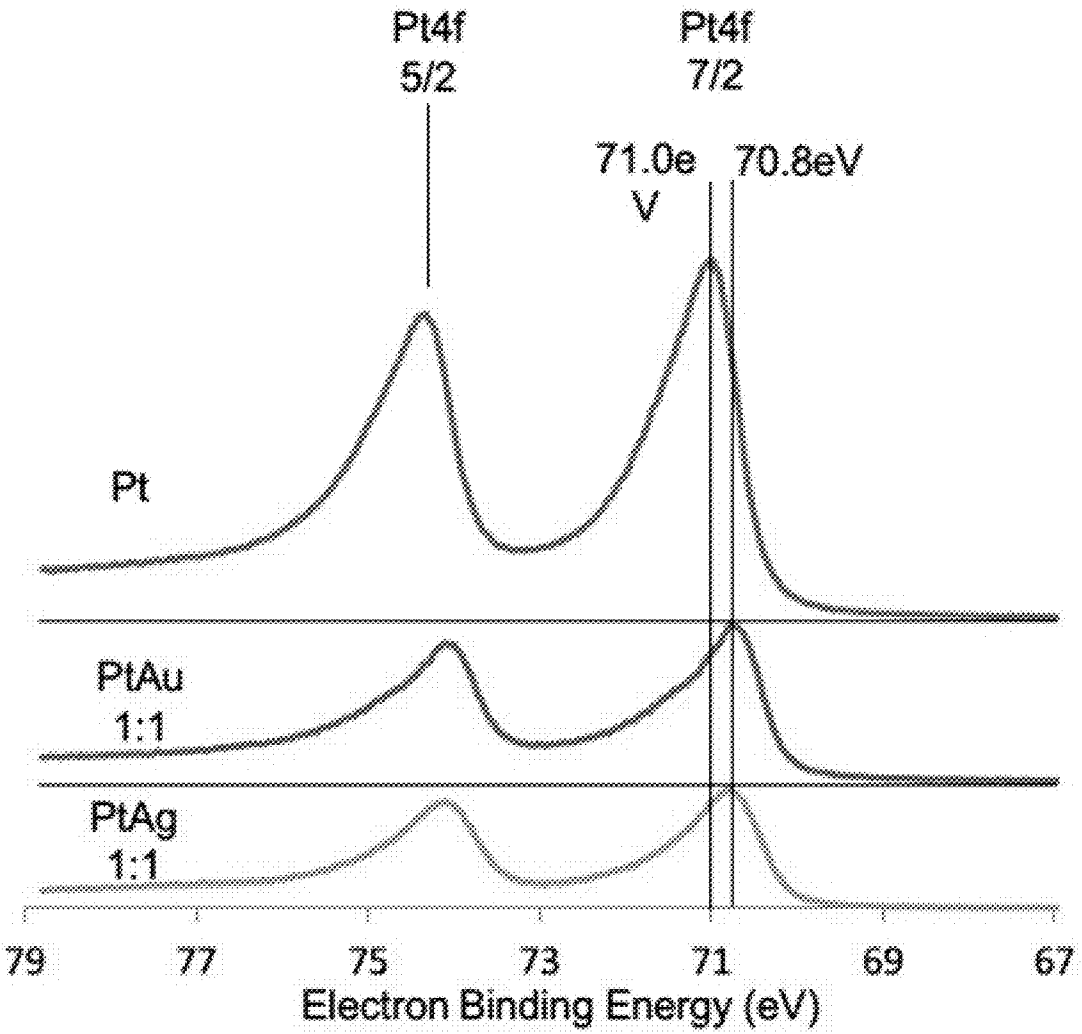
FIG. 25 shows an X-ray photoelectron spectroscopy (XPS) graph showing the XPS energies of Pt and PtAu (1:1) and PtAg (1:1) alloys deposited according to an example embodiment of the present invention.

Deposition of a metal alloy film was obtained by the simultaneous deposition of metals from an electrochemical bath containing two or more metal salts. Alloy formation was confirmed through X-ray diffraction (XRD) and X-ray photoelectron spectroscopy (XPS). Au—Pt and Ag—Pt alloys were deposited from baths containing salts of Au and Pt and salts of Ag and Pt, respectively. The alloy composition was determined based on the relative concentration of each metal salt in the bath. New material alloy formation (as opposed to segregation of the metals to make a film mixture) was confirmed from XRD (FIGS. 23-24) and XPS data (FIG. 25).

The two-dimensional XRD (2D-XRD) pattern of single-crystal Pt (FIG. 23) shows two distinct spots, one from the single-crystal silver substrate and one from the single-crystal Pt film. The one-dimensional XRD (1D-XRD) pattern was obtained by taking a narrow angular segment of the 2D-XRD pattern along the 200 direction (FIGS. 24A-24C). Pure Pt films showed a diffraction peak at 46.5° (FIG. 24A). Pt—Au (1:1) (FIG. 24B) and Pt—Ag (1:1) (FIG. 24C) alloy films showed new diffraction peaks (45.5° and 45.6°, respectively) at unique angles that differed from those of Pt, Au (44.3°), and Ag (44.4°), indicating the formation of new alloys. The formation of new alloys is supported by XPS data (FIG. 25), which shows that the XPS energies of the alloy films were shifted in energy with respect to those of pure Pt films.

Example 7

Epitaxial Electroless Deposition of Au(100) on Planar Ag(100)

Electroless deposition was carried out on a single-crystal silver (Ag(100)) substrate of area 1 cm×1 cm according to method 10 of FIG. 1. An alkaline solution was prepared by mixing sodium hydroxide (NaOH) in deionized water to a concentration of 1.0 M. A metallic material precursor solution was prepared by mixing the gold salt $HAuCl_4$ in deionized water to form a solution of 0.025 M concentration. The substrate was immersed in the alkaline solution. 250 μL of the metallic material precursor solution was then added to 10.0 mL of the alkaline solution. The concentration of hydroxide in the resulting electrochemical bath was 0.97 M. The concentration of gold ions ($Au^{3+}$) in the electrochemical bath was $6.1\times10^{-4}$ M. The temperature of the electrochemical bath was controlled and held at about 70° C. The thickness of the deposited layer, as determined by cross-sectional scanning electron microscopy (SEM), was about 200 nm after a deposition period of about 120 minutes.

In view of the gold layer deposited according to the conditions described in Example 1, increasing the metal ion concentration was observed to yield a thicker deposited layer. Alternatively, increasing the metal ion concentration may yield a deposited layer with a desired thickness within a shorter deposition period.

When the concentration of gold-containing ions relative to the concentration of hydroxide ions in the electrochemical bath exceeds a desired ratio, the substrate may become oxidized (presumably through galvanic replacement) and the quality of the deposited layer may be diminished (i.e. less textured). To determine the threshold conditions for substrate oxidation, deposition of gold onto Ag(100) was carried out under conditions where only the hydroxide ion concentration in the electrochemical bath was varied. A $500\times10^{-6}$ L volume of $2.5\times10^{-3}$ M $HAuCl_{4(aq)}$ was added to each of 10 mL volume aqueous solutions containing sodium hydroxide at concentrations of 0.05 M, 0.10 M, 0.30 M., 0.50 M, and 0.80 M respectively. Gold deposition onto 1 cm×1 cm area Ag(100) substrates was carried out at 60° C. for 120 minutes in the resulting electrochemical baths.

The degree of surface oxidation of the resulting films was assessed by scanning electron microscopy (SEM). Surface oxidation of the silver substrate was observed only for the lowest concentration hydroxide (i.e. 0.05M). In this example, the concentration of gold ions in the resulting electrochemical bath was $1.2\times10^{-4}$ M and the concentration of hydroxide ions in the bath was $4.8\times10^{-2}$ M. The molar ratio of hydroxide ions to gold ions in the bath was about 400. Little, if any, surface oxidation of the substrate was observed for deposition samples containing higher hydroxide ion to gold ion molar ratios. Further, the gold layers resulting from electrochemical deposition of these samples possessed a higher degree of texture and even resulted in an epitaxial layer for some samples. Persons skilled in the art will understand that the ratio of metal ion to hydroxide ion may be less important to the electrochemical deposition of a metallic material onto a substrate that is not capable of oxidizing. However, rates of metal deposition may be affected by decreasing hydroxide concentration and/or metallic material precursor concentration.

The surface area of the substrate was also observed to impact the quality of the deposited layer. For example, when the surface area is very large compared to the number of hydroxide ions and/or gold ions contained in the electrochemical bath, the gold ions are reduced at scattered positions on the substrate surface and the deposited layer is not uniform or homogenous. Instead, small islands of reduced gold formed on the surface of the substrate.

Increasing the temperature of the electrochemical bath was observed to improve and enhance the rate of metallic material deposition. However, at temperatures in excess of about 80° C., faster gold ion reduction was achieved at the expense of quality of the deposited gold layer.

Metallic material deposition under conditions of high metal ion concentration and high hydroxide ion concentrations, or high metal ion concentration and modest hydroxide ion and/or reducing agent concentration, may cause gold nanoparticles to form in the electrochemical bath. Due to incorporation of the nanocrystals into the deposited layer, the surface morphology and the thickness of the gold layer deposited on the substrate was negatively impacted.

Example 8

Epitaxial Eletroless Deposition of Gold onto Lithographically Patterned Ag(100) Substrates Electroless deposition was carried out on a single-crystal silver (Ag(100)) substrate patterned according to a conventional electron beam lithography method to achieve nanometer scale features. To pattern the substrate, a positive photoresist poly(methyl methacrylate) (PMMA) was spin cast onto the Ag(100) substrate. A uniform layer having a 50 nm thickness was observed. The PMMA was irradiated with an electron beam under conditions of about 0.2 nA beam current, 0.1 dose factor×0.12 pA-sec dot dose exposure. To remove the electron beam-modified resist and expose the Ag(100) surface under each region of resist exposure, a developer solution comprised of methyl isobutyl ketone (MIBK) and isopropyl alcohol (IPA) prepared in a volume ratio of 3:1 was used. Resist development provided a patterned surface of 128 nm diameter cylindrical pores of exposed Ag(100) formed in a 5 mm×5 mm square array with a period spacing of 700 nm.

The electroless deposition procedure and conditions described in Example 1 were used to deposit gold onto the PMMA patterned substrate. The total deposition time was decreased to 10 minutes to avoid over-deposition in the patterned cylindrical pores. Electroless gold deposition was observed on the exposed Ag(100) regions yielding a patterned array of crystalline gold (Au) pillars in the pores of the PMMA patterned substrate. The PMMA electron beam resist showed little to no gold deposition, indicating that deposition on the underlying metal is preferential. Subsequent dissolution of the PMMA film in acetone yielded an array of epitaxial Au(100) pillars on the planar silver substrate. The silver substrate showed no indication of oxidation. Accordingly, epitaxial deposition of one metal (Au) onto another (Ag) (heteroepitaxy) and the formation of single crystal Au(100) nanopillar arrays through electroless deposition was observed.

Following a similar procedure for electron beam patterning onto a Au(100) substrate deposited under the conditions described in Example 1, Au(100) pillars were deposited onto Au(100) single-crystal surfaces, demonstrating homoepitaxy. Likewise, Ag(100) pillars may be deposited onto Ag(100) single-crystal surfaces using a similar procedure, except that silver nitrate ($AgNO_3$) is employed as the metal salt.

Example 9

Epitaxial Electroless Deposition of Copper on a Single-Crystal Ag(100)

To provide a single-crystal Ag(100) substrate with an epitaxial layer of copper (Cu) via electroless deposition, a higher concentration of hydroxide ions (i.e. more alkaline pH) was used in comparison with that used to observe epitaxial electroless deposition of more noble metals deposited on the same substrate. At lower hydroxide ion concentrations, the copper ions tend to form insoluble copper hydroxide ($Cu(OH)_2$), thereby preventing the deposition of copper. By increasing the hydroxide ion concentration to about 4.0 M, no such precipitate was formed. 500 μL of a 0.05 M $CuSO_{4(aq)}$ solution was added to a 10 mL solution of 4.0 M $NaO_{(aq)}$ containing a 1 cm×1 cm single crystal Ag(100) substrate. The temperature of the resulting electrochemical bath was maintained at about 60° C. for 2 hours. Epitaxial electroless deposition of Cu was observed. Under these conditions, the initial metal salt concentration in the electrochemical bath was $2.38\times10^{-3}$ M and the hydroxide concentration was 3.81 M. Accordingly, the hydroxide to metal ion concentration ratio was about 1600:1.

Electroless deposition was carried out on a second single-crystal Ag(100) substrate. 500 μL of a 0.05 M $CuSO_{4(aq)}$ solution was added to 10 mL of a 4.0 M $NaOH_{(aq)}$ solution. 500 μL of the resulting solution was then added to a solution of 1.0 M NaOH containing the 1 cm×1 cm Ag(100) substrate. Deposition for a duration of about 2 hours at about 60° C. yielded an epitaxial Cu(100) layer deposited on the substrate. Under these deposition conditions, the concentration of the $CuSO_4$ in the electrochemical bath was $1.13\times10^{-4}$ M and the concentration of hydroxide ions was 1.13 M. Thus, the molar ratio of $OH^-$ to $Cu^{2+}$ ions in the electrochemical bath was about 10,000:1.

Scanning electron microscopy (SEM) was used to inspect the layers resulting from both deposition experiments. No observable oxidation of the substrate was observed. The first set of deposition conditions resulted in the deposition of faceted square pyramids of Cu having a base aligned with the underlying Ag(100) substrate. The second set of deposition conditions resulted in the deposition of a smoother, shinier, epitaxial layer of Cu having few faceted copper crystallites. The faceted nature of the layer deposited under the first set of conditions may be attributed to the presence of a higher concentration of sulphate ($SO_4^{2-}$) ions which can act as a shape control agent by interacting with different facets of the growing copper crystallites differentially to yield specific shapes and textures.

Example 10

Crystalline Platinum Overlayer on Shape Controlled Copper Square Pyramids

Square pyramids of copper were deposited on the surface of a 1 cm×1 cm single-crystal Au(100) substrate using a conventional copper electrodeposition method in which malachite green chloride was used as a shape control agent (Y. J. Han, X. Zhang, G. W. Leach, "Shape Control of Electrodeposited Copper Films and Nanostructures through Additive Effects", Langmuir, 30(12): 3589=3598 (2014)). An aqueous solution of 0.005 M malachite green chloride and 0.05 M copper sulphate ($CuSO_4$) was prepared. Using a standard three electrode cell with a Pt wire counter electrode and the Au(100) substrate as the working electrode, electrodeposition under potentiostatic control at −350 mV with respect to a Ag/AgCl reference electrode for 5 minutes led to the deposition of square pyramids of copper with preferential orientation of pyramid apexes along the surface normal (i.e. orthogonal to the substrate plane and directed away from the substrate). The plated substrate was then used as a substrate for platinum (Pt) electroless deposition. A textured layer of Pt was deposited onto the textured copper substrate. The method and conditions used were identical to those used in Example 1, except that the metal salt employed was chloroplatinic acid ($H_2PtCl_6$). Specifically, 500 μL of $2.5\times10^{-3}$ M $H_2PtCl_{6(aq)}$ was added to 10 mL of a 1 M $NaOH_{(aq)}$ containing the textured copper substrate. Deposition at 60° C. for a period of 2 hours led to a conformal coating of Pt over the highly textured, pyramid-structured, copper layer. Such layers may be useful for catalysis applications that rely on expensive catalysts such as Pt with preferential catalytic activity on their Pt(111) facets, by producing a supported Pt layer with preferential Pt(111) faceting while utilizing less platinum.

Example 11

The Use of Shape Control Agents to Produce Textured Crystalline Films by Electroless Deposition Electroless deposition in the presence of a variety of shape control agents was carried out according to method 10 of FIG. 1. The morphology of the resulting films were observed to depend on the nature of the shape control agent and the concentration of the shape control agent in the electrochemical bath. The following concentrations of metallic material (in the electrochemical bath) were studied: 0.25 M, 0.5 M, 0.75 M and 1.0 M. Salts of the shape control agents were dissolved in 10 mL of 1.0M $NaOH_{(aq)}$. The deposition of metal materials in the presence of the shape control agents was carried out at temperatures in the range of about 50° C. to about 75° C. The following shape control agents were observed to affect the morphology of the gold (Au), silver (Ag), and copper (Cu) layers deposited on planar Ag(100) and Au(100) substrates via electroless deposition: malachite green chloride, polyvinylpyrrolidone (PVP), cetyltrimethylammonium bromide (CTAB), chloride ions ($Cl^-$), nitrate ions ($NO_3^-$), sulphate ions ($SO_4^{2-}$), bromide ions ($Br^-$), and citrate ions ($C_6H_8O_7^-$).

Example 12

The Use of Shape Control Agents to Produce Nanopatterned Textured Crystalline Film by Electroless Deposition Single-crystal Au(100) and/or single-crystal Ag(100) substrates were patterned using the electron beam lithography method described in Example 2. Electroless deposition of silver was carried out on the resulting PMMA-patterned substrate according to method 10 of FIG. 1 in the presence of the shape control agent nitrate ions ($NO_3^-$). Scanning electron microscopy (SEM) of the resulting layers showed the formation of highly faceted silver nanostructures (nanogems) confined to the pores of the patterned substrates. The patterned substrate was immersed in 10 mL of a 1.0 M $NaOH_{(aq)}$ solution. 500 μL of a 0.0025 M $AgNO_{3(aq)}$ solution was added to the $NaOH_{(aq)}$ solution. The temperature of the resulting electrochemical bath was maintained at 60° C. during electroless deposition. The deposition period was 20 minutes. The substrate was then removed from the solution, rinsed in deionized-water for 2 minutes, dried under nitrogen, and the PMMA film was then removed from the substrate by immersion in an acetone bath.

Example 13

Epitaxial Deposition of Copper Oxide on Single-Crystal Ag(100) Substrates

A textured layer of copper oxide ($Cu_2O$) was deposited on the surface of a 1 cm×1 cm Ag(100) single-crystal substrate according to method 10 of FIG. 1. The Ag(100) substrate was immersed in an elelctrochemical bath comprising 10 mL of 4.0 M $NaOH_{(aq)}$ and 500 μL of 0.05 M $Cu(NO_3)_{2(aq)}$. The temperature of the electrochemical bath was maintained at 60° C. and deposition occurred over a period of 2 hours. The substrate was removed from the electrochemical bath, rinsed thoroughly with deionized water, and dried under nitrogen before imaging with a scanning electron microscope (SEM). The resulting SEM images were unlike any of those observed for copper deposition under other conditions, including those resulting from deposition from other copper salts such as $CuSO_4$, $CuCl_2$, or $CuBr_2$, which yielded comparatively smooth and less structured epitaxial copper deposits. In contrast, the morphology of the film was significantly more polycrystalline and resembled morphologies characteristic of $Cu_2O$ films deposited by others (L. Wang, G. Liu, D. Xue, "Effects of supporting electrolyte on galvanic deposition of Cu2O crystals", *Electrochimica Acta*, Vol. 56 (2011) 6277-6283; A. Paracchino, J. C. Brauer, J.-E. Moser, E. Thimsen, M. Graetzel, "Synthesis and Characterization of High-Photoactivity Electrodeposited $Cu_2O$ Solar Absorber by Photoelectrochemistry and Ultrafast Spectroscopy", *J. Phys. Chem. C* (2012), Vol 116, 7341-7350). Accordingly, these conditions produced a textured $Cu_2O$ layer on the Ag(100) substrate and demonstrate the deposition of a metal-containing compound.

Example 14

Figure 26A:
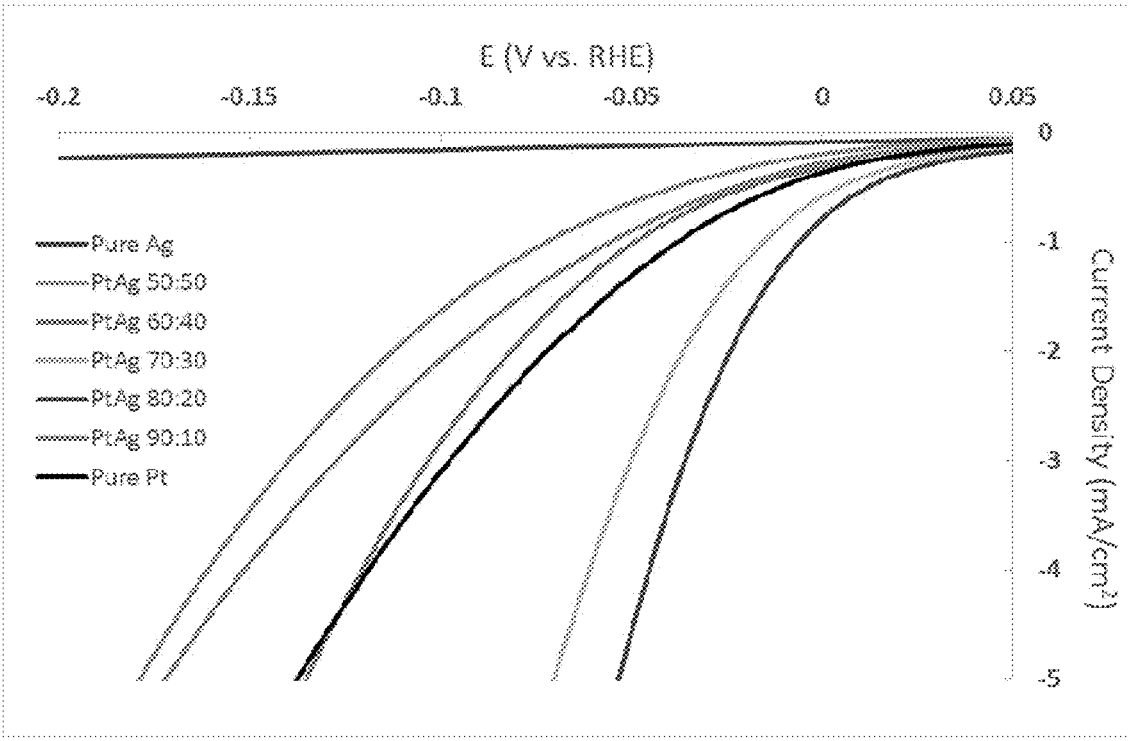
FIG. 26A shows a graph of linear sweep voltammograms performed in 1.0 M NaOH to assess the catalytic activities of a series of $Pt_xAg_y$ alloy catalysts according to an example embodiment of the present invention.
Figure 26B:
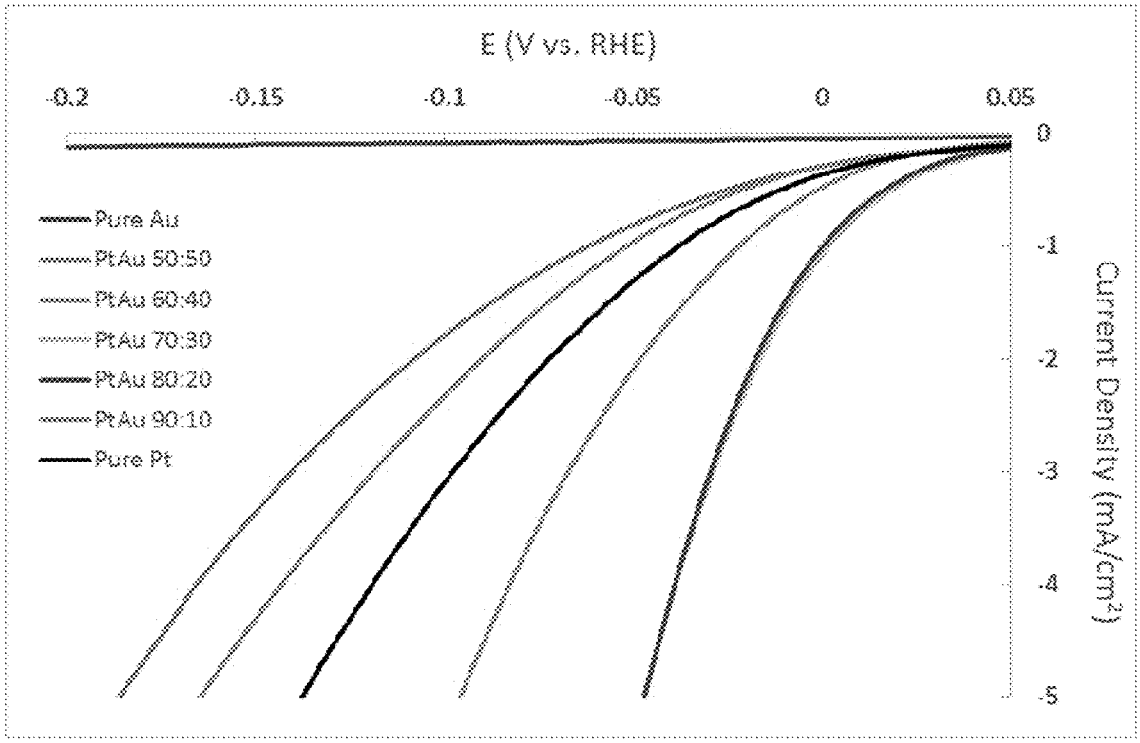
FIG. 26B shows a graph of linear sweep voltammograms performed in 1.0 M NaOH to assess the catalytic activities of a series of $Pt_xAu_y$ alloy catalysts according to an example embodiment of the present invention.
Figure 27B:
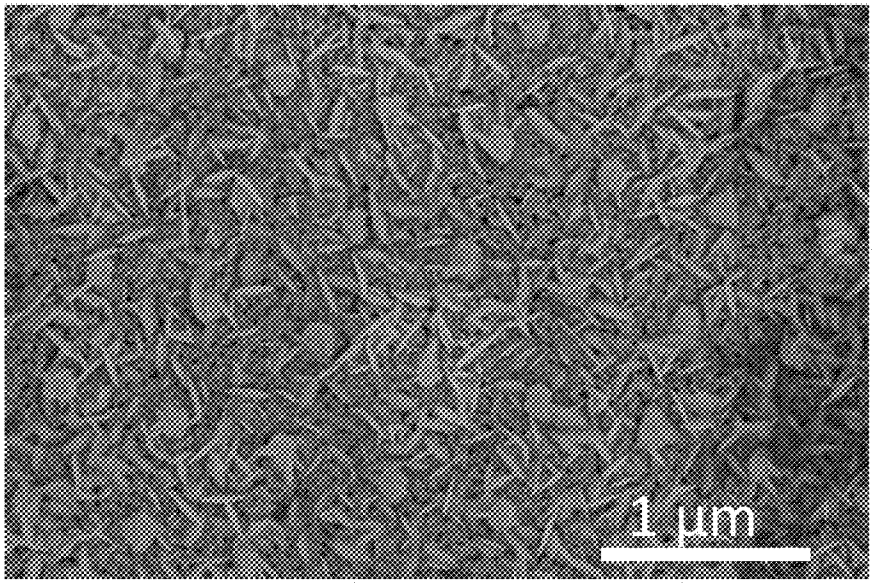
FIG. 27B shows a top view SEM image (1 μm scale bar) of a platinum Pt film deposited on single crystal Au(100) according to an example embodiment of the present invention. The morphology of the resulting film is significantly different from that obtained by deposition on single crystal Ag(100), demonstrating the substrate dependent nature of the deposition.
Figure 27A:
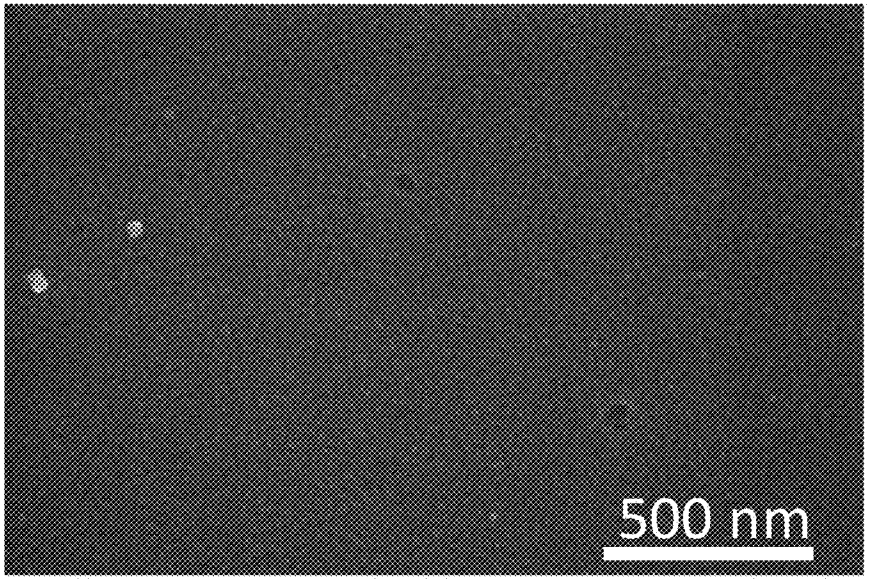
FIG. 27A shows a top view SEM image (500 nm scale bar) of a single crystal platinum Pt(100) film deposited on single crystal Ag(100) according to an example embodiment of the present invention. The morphology of the resulting film is substantially flat and smooth.

Study of Single-Crystal Epitaxial Platinum Based Alloys for Hydrogen Evolution Reaction (HER) Catalysis The catalytic activity of several Pt alloys was evaluated to determine whether a binary alloy of Pt with other noble metals such as Au and Ag would yield a more active hydrogen evolution reaction (HER) catalyst composition than that of pure platinum. Pt:Au and Pt:Ag binary alloys were fabricated according to the conditions listed in Table 2. The Pt:M alloys were formed from 500 μL volume solutions of metal salts formed by mixing appropriate volumes of 0.0025 M $H_2PtCl_6$ with 0.0025 M HAuCl4 for Pt:Au alloys, or with 0.0025 M $AgNO_3$ for Pt:Ag alloys. The 500 μL volume binary mixture of salts was added to a 10 mL solution of 1.0 M $NaOH_{(aq)}$ in the presence of a Ag(100) substrate to form the electrochemical bath. The bath was heated to 60° C. and the deposition period was about 2 hours. Metal concentrations in the bath were determined by the relative volumes of metal salt solutions used. Alloys deposited from baths containing molar ratios of Pt:M ranged from about 19:1 to about 1:19. For example, the 1:1 Pt:Au alloy composition was fabricated from equal 250 μL volumes of Pt salt and Au salt. Under these deposition conditions, the metal ion concentrations in the electrochemical bath were 6.0×10−5 M while the hydroxide concentration was 0.97 M, corresponding to hydroxide to metal molar ratios of 16,300:1. X-ray diffraction studies used to confirm catalyst crystallinity and the presence of Pt-based alloys as described in FIGS. 23-24. Alloy formation was corroborated through X-ray photoelectron spectroscopy (XPS) studies (see FIG. 25). Linear sweep voltammograms were performed in 1.0 M $NaOH_{(aq)}$ to assess the hydrogen evolution reaction catalytic activities of the alloy catalysts (see FIG. 26). A standard three electrode cell was employed for the linear sweep voltammetry measurements. Current associated with the generation of $H_2$ is plotted versus the applied voltage in the cell. A more positive voltage onset and higher HER currents for a given voltage are signatures of better electrocatalytic activity. FIG. 26 indicates that the various alloys have different electrocatalytic activities and that for both Pt:Au and Pt:Ag alloys, the compositions that provide the lowest kinetic overpotentials and highest activities correspond to compositions of approximately 3:1 Pt:M.

These results indicate that certain Pt alloys behave beneficially and preferentially to Pt, one of the best catalyst materials known in acidic and basic media. Note that the alloy composition as described in the figure represents the initial relative concentrations of the corresponding metal salts in the electrochemical baths and may not reflect the surface composition of the alloy, as the respective rates of metal deposition may differ. Further studies are required to ascertain the nature of the surface composition, and to investigate other, potentially more beneficial, formulations. Nevertheless, the ability to form crystalline epitaxial alloys based on some embodiments of the present invention appears to have significant merit. Aspects of this invention to permit a systematic evaluation of catalyst formulations for this (HER) and other important reactions to establish improved catalyst formulations which we claim herein.

Example 15

Electrochemical Deposition in the Presence of Excess Hydroxide

Electroless deposition was carried out using a variety of substrates and a variety of metal salts according to method 10 of FIG. 1. Table 1 (below) describes the processing conditions for each experiment conducted, including the metal salt identity, metal salt concentration, hydroxide concentration, and temperature. An aqueous solution of each metal salt and the corresponding substrate was added to an aqueous solution of hydroxide to derive electrochemical baths having the indicated concentrations of metal ion ($[M^{n+}](M)$) and hydroxide ion ($[OH^-](M)$). For some samples, the substrate was wet with isopropyl alcohol before immersing the substrate in the electrochemical bath. The temperature of the electrochemical bath was controlled and held at temperatures within the indicated temperature range. The resulting textured layer of metallic material deposited on each substrate was examined via one or more of X-ray diffraction, transmission electron microscopy (TEM), and scanning electron microscopy (SEM). Epitaxial deposition of the metallic material is indicated in Table 1. The Table 1 samples are in no way intended to be limiting and are provided to demonstrate the applicability of the present invention for depositing a textured layer of the variety of metallic materials on the variety of substrates disclosed herein in an alkaline electrochemical bath comprising hydroxide ions. Electrochemical deposition under conditions outside those that resulted in the deposition of epitaxial layers yielded textured layers.

TABLE 1

Electroless deposition of textured layers of metallic materials in alkaline electrochemical bath conditions.

| Metal Salt (MX) | $[M^{n+}]$ (M) | $[OH^-]$ (M) | Substrate | Temperature | pH | Molar Ratio $[OH^-]:[M^{n+}]$ |
|---|---|---|---|---|---|---|
| $HAuCl_4$ | $1 \times 10^{-6}$ – 0.04 | 0.01-15 | Silver# | 20-75° C. | 12-15 | about 400:1-about 18,000:1 |
| $HAuCl_4$ | $1 \times 10^{-6}$ – 0.04 | 0.0001-15 | Silver | 20-75° C. | 10-15 | about 50:1-about 400:1 |
| $HAuCl_4$ | $1 \times 10^{-6}$ – 0.03 | 0.01-15 | Gold# | 20-75° C. | 12-15 | about 50:1-about 18,000:1 |
| $HAuCl_4$ | $1 \times 10^{-6}$ – 15 | 0.0001-15 | Gold | 20-75° C. | 10-15 | about 1:1-about 50:1 |
| $HAuCl_4$ | $6.1 \times 10^{-5}$ – $2.4 \times 10^{-3}$ | 0.95-1.1 | Platinum# | 20-75° C. | 10-15 | about 400:1-about 18,00:1 |
| $HAuCl_4$ | $6.1 \times 10^{-5}$ – $2.4 \times 10^{-3}$ | 0.95-1.1 | Palladium# | 20-75° C. | 10-15 | about 400:1-about 18,000:1 |
| $HAuCl_4$ | $6.1 \times 10^{-5}$ – $2.4 \times 10^{-3}$ | 0.95-1.1 | Iridium# | 20 -75°C | 10-15 | about 400:1 - about 18,000:1 |
| $HAuCl_4$ | $6.1 \times 10^{-5}$ – $2.4 \times 10^{-3}$ | 0.95-1.1 | Rhodium# | 20-75° C. | 10-15 | about 400:1-about 18,000:1 |
| $HAuCl_4$ | $6.1 \times 10^{-5}$ – $2.4 \times 10^{-3}$ | 0.95-1.1 | Copper# | 20-75° C. | 10-15 | about 400:1-about 18,000:1 |
| $HAuCl_4$ | $6.1 \times 10^{-5}$ – $2.4 \times 10^{-3}$ | 0.95-1.1 | Cobalt | 20-75° C. | 10-15 | about 400:1-about 18,000:1 |
| $HAuCl_4$ | $6.1 \times 10^{-5}$ – $2.4 \times 10^{-3}$ | 0.95-1.1 | Coin# | 20-75° C. | 10-15 | about 400:1-about 18,000:1 |

TABLE 1-continued

Electroless deposition of textured layers of metallic materials in alkaline electrochemical bath conditions.

| Metal Salt (MX) | $[M^{n+}]$ (M) | $[OH^-]$ (M) | Substrate | Temperature | pH | Molar Ratio $[OH^-]:[M^{n+}]$ |
|---|---|---|---|---|---|---|
| $HAuCl_4$ | $6.1 \times 10^{-5} - 1.2 \times 10^{-3}$ | 0.95-1.1 | Silicon** | 20-75° C. | 10-15 | greater than about 0.1:1 |
| $HAuCl_4$ | $6.1 \times 10^{-5} - 2.4 \times 10^{-3}$ | 0.95-1.1 | ITO | 20-75° C. | 10-15 | about 400:1-about 18,000:1 |
| $HAuCl_4$ | $6.1 \times 10^{-5} - 2.4 \times 10^{-3}$ | 0.95-1.1 | $SnCl_2$ | 20-75° C. | 10-15 | about 400:1 about 18,000:1 |
| $HAuCl_4$ | $6.1 \times 10^{-5} - 2.4 \times 10^{-3}$ | 0.95-1.1 | $PdCl_2$ | 20-75° C. | 10-15 | about 400:1-about 18,000:1 |
| $HAuCl_4$ | $6.1 \times 10^{-5} - 2.4 \times 10^{-3}$ | 0.95-1.1 | $Si_3N_4$* | 20-75° C. | 10-15 | about 400:1-about 18,000:1 |
| $HAuCl_4$ | $6.1 \times 10^{-5} - 2.4 \times 10^{-3}$ | 0.95-1.1 | $SiO_2$* | 20-75° C. | 10-15 | about 400:1 about 18,000:1 |
| $HAuCl_4$ | $6.1 \times 10^{-5} - 2.4 \times 10^{-3}$ | 0.95-1.1 | Polyimide* | 20-75° C. | 10-15 | about 400:1-about 18,000:1 |
| $HAuCl_4$ | $6.1 \times 10^{-5} - 2.4 \times 10^{-3}$ | 0.95-1.1 | PET* | 20-75° C. | 10-15 | about 400:1-about 18,000:1 |
| $HAuCl_4$ | $6.1 \times 10^{-5} - 2.4 \times 10^{-3}$ | 0.95-1.1 | Glass* | 20-75° C. | 10-15 | about 400:1-about 18,000:1 |
| $HAuCl_4$ | $6.1 \times 10^{-5} - 2.4 \times 10^{-3}$ | 0.95-1.1 | PMMA* | 20-75° C. | 10-15 | about 400:1-about 18,000:1 |
| $AgNO_3$ | $6.1 \times 10^{-5} - 2.4 \times 10^{-3}$ | 0.95-4.0 | Silver# | 20-75° C. | 10-15 | about 400:1 about 65,575:1 |
| $AgNO_3$ | $6.1 \times 10^{-5} - 2.4 \times 10^{-3}$ | 0.95-15.0 | Gold# | 20-75° C. | 10-15 | about 400:1-about 250,000:1 |
| $AgNO_3$ | $6.1 \times 10^{-5} - 2.4 \times 10^{-3}$ | 0.95-1.1 | Platinum# | 20-75° C. | 10-15 | about 400:1-about 18,000:1 |
| $AgNO_3$ | $6.1 \times 10^{-5} - 2.4 \times 10^{-3}$ | 0.95-1.1 | Silicon** | 20-75° C. | 10-15 | greater than about 0.1:1 |
| $AgNO_3$ | $6.1 \times 10^{-5} - 2.4 \times 10^{-3}$ | 0.95-1.1 | PET* | 20-75° C. | 10-15 | about 400:1-about 18,000:1 |
| $AgNO_3$ | $6.1 \times 10^{-5} - 2.4 \times 10^{-3}$ | 0.95-4.0 | Glass* | 20-75° C. | 10-15 | about 400:1-about 65,575:1 |
| $CuSO_4$ | $1.1 \times 10^{-4} - 2.4 \times 10^{-3}$ | 0.95-4.0 | Silver# | 60-70° C. | 10-15 | about 400:1-about 36,000:1 |
| $CuSO_4$ | $1.1 \times 10^{-4} - 2.4 \times 10^{-3}$ | 0.95-4.0 | Gold# | 60-70° C. | 10-15 | about 400:1-about 36,000:1 |
| $CuSO_4$ | $1.1 \times 10^{-4} - 2.4 \times 10^{-3}$ | 0.95-15.0 | Copper# | 60-70° C. | 10-15 | about 400:1-about 36,000:1 |
| $CuSO_4$ | $1.1 \times 10^{-4} - 2.4 \times 10^{-3}$ | 0.95-4.0 | Coin~ | 60-70° C. | 10-15 | about 400:1-about 135,000:1 |
| $CuSO_4$ | $1.1 \times 10^{-4} - 2.4 \times 10^{-3}$ | 0.95-4.0 | Platinum# | 60-70° C. | 10-15 | about 400:1-about 36,000:1 |
| $CuSO_4$ | $1.1 \times 10^{-4} - 2.4 \times 10^{-3}$ | 0.95-4.0 | Glass* | 60-70° C. | 10-15 | about 400:1-about 36,000:1 |
| $CuSO_4$ | $1.1 \times 10^{-4} - 2.4 \times 10^{-3}$ | 0.95-4.0 | Silicon | 60-70° C. | 10-15 | about 400:1-about 36,000:1 |
| $CuCl_2$ | $1.1 \times 10^{-4} - 2.4 \times 10^{-3}$ | 0.95-4.0 | Silver# | 60-70° C. | 10-15 | about 400:1-about 36,000:1 |
| $CuCl_2$ | $1.1 \times 10^{-4} - 2.4 \times 10^{-3}$ | 0.95-15.0 | Gold# | 60-70° C. | 10-15 | about 400:1-about 135,000:1 |
| $CuCl_2$ | $1.1 \times 10^{-4} - 2.4 \times 10^{-3}$ | 0.95-15.0 | Copper# | 60-70° C. | 10-15 | about 400:1-about 135,000:1 |
| $CuCl_2$ | $1.1 \times 10^{-4} - 2.4 \times 10^{-3}$ | 0.95-4.0 | Glass* | 60-70° C. | 10-15 | about 400:1-about 36,000:1 |
| $CuCl_2$ | $1.1 \times 10^{-4} - 2.4 \times 10^{-3}$ | 0.95-4.0 | Coin~ | 60-70° C. | 10-15 | about 400:1-about 36,000:1 |
| $CuCl_2$ | $1.1 \times 10^{-4} - 2.4 \times 10^{-3}$ | 0.95-4.0 | Palladium# | 60° C. | 10-15 | about 400:1-about 36,000:1 |
| $CuCl_2$ | $1.1 \times 10^{-4} - 2.4 \times 10^{-3}$ | 0.95-4.0 | Iridium# | 60° C. | 10-15 | about 400:1 - about 36,000:1 |
| $Cu(NO_3)_2$ | $1.1 \times 10^{-4} - 2.4 \times 10^{-3}$ | 0.95-4.0 | Silver# | 60-70° C. | 10-15 | about 400:1-about 36,000:1 |
| $Cu(NO_3)_2$ | $1.1 \times 10^{-4} - 2.4 \times 10^{-3}$ | 0.95-4.0 | Gold# | 60-70° C. | 10-15 | about 400:1-about 36,000:1 |
| $Cu(NO_3)_2$ | $1.1 \times 10^{-4} - 2.4 \times 10^{-3}$ | 0.95-4.0 | Copper# | 60-70° C. | 10-15 | about 400:1-about 36,000:1 |
| $CuBr_2$ | $1.1 \times 10^{-4} - 2.4 \times 10^{-3}$ | 0.95-4.0 | Silver# | 60-70° C. | 10-15 | about 400:1-about 36,000:1 |
| $CuBr_2$ | $1.1 \times 10^{-4} - 2.4 \times 10^{-3}$ | 0.95-4.0 | Gold# | 60-70° C. | 10-15 | about 400:1-about 36,000:1 |

TABLE 1-continued

Electroless deposition of textured layers of metallic materials in alkaline electrochemical bath conditions.

| Metal Salt (MX) | $[M^{n+}]$ (M) | $[OH^-]$ (M) | Substrate | Temperature | pH | Molar Ratio $[OH^-]:[M^{n+}]$ |
|---|---|---|---|---|---|---|
| $CuBr_2$ | $1.1 \times 10^{-4} - 2.4 \times 10^{-3}$ | 0.95-4.0 | Copper# | 60-70° C. | 10-15 | about 400:1-about 36,000:1 |
| $CoCl_2$ | $1.1 \times 10^{-4} - 2.4 \times 10^{-3}$ | 0.95-15.0 | Silver# | 60-70° C. | 10-15 | about 400:1-about 36,000:1 |
| $CoCl_2$ | $1.1 \times 10^{-4} - 2.4 \times 10^{-3}$ | 0.95-15.0 | Gold# | 60-70° C. | 10-15 | about 400:1-about 36,000:1 |
| $CoCl_2$ | $1.1 \times 10^{-4} - 2.4 \times 10^{-3}$ | 0.95-15.0 | Cobalt# | 60-70° C. | 10-15 | about 400:1-about 36,000:1 |
| $CoCl_2$ | $1.1 \times 10^{-4} - 2.4 \times 10^{-3}$ | 0.95-15.0 | Copper# | 60-70° C. | 10-15 | about 400:1-about 36,000:1 |
| $H_2PtCl_6$ | $6.1 \times 10^{-5} - 1.2 \times 10^{-4}$ | 0.95-1.1 | Silver# | 60-75° C. | 10-15 | about 8,000:1-about 18,000:1 |
| $H_2PtCl_6$ | $6.1 \times 10^{-5} - 1.2 \times 10^{-4}$ | 0.95-1.1 | Gold# | 60-75° C. | 10-15 | about 8,000:1-about 18,000:1 |
| $H_2PtCl_6$ | $6.1 \times 10^{-5} - 1.2 \times 10^{-4}$ | 0.95-1.1 | Platinum# | 60-75° C. | 10-15 | about 8,000:1-about 18,000:1 |
| $H_2PtCl_6$ | $6.1 \times 10^{-5} - 1.2 \times 10^{-4}$ | 0.95-1.1 | Copper | 60-75° C. | 10-15 | about 8,000:1-about 18,000:1 |
| $H_2PtCl_6$ | $6.1 \times 10^{-5} - 1.2 \times 10^{-4}$ | 0.95-1.1 | Glass* | 60-75° C. | 10-15 | about 8,000:1-about 18,000:1 |
| $PdCl_2$ | $6.1 \times 10^{-5} - 2.4 \times 10^{-3}$ | 0.95-1.1 | Silver# | 60-75° C. | 10-15 | about 400:1-about 18,000:1 |
| $PdCl_2$ | $6.1 \times 10^{-5} - 2.4 \times 10^{-3}$ | 0.95-1.1 | Gold# | 60-75° C. | 10-15 | about 400:1-about 18,000:1 |
| $PdCl_2$ | $6.1 \times 10^{-5} - 2.4 \times 10^{-3}$ | 0.95-1.1 | Platinum# | 60-75° C. | 10-15 | about 400:1-about 18,000:1 |
| $PdCl_2$ | $6.1 \times 10^{-5} - 2.4 \times 10^{-3}$ | 0.95-1.1 | Palladium# | 60-75° C. | 10-15 | about 400:1-about 18,000:1 |
| $IrCl_2$ | $6.1 \times 10^{-5} - 2.4 \times 10^{-3}$ | 0.95-1.1 | Silver# | 60-75° C. | 10-15 | about 400:1-about 18,000:1 |
| $IrCl_2$ | $6.1 \times 10^{-5} - 2.4 \times 10^{-3}$ | 0.95-1.1 | Palladium# | 60-75° C. | 10-15 | about 400:1-about 18,000:1 |
| $IrCl_2$ | $6.1 \times 10^{-5} - 2.4 \times 10^{-3}$ | 0.95-1.1 | Iridium# | 60-75° C. | 10-15 | about 400:1-about 18,000:1 |
| $RhCl_2$ | $6.1 \times 10^{-5} - 2.4 \times 10^{-3}$ | 0.95-1.1 | Silver# | 60-75° C. | 10-15 | about 400:1-about 18,000:1 |
| $RhCl_2$ | $6.1 \times 10^{-5} - 2.4 \times 10^{-3}$ | 0.95-1.1 | Iridium# | 60-75° C. | 10-15 | about 400:1-about 18,000:1 |
| $RhCl_2$ | $6.1 \times 10^{-5} - 2.4 \times 10^{-3}$ | 0.95-1.1 | Rhodium# | 60-75° C. | 10-15 | about 400:1-about 18,000:1 |

#If Refers to deposition that is epitaxial, as inferred from X-Ray diffraction, transmission electron microscopy, and/or scanning electron microscopy data.

"Coin" refers to a Canadian dime comprising 92% steel, 5.5% copper, and 2.5% nickel.

*Refers to deposition that is facilitated by wetting the substrate with isopropyl alcohol prior to immersing the substrate in the electrochemical bath.

**Conditions in which ($[OH^-] < [M^{n+}]$) could be beneficial for deposition of metal from metal ions which have a higher reduction potential than a semiconductor substrate (e.g. Si, Ge, etc.). In this case, the metal ion excess may be reduced on the surface of the semiconductor through galvanic replacement to form nanocrystallites of the metal. In a parallel process, the metal ion may also be reduced by oxidizing hydroxide, which acts as the reducing agent. This may lead to deposition of the metal by galvanic replacement-mediated reduction on semiconductor materials.

Example 16

Electrochemical Alloy Deposition in the Presence of Excess Hydroxide

Electroless deposition was carried out using a variety of substrates and a variety of metal alloys according to method 10 of FIG. 1. Table 2 (below) describes the processing conditions for each experiment conducted, including the metal alloy identity, metal salt concentrations, hydroxide concentration, and temperature. The metal ion precursor solutions had the indicated concentrations of metal ions ($[M_1^{m+}]$(M), $[M_2^{n+}]$(M), $[M_3^{p+}]$(M), and $[M_4^{q+}]$(M), wherein $M_1$=first metal salt precursor, $M_2$=second metal salt precursor, $M_3$=third metal salt precursor, and $M_4$=fourth metal salt precursor) and hydroxide ion ($[OH^-]$(M)). A 500 μL aqueous solution comprised of the metallic material precursors (i.e. the indicated metal salts for each sample) was prepared by selecting appropriate volumes of each metal precursor solution. For the binary alloys in which the two metal precursor solutions have the same concentration, the relative volumes of each precursor solution comprising the 500 μL volume determines the fractional concentrations of each metal ion. Metal ion concentrations can be calculated accordingly. For example, a 1:1 Au:Ag alloy precursor solution is formed by combining 250 μL of each of the 0.0025 M $HAuCl_4$ and $AgNO_3$ solutions. The resulting 500 μL mixture is added to 1 mL of 1.0 M $NaOH_{(aq)}$ in most cases, to form the electrochemical bath. In the case of the binary alloy formed from cobalt and gold salts, and the quaternary alloy formed from copper, gold, silver and cobalt salts, indicated by the asterisks in Table 2, a volume of 500 μL of each metal salt solution was combined prior to addition to the 10 mL of 4.0 M hydroxide containing solution (Co:Au binary alloy) or 10 mL of 10.0 M hydroxide containing solution (Cu:Au:Ag:Co quaternary alloy), to form the respective electrochemical baths.

Deposition was carried out at 60° C. for a period of 2 hours. The resulting textured layer of metal alloy was deposited on a 1 cm×1 cm single crystal silver Ag(100) substrate. Each deposited alloy film was examined via one or more of X-ray diffraction, transmission electron microscopy (TEM), and scanning electron microscopy (SEM). Epitaxial deposition of the metal alloy is indicated in Table 2. The composition of each metallic material precursor (i.e. metal salt) contained in the electrochemical bath (and the relative rates of metal deposition) was anticipated to influence the composition of the deposited alloy. The samples listed in Table 2 are in no way intended to be limiting and are provided to demonstrate the applicability of the present invention for depositing a textured layer of the variety of metal alloys on the variety of substrates disclosed herein in an alkaline electrochemical bath comprising hydroxide ions.

TABLE 2

Electroless deposition of textured layers of metallic materials in alkaline electrochemical bath conditions.

| Metal Alloy | $[M_1^{n+}]$ (M) | $[M_2^{n+}]$ (M) | $[M_3^{n+}]$ (M) | $[M_4^{n+}]$ (M) | $[OH^-]$ (M) | pH | $[M_1^{m+}]:[M_2^{n+}]$ | $[OH^-]:[M_1]$/ $[OH^-]:[M_2]$/ $[OH^-]:[M_3]$/ $[OH^-]:[M_4]$ |
|---|---|---|---|---|---|---|---|---|
| Au:Ag | 0.0025 $HAuCl_4$ | 0.0025 $AgNO_3$ | | | 0.97M | 10-15 | 1:10-10:1 | 14,000:1/ 120,000:1 |
| Au:Pt | 0.0025 $HAuCl_4$ | 0.0025 $H_2PtCl_6$ | | | 0.97M | 10-15 | 1:20-20:1 | 10,000:1/ 240,000:1 |
| Ag:Pt | 0.0025 $AgNO_3$ | 0.0025 $H_2PtCl_6$ | | | 0.97M | 10-15 | 1:20-20:1 | 10,000:1/ 240,000:1 |
| Au:Pd | 0.0025 $HAuCl_4$ | 0.0025 $PdCl_2$ | | | 0.97M | 10-15 | 1:10-10:1 | 14,000:1/ 120,000:1 |
| Ag:Pd | 0.0025 $AgNO_3$ | 0.0025 $PdCl_2$ | | | 0.97M | 10-15 | 1:10-10:1 | 14,000:1/ 120,000:1 |
| Co:Au* | 0.024 $CoCl_2$ | 0.0025 $HAuCl_4$ | | | 3.64M | 10-15 | 10:1 | 4000:1/ 40,000:1 |
| Co:Cu | 0.024 $CoCl_2$ | 0.05 $CuSO_4$ | | | 3.81M | 10-15 | 1:2 | 6,700:1/ 13,500 |
| Cu:Au | 0.024 $CuSO_4$ | 0.0025 $HAuCl_4$ | | | 0.97M | 10-15 | 10:1 | 1700:1/ 17,000:1 |
| Cu:Pt | 0.024 $CuSO_4$ | 0.0025 $H_2PtCl_6$ | | | 0.97M | 10-15 | 10:1 | 1700:1/ 17,000:1 |
| Cu:Au: Ag:Co* | 0.05 $CuCl_2$ | 0.025 $HAuCl_4$ | 0.05 $AgNO_3$ | 0.05 $CoCl_2$ | 8.33M | 10-15 | 2:1:2:2 | 4200:1/ 2100:1/ 4200:1/ 4200:1 |

*In the case of the binary alloy formed from cobalt and gold salts, and the quaternary alloy formed from copper, gold, silver and cobalt salts, indicated by the asterisks, a volume of 500 μL of each metal salt solution was combined prior to addition to the 10 mL of 4.0M hydroxide containing solution (Co:Au binary alloy) or 10 mL of 10.0M hydroxide containing solution (Cu:Au:Ag:Co quaternary alloy), to form the respective electrochemical baths. Metal ion concentrations can be calculated accordingly.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are consistent with the broadest interpretation of the specification as a whole.

The invention claimed is:

1. A method of electrochemical deposition of a metallic material onto a substrate, the method comprising:

providing an alkaline solution of hydroxide ions;

immersing a metallic material precursor and the substrate into the alkaline solution to form an electrochemical bath;

controlling a molar ratio of a concentration of hydroxide ions to a concentration of the metallic material precursor in the electrochemical bath to selectively adjust electrochemical deposition of the metallic material; and electrochemically depositing a textured layer of the metallic material onto the substrate, the electrochemical deposition of the metallic material comprising an electroless deposition wherein all electrons for the electroless deposition come from the hydroxide ions, the hydroxide ions acting as the reducing agent for the electroless deposition.

2. A method according to claim 1 wherein controlling the molar ratio of a concentration of hydroxide ions to a concentration of the metallic material precursor in the electrochemical bath to selectively adjust electrochemical deposition of the metallic material comprises controlling the ratio to permit epitaxial deposition.

3. A method according to claim 1, wherein controlling the molar ratio of a concentration of hydroxide ions to a concentration of the metallic material precursor in the electrochemical bath to selectively adjust electrochemical deposition of the metallic material comprises controlling the ratio to permit deposition of a single-crystal layer.

4. A method according to claim 1, wherein controlling the molar ratio of a concentration of hydroxide ions to a concentration of the metallic material precursor in the electrochemical bath to selectively adjust electrochemical deposition of the metallic material comprises controlling the ratio to permit deposition of a polycrystalline layer.

5. A method according to claim 1, wherein controlling the molar ratio of a concentration of hydroxide ions to a concentration of the metallic material precursor in the electrochemical bath to selectively adjust electrochemical deposition of the metallic material comprises controlling the ratio to substantially prevent galvanic replacement.

6. A method according to claim 5, wherein the molar ratio of the concentration of the hydroxide ions to the concentration of the metallic material precursor in the electrochemical bath is greater than about 400:1.

7. A method according to claim 1, wherein controlling the molar ratio of concentration of hydroxide ions to a concentration of the metallic material precursor in the electrochemical bath to selectively adjust electrochemical deposition of the metallic material comprises controlling the ratio to substantially prevent precipitation of the metallic material precursor in the electrochemical bath.

8. A method according to claim 1, wherein immersing the metallic material precursor comprises making a solution of the metallic material precursor and adding the resulting metallic material precursor solution to the alkaline solution.

9. A method according to claim 1, further comprising adding at least one of an additive or a shape control agent to at least one of the alkaline solution, a solution of the metallic material precursor, or the electrochemical bath.

10. A method according to claim 9, wherein the shape control agent is added to at least one of the alkaline solution, a solution of the metal material precursor, or the electrochemical bath, and the shape control agent comprises one or more of malachite green chloride, polyvinylpyrrolidone (PVP), cetyltrimethylammonium bromide (CTAB), chloride ions (Cl—), sulphate ions (S042-) and nitrate ions (NO3-).

11. A method according to claim 1, wherein the pH of the electrochemical bath is in the range of about 10 to about 15.

12. A method according to claim 1, wherein the substrate is not susceptible to galvanic replacement in the presence of the metallic material precursor and wherein the molar ratio of the concentration of the hydroxide ions to the concentration of the metallic material precursor in the electrochemical bath is in the range of about 50:1 to about 400:1.

13. A method according to claim 1, wherein the substrate is not susceptible to oxidation in the presence of the metallic material precursor and wherein the molar ratio of the concentration of the hydroxide ions to the concentration of the metallic material precursor in the electrochemical bath is greater than about 50:1.

14. A method according to claim 1 wherein immersing the metallic material precursor into the alkaline solution comprises immersing a plurality of metallic material precursors into the alkaline solution and wherein the deposited textured layer of the metallic material comprises an alloy.

15. A method according to claim 1, wherein the substrate is patterned.

16. A method according to claim 15, wherein the substrate is patterned according to one or more of the following: a lithographic process, wet etching, dry etching, electrodeposition, electroless deposition, physical vapor deposition, chemical deposition, and atomic layer deposition.

17. A method according to claim 1 wherein the metallic material precursor is characterized by one of:

the metallic material precursor comprising a metal salt containing gold and a molar ratio of hydroxide ions to gold ions while electrochemically depositing the textured layer of the metallic material onto the substrate is between about 400:1 and about 18000:1;

the metallic material precursor comprising a metal salt containing silver and a molar ratio of hydroxide ions to silver ions while electrochemically depositing the textured layer of the metallic material onto the substrate is between about 400:1 and about 36000:1;

the metallic material precursor comprising a metal salt containing copper and a molar ratio of hydroxide ions to copper ions while electrochemically depositing the textured layer of the metallic material onto the substrate is between about 400:1 and about 36000:1;

the metallic material precursor comprising a metal salt containing cobalt and a molar ratio of hydroxide ions to cobalt ions while electrochemically depositing the textured layer of the metallic material onto the substrate is between about 400:1 and about 36000:1;

the metallic material precursor comprising a metal salt containing palladium and a molar ratio of hydroxide ions to palladium ions while electrochemically depositing the textured layer of the metallic material onto the substrate is between about 400:1 and about 18000:1;

the metallic material precursor comprising a metal salt containing iridium and a molar ratio of hydroxide ions to iridium ions while electrochemically depositing the textured layer of the metallic material onto the substrate is between about 400:1 and 18000:1;

the metallic material precursor comprising a metal salt containing rhodium and a molar ratio of hydroxide ions to rhodium ions while electrochemically depositing the textured layer of the metallic material onto the substrate is between about 400:1 and 18000:1; or the metallic material precursor comprising a metal salt containing platinum and a molar ratio of hydroxide ions to platinum ions while electrochemically depositing the textured layer of the metallic material onto the substrate is between about 400:1 and about 18000:1.

18. The method according to claim 1 wherein controlling the molar ratio of a concentration of hydroxide ions to a concentration of the metallic material precursor in the electrochemical bath to selectively adjust electrochemical deposition of the metallic material comprises controlling the ratio to form metal hydroxide complexes in the electrochemical bath.

19. A method of electrochemical deposition of a textured nanoparticle, the method comprising:

providing an alkaline solution of hydroxide ions;

immersing a metallic material precursor into the alkaline solution to form an electrochemical bath;

controlling a molar ratio of a concentration of hydroxide ions to a concentration of the metallic material precursor in the electrochemical bath to selectively adjust electrochemical deposition of the metallic material; and forming textured nanoparticles in the electrochemical bath, forming the textured nanoparticles comprising an electroless deposition wherein all electrons for the electroless deposition come from the hydroxide ions, the hydroxide ions acting as the reducing agent for the electroless deposition.

20. A method of electrochemical deposition of a metallic material onto a nanoparticle, the method comprising:

providing an alkaline solution of hydroxide ions;

immersing a metallic material precursor and the nanoparticle into the alkaline solution to form an electrochemical bath; and depositing a textured layer of the metallic material onto the nanoparticle, depositing the textured layer of the metallic material onto the nanoparticle comprising an electroless deposition wherein all electrons for the electroless deposition come from the hydroxide ions, the hydroxide ions acting as the reducing agent for the electroless deposition.

* * * * *